US010575116B2

(12) United States Patent
Seldess

(10) Patent No.: US 10,575,116 B2
(45) Date of Patent: Feb. 25, 2020

(54) SPECTRAL DEFECT COMPENSATION FOR CROSSTALK PROCESSING OF SPATIAL AUDIO SIGNALS

(71) Applicant: Boomcloud 360, Inc., Encinitas, CA (US)

(72) Inventor: Zachary Seldess, San Diego, CA (US)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 16/013,804

(22) Filed: Jun. 20, 2018

(65) Prior Publication Data

US 2019/0394600 A1 Dec. 26, 2019

(51) Int. Cl.
*H04S 7/00* (2006.01)
*H04S 3/00* (2006.01)
(Continued)

(52) U.S. Cl.
CPC ..... *H04S 7/303* (2013.01); *H04R 3/04* (2013.01); *H04R 3/14* (2013.01); *H04R 5/02* (2013.01);
(Continued)

(58) Field of Classification Search
CPC ..... H04S 7/303; H04S 3/008; H04S 2400/01; H04S 2400/05; H04S 2400/13;
(Continued)

(56) References Cited

U.S. PATENT DOCUMENTS

2008/0031462 A1 2/2008 Walsh et al.
2008/0031466 A1* 2/2008 Buck ..... H04M 9/082 381/66
(Continued)

FOREIGN PATENT DOCUMENTS

TW 201804462 A 2/2018
WO WO 2010/094812 A2 8/2010
WO WO 2017/074321 A1 5/2017

OTHER PUBLICATIONS

PCT International Search Report and Written Opinion, PCT Application No. PCT/US2018/041125, dated Mar. 18, 2019, ten pages.
(Continued)

*Primary Examiner* — Vivian C Chin
*Assistant Examiner* — Douglas J Suthers
(74) *Attorney, Agent, or Firm* — Fenwick & West LLP

(57) ABSTRACT

An audio system provides for spatial enhancement, crosstalk processing, and crosstalk compensation of an input audio signal. The crosstalk compensation compensates for spectral defects caused by the application of the crosstalk processing to a spatially enhanced signal. The crosstalk compensation may be performed prior to the crosstalk processing, after the crosstalk processing, or in parallel with the crosstalk processing. The crosstalk compensation includes applying filters to the mid and side components of the left and right input channels to compensate for spectral defects from crosstalk processing of the audio signal. The crosstalk processing may include crosstalk simulation or crosstalk cancellation. In some embodiments, the crosstalk compensation may be integrated with a subband spatial processing that spatially enhances the audio signal.

22 Claims, 41 Drawing Sheets

(51) Int. Cl.
*H04R 3/14* (2006.01)
*H04R 3/04* (2006.01)
*H04R 5/02* (2006.01)

(52) U.S. Cl.
CPC ..... *H04S 3/008* (2013.01); *H04S 2400/01* (2013.01); *H04S 2400/05* (2013.01); *H04S 2400/13* (2013.01); *H04S 2420/07* (2013.01)

(58) Field of Classification Search
CPC ..... H04S 2420/07; H04R 3/04; H04R 3/14; H04R 5/02
USPC ..... 381/303
See application file for complete search history.

(56) References Cited

U.S. PATENT DOCUMENTS

| | | | | |
|---|---|---|---|---|
| 2008/0273721 | A1 | 11/2008 | Walsh | |
| 2013/0156202 | A1 | 6/2013 | Hamacher | |
| 2017/0208411 | A1 | 7/2017 | Seldess et al. | |
| 2017/0230777 | A1 | 8/2017 | Seldess et al. | |
| 2018/0124512 | A1* | 5/2018 | Wen ..... | H04R 3/007 |

OTHER PUBLICATIONS

Taiwan Intellectual Property Office, Office Action, TW Patent Application No. 107123899, Aug. 19, 2019, 15 pages.

* cited by examiner

Add name for the line next to numeral

2100

2700

| Crosstalk Delay 1536/1546 (samps) @48KHz | 1 | 2 | 3 | 4 | 5 | 6 | 7 | 8 | 9 | 10 | 11 | 12 | 13 |
|---|---|---|---|---|---|---|---|---|---|---|---|---|---|
| Filter 1532/1542 Fc (Hz) | 1000 | 750 | 650 | 600 | 500 | 485 | 415 | 390 | 380 | 360 | 340 | 330 | 320 |
| Filter 1532/1542 Gain (dB) | 12.5 | 9 | 8 | 7 | 6 | 5.5 | 5 | 4.5 | 4.25 | 4 | 3.5 | 3 | 3.5 |
| Filter 1532/1542 Q | 0.4 | 0.45 | 0.65 | 0.65 | 0.65 | 0.75 | 0.75 | 0.75 | 0.75 | 0.75 | 0.75 | 0.75 | 0.75 |

FIG. 27A

2750

| Crosstalk Delay 1536/1546 (samps) @48KHz | 1 | 2 | 3 | 4 | 5 | 6 | 7 | 8 | 9 | 10 | 11 | 12 | 13 |
|---|---|---|---|---|---|---|---|---|---|---|---|---|---|
| Filter 1532/1542 Fc (Hz) | 750 | 575 | 500 | 425 | 400 | 375 | 300 | 300 | 300 | 280 | 260 | 250 | 250 |
| Filter 1532/1542 Gain (dB) | 15 | 11 | 10 | 8.75 | 8 | 7.25 | 7 | 6.5 | 5.5 | 5.5 | 5 | 5 | 5 |
| Filter 1532/1542 Q | 0.35 | 0.4 | 0.4 | 0.45 | 0.45 | 0.45 | 0.6 | 0.6 | 0.6 | 0.6 | 0.6 | 0.5 | 0.5 |

FIG. 27B

SPECTRAL DEFECT COMPENSATION FOR CROSSTALK PROCESSING OF SPATIAL AUDIO SIGNALS

BACKGROUND

1. Field of the Disclosure

Embodiments of the present disclosure generally relate to the field of audio signal processing and, more particularly, to crosstalk processing of spatially enhanced multi-channel audio.

2. Description of the Related Art

Stereophonic sound reproduction involves encoding and reproducing signals containing spatial properties of a sound field. Stereophonic sound enables a listener to perceive a spatial sense in the sound field from a stereo signal using headphones or loudspeakers. However, processing of the stereophonic sound by combining the original signal with delayed and possibly inverted or phase-altered versions of the original can produce audible and often perceptually unpleasant comb-filtering artifacts in the resulting signal. The perceived effects of such artifacts can range from mild coloration to significant attenuation or amplification of particular sonic elements within a mix (i.e. voice receding, etc.).

SUMMARY

Embodiments relate to enhancing an audio signal including a left input channel and a right input channel. A nonspatial component and a spatial component are generated from the left input channel and the right input channel. A mid compensation channel is generated by applying first filters to the nonspatial component that compensate for spectral defects from crosstalk processing of the audio signal. A side compensation channel is generated by applying second filters to the spatial component that compensate for spectral defects from the crosstalk processing of the audio signal. A left compensation channel and a right compensation channel are generated from the mid compensation channel and the side compensation channel. A left output channel is generated using the left compensation channel, and a right output channel is generated using the right compensation channel.

In some embodiments, crosstalk processing and subband spatial processing are performed on the audio signal. The crosstalk processing may include a crosstalk cancellation, or a crosstalk simulation. Crosstalk simulation may be used to generate output to head-mounted speakers to simulate crosstalk that may be experienced using loudspeakers. Crosstalk cancellation may be used to generate output to loudspeakers to remove crosstalk that may be experienced using the loudspeakers. The crosstalk processing may be performed prior to, subsequent to, or in parallel with the crosstalk cancellation. The subband spatial processing includes applying gains to the subbands of a nonspatial component and a spatial component of the left and right input channels. The crosstalk processing compensates for spectral defects caused by the crosstalk cancellation or crosstalk simulation, with or without the subband spatial processing.

In some embodiments, a system enhances an audio signal having a left input channel and a right input channel. The system includes circuitry configured to: generate a nonspatial component and a spatial component from the left input channel and the right input channel, generate a mid compensation channel by applying first filters to the nonspatial component that compensate for spectral defects from crosstalk processing of the audio signal, and generate a side compensation channel by applying second filters to the spatial component that compensate for spectral defects from the crosstalk processing of the audio signal. The circuitry is further configured to generate a left compensation channel and a right compensation channel from the mid compensation channel and the side compensation channel, and generates a left output channel using the left compensation channel; and generate a right output channel using the right compensation channel.

In some embodiments, the crosstalk compensation is integrated with subband spatial processing. The left input channel and the right input channel are processed into a spatial component and a nonspatial component. First subband gains are applied to subbands of the spatial component to generate an enhanced spatial component, and second subband gains are applied to subbands of the nonspatial component to generate an enhanced nonspatial component. A mid enhanced compensation channel is generated by applying filters to the enhanced nonspatial component. The mid enhanced compensation channel includes the enhanced nonspatial component having compensation for spectral defects from crosstalk processing of the audio signal. A left enhanced compensation channel and a right enhanced compensation channel are generated from the mid enhanced compensation channel. A left output channel is generated from the left compensation channel, and a right output channel is generated from the right enhanced compensation channel.

In some embodiments, a side enhanced compensation channel is generated by applying second filters to the enhanced spatial component, the side enhanced compensation channel including the enhanced spatial component having compensation for spectral defects from the crosstalk processing of the audio signal. The left enhanced compensation channel and the right enhanced compensation channel are generated from the mid enhanced compensation channel and the side enhanced compensation channel.

Other aspects include components, devices, systems, improvements, methods, processes, applications, computer readable mediums, and other technologies related to any of the above.

BRIEF DESCRIPTION OF THE DRAWINGS

FIGS. 27A and 27B illustrate tables of filter settings for a crosstalk compensation processor as a function of crosstalk cancellation delays, according to one embodiment.

DETAILED DESCRIPTION

The features and advantages described in the specification are not all inclusive and, in particular, many additional features and advantages will be apparent to one of ordinary skill in the art in view of the drawings, specification, and claims. Moreover, it should be noted that the language used in the specification has been principally selected for readability and instructional purposes, and may not have been selected to delineate or circumscribe the inventive subject matter.

The Figures (FIG.) and the following description relate to the preferred embodiments by way of illustration only. It should be noted that from the following discussion, alternative embodiments of the structures and methods disclosed herein will be readily recognized as viable alternatives that may be employed without departing from the principles of the present invention.

Reference will now be made in detail to several embodiments of the present invention(s), examples of which are illustrated in the accompanying figures. It is noted that wherever practicable similar or like reference numbers may be used in the figures and may indicate similar or like functionality. The figures depict embodiments for purposes of illustration only. One skilled in the art will readily recognize from the following description that alternative embodiments of the structures and methods illustrated herein may be employed without departing from the principles described herein.

The audio systems discussed herein provide crosstalk processing for spatially enhanced audio signals. The crosstalk processing may include crosstalk cancellation for loudspeakers, or crosstalk simulation for headphones. An audio system that performs crosstalk processing for spatially enhanced signals may include a crosstalk compensation processor that adjusts for spectral defects resulting from the crosstalk processing of audio signals, with or without spatial enhancement.

Figure 1A:
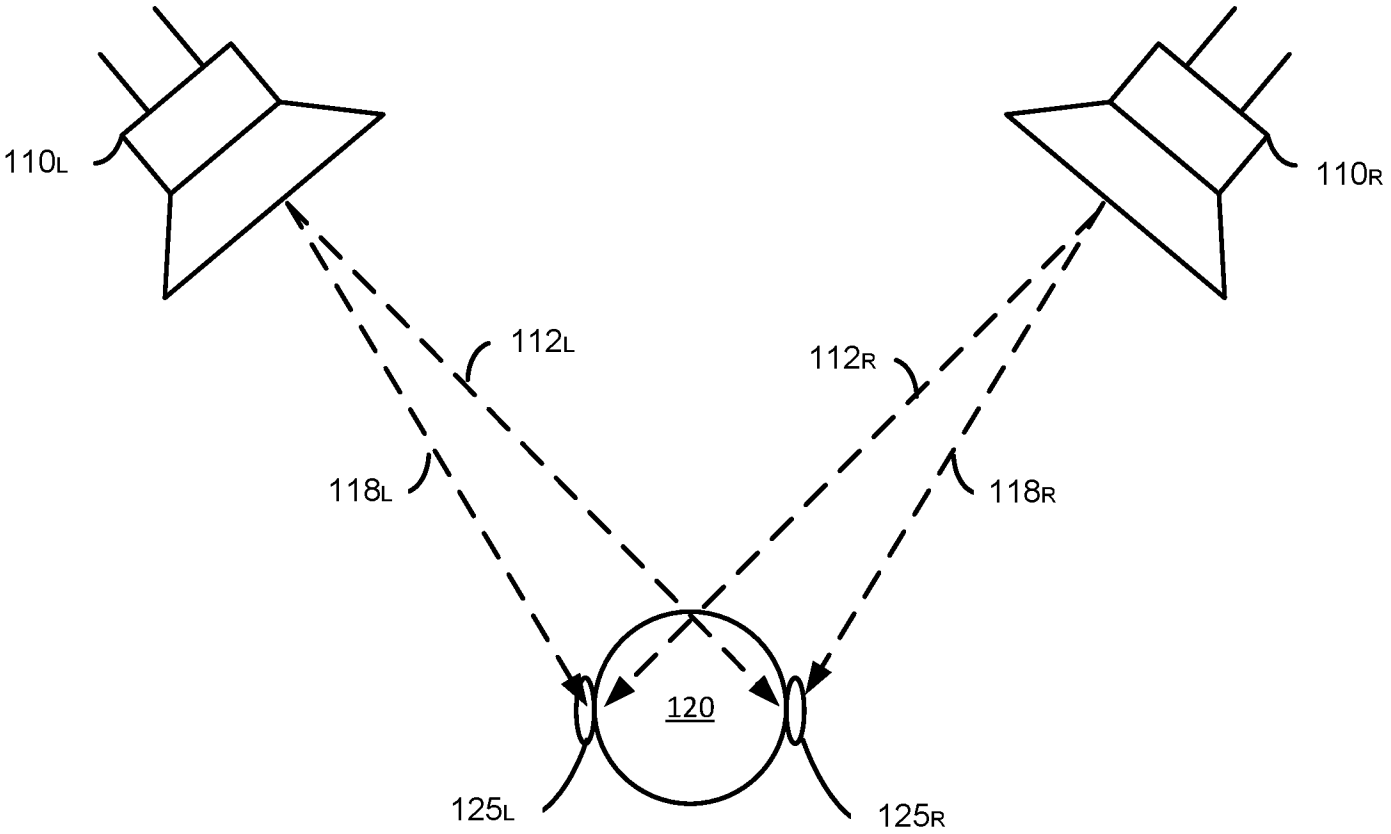
FIG. 1A illustrates an example of a stereo audio reproduction system for loudspeakers, according to one embodiment.

In a loudspeaker arrangement such as illustrated in FIG. 1A, sound waves produced by both of the loudspeakers $\mathbf{110}_L$ and $\mathbf{110}_R$ are received at both the left and right ears $\mathbf{125}_L$, $\mathbf{125}_R$ of the listener 120. The sound waves from each of the loudspeakers $\mathbf{110}_L$ and $\mathbf{110}_R$ have a slight delay between left ear $\mathbf{125}_L$ and right ear $\mathbf{125}_R$, and filtering caused by the head of the listener 120. A signal component (e.g., $\mathbf{118}_L$, $\mathbf{118}_R$) output by a speaker on the same side of the listener's head and received by the listener's ear on that side is herein referred to as "an ipsilateral sound component" (e.g., left channel signal component received at left ear, and right channel signal component received at right ear) and a signal component (e.g., $\mathbf{112}_L$, $\mathbf{112}_R$) output by a speaker on the opposite side of the listener's head is herein referred to as "a contralateral sound component" (e.g., left channel signal component received at right ear, and right channel signal component received at left ear). Contralateral sound components contribute to crosstalk interference, which results in diminished perception of spatiality. Thus, a crosstalk cancellation may be applied to the audio signals input to the loudspeakers 110 to reduce the experience of crosstalk interference by the listener 120.

Figure 1B:
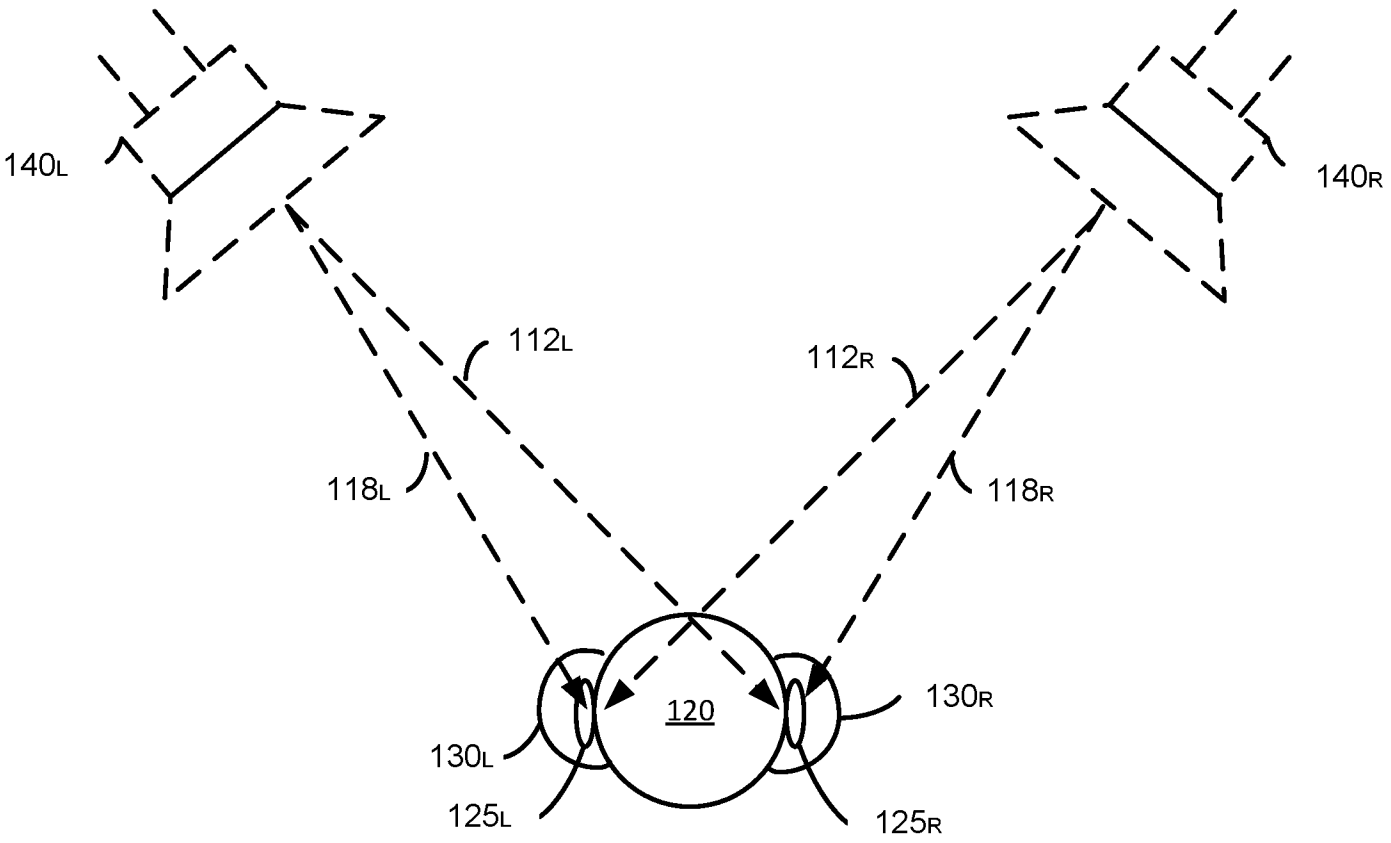
FIG. 1B illustrates an example of a stereo audio reproduction system for headphones, according to one embodiment.

In a head-mounted speaker arrangement such as illustrated in FIG. 1B, a dedicated left speaker $\mathbf{130}_L$ emits sound into the left ear $\mathbf{125}_L$ and a dedicated right speaker $\mathbf{130}_R$ emits sound into the right ear $\mathbf{125}_R$. Head-mounted speakers emit sound waves close to the user's ears, and therefore generate lower or no trans-aural sound wave propagation, and thus no contralateral components that cause crosstalk interference. Each ear of the listener 120 receives an ipsilateral sound component from a corresponding speaker, and no contralateral crosstalk sound component from the other speaker. Accordingly, the listener 120 will perceive a different, and typically smaller sound field with head-mounted speakers. Thus, a crosstalk simulation may be applied to the audio signals input to the head-mounted speakers 110 to simulate crosstalk interference as would be experienced by the listener 120 when the audio signals are output by imaginary loudspeaker sound sources $\mathbf{140}_L$ and $\mathbf{140}_R$.

Example Audio System

FIGS. 2A, 2B, 3, and 4 show examples of audio systems that perform crosstalk cancellation with a spatially enhanced audio signal E. These audio systems each receive an input signal X, and generate an output signal O for loudspeakers having reduced crosstalk interference. FIGS. 5A, 5B, 5C, 6, and 7 show examples of audio systems that perform crosstalk simulation with a spatially enhanced audio signal. These audio systems receive the input signal X, and generate an output signal O for head-mounted speakers that simulates crosstalk interference as would be experienced using loudspeakers. The crosstalk cancellation and crosstalk simulation are also referred to as "crosstalk processing." In each of the audio systems shown in FIGS. 2A through 7, a crosstalk compensation processor removes spectral defects caused by the crosstalk processing of the spatially enhanced audio signal.

The crosstalk compensation may be applied in various ways. In one example, crosstalk compensation is performed prior to the crosstalk processing. For example, crosstalk compensation may be performed in parallel with subband spatial processing of the input audio signal X to generate a combined result, and the combined result may subsequently receive crosstalk processing. In another example, the crosstalk compensation is integrated with the subband spatial processing of the input audio signal, and the output of the subband spatial processing subsequently receives the crosstalk processing. In another example, the crosstalk compensation may be performed after crosstalk processing is performed on the spatially enhanced signal E.

In some embodiments, the crosstalk compensation may include enhancement (e.g., filtering) of mid components and side components of the input audio signal X. In other embodiments, the crosstalk compensation enhances only the mid components, or only the side components.

Figure 2A:
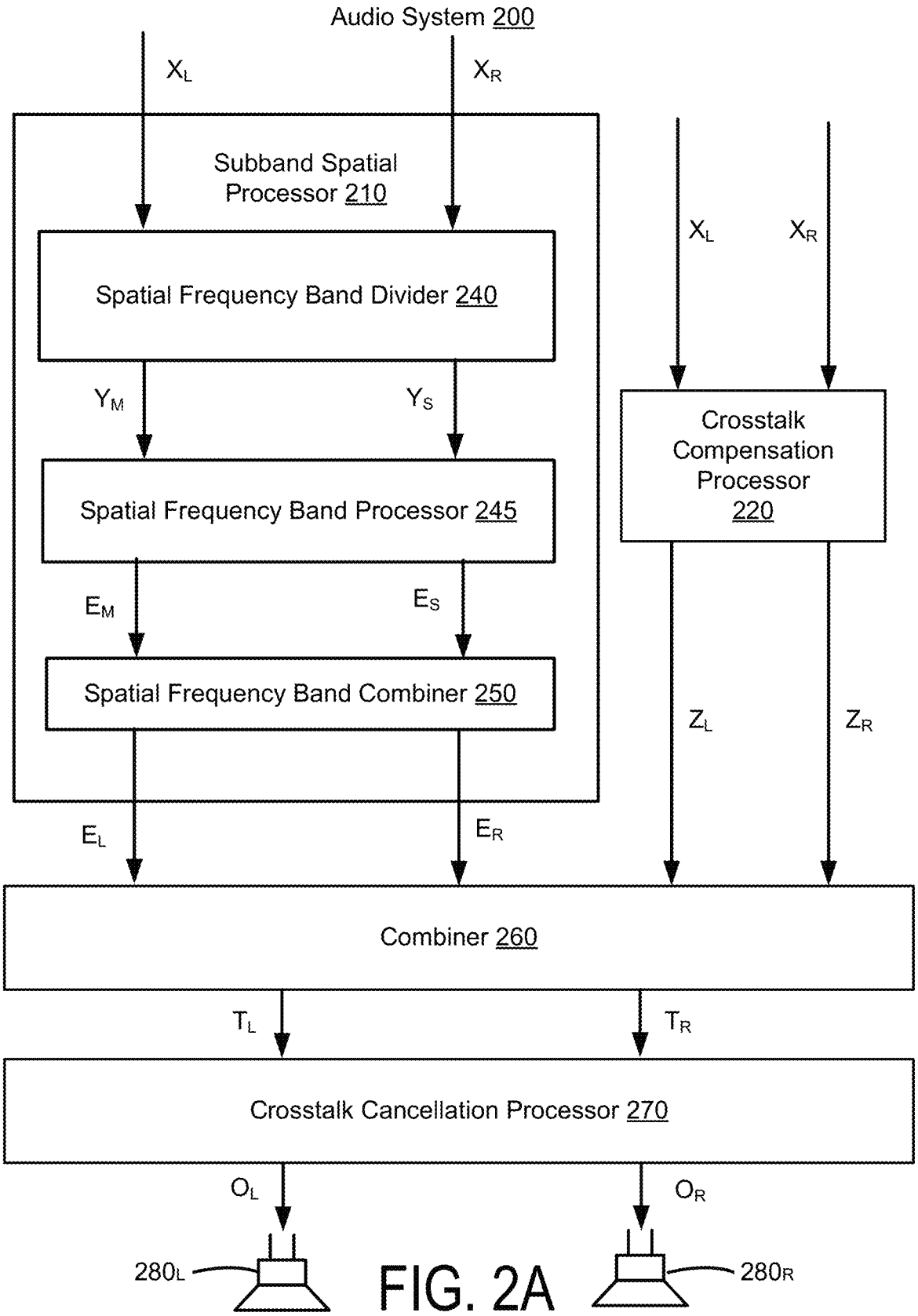
FIG. 2A illustrates an example of an audio system for performing crosstalk cancellation with a spatially enhanced audio signal, according to one embodiment.

FIG. 2A illustrates an example of an audio system 200 for performing crosstalk cancellation with a spatially enhanced audio signal, according to one embodiment. The audio system 200 receives an input audio signal X including a left input channel $X_L$ and a right input channel $X_R$. In some embodiments, the input audio signal X is provided from a source component in a digital bitstream (e.g., PCM data). The source component may be a computer, digital audio player, optical disk player (e.g., DVD, CD, Blu-ray), digital audio streamer, or other source of digital audio signals. The audio system 200 generates an output audio signal O including two output channels $O_L$ and $O_R$ by processing the input channels $X_L$ and $X_R$. The audio output signal O is a spatially enhanced audio signal of the input audio signal X with crosstalk compensation and crosstalk cancellation. Although not shown in FIG. 2A, the audio system 200 may further include an amplifier that amplifies the output audio signal O from the crosstalk cancellation processor 270, and provides the signal O to output devices, such as the loudspeakers $\mathbf{280}_L$ and $\mathbf{280}_R$, that convert the output channels $O_L$ and $O_R$ into sound.

The audio processing system 200 includes a subband spatial processor 210, a crosstalk compensation processor 220, a combiner 260, and a crosstalk cancellation processor 270. The audio processing system 200 performs crosstalk compensation and subband spatial processing of the input audio input channels $X_L$, $X_R$, combines the result of the subband spatial processing with the result of the crosstalk compensation, and then performs a crosstalk cancellation on the combined signals.

The subband spatial processor 210 includes a spatial frequency band divider 240, a spatial frequency band processor 245, and a spatial frequency band combiner 250. The spatial frequency band divider 240 is coupled to the input channels $X_L$ and $X_R$ and the spatial frequency band processor 245. The spatial frequency band divider 240 receives the left input channel $X_L$ and the right input channel $X_R$, and processes the input channels into a spatial (or "side") component $Y_s$ and a nonspatial (or "mid") component $Y_m$. For example, the spatial component $Y_s$ can be generated based on a difference between the left input channel $X_L$ and the right input channel $X_R$. The nonspatial component $Y_m$ can be generated based on a sum of the left input channel $X_L$ and the right input channel $X_R$. The spatial frequency band divider 240 provides the spatial component $Y_s$ and the nonspatial component $Y_m$ to the spatial frequency band processor 245. Additional details regarding the spatial frequency band divider is discussed below in connection with FIG. 12.

The spatial frequency band processor 245 is coupled to the spatial frequency band divider 240 and the spatial frequency band combiner 250. The spatial frequency band processor 245 receives the spatial component $Y_s$ and the nonspatial component $Y_m$ from spatial frequency band divider 240, and enhances the received signals. In particular, the spatial frequency band processor 245 generates an enhanced spatial component $E_s$ from the spatial component $Y_s$, and an enhanced nonspatial component $E_m$ from the nonspatial component $Y_m$.

For example, the spatial frequency band processor 245 applies subband gains to the spatial component $Y_s$ to generate the enhanced spatial component $E_s$, and applies subband gains to the nonspatial component $Y_m$ to generate the enhanced nonspatial component $E_m$. In some embodiments, the spatial frequency band processor 245 additionally or alternatively provides subband delays to the spatial component $Y_s$ to generate the enhanced spatial component $E_s$, and subband delays to the nonspatial component $Y_m$ to generate the enhanced nonspatial component $E_m$. The subband gains and/or delays may can be different for the different (e.g., n) subbands of the spatial component $Y_s$ and the nonspatial component $Y_m$, or can be the same (e.g., for two or more subbands). The spatial frequency band processor 245 adjusts the gain and/or delays for different subbands of the spatial component $Y_s$ and the nonspatial component $Y_m$ with respect to each other to generate the enhanced spatial component $E_s$ and the enhanced nonspatial component $E_m$. The spatial frequency band processor 245 then provides the enhanced spatial component $E_s$ and the enhanced nonspatial component $E_m$ to the spatial frequency band combiner 250. Additional details regarding the spatial frequency band divider is discussed below in connection with FIG. 13.

The spatial frequency band combiner 250 is coupled to the spatial frequency band processor 245, and further coupled to the combiner 260. The spatial frequency band combiner 250 receives the enhanced spatial component $E_s$ and the enhanced nonspatial component $E_m$ from the spatial frequency band processor 245, and combines the enhanced spatial component $E_s$ and the enhanced nonspatial component $E_m$ into a left spatially enhanced channel $E_L$ and a right spatially enhanced channel $E_R$. For example, the left spatially enhanced channel $E_L$ can be generated based on a sum of the enhanced spatial component $E_s$ and the enhanced nonspatial component $E_m$, and the right spatially enhanced channel $E_R$ can be generated based on a difference between the enhanced nonspatial component $E_m$ and the enhanced spatial component $E_s$. The spatial frequency band combiner 250 provides the left spatially enhanced channel $E_L$ and the right spatially enhanced channel $E_R$ to the combiner 260.

Additional details regarding the spatial frequency band divider is discussed below in connection with FIG. 14.

The crosstalk compensation processor 220 performs a crosstalk compensation to compensate for spectral defects or artifacts in the crosstalk cancellation. The crosstalk compensation processor 220 receives the input channels $X_L$ and $X_R$, and performs a processing to compensate for any artifacts in a subsequent crosstalk cancellation of the enhanced nonspatial component $E_m$ and the enhanced spatial component $E_s$ performed by the crosstalk cancellation processor 270. In some embodiments, the crosstalk compensation processor 220 may perform an enhancement on the nonspatial component $X_m$ and the spatial component $X_s$ by applying filters to generate a crosstalk compensation signal Z, including a left crosstalk compensation channel $Z_L$ and a right crosstalk compensation channel $Z_R$. In other embodiments, the crosstalk compensation processor 220 may perform an enhancement on only the nonspatial component $X_m$. Additional details regarding crosstalk compensation processors are discussed below in connection with FIGS. 8 through 10.

The combiner 260 combines the left spatially enhanced channel $E_L$ with the left crosstalk compensation channel $Z_L$ to generate a left enhanced compensation channel $T_L$, and combines the right spatially enhanced channel $E_R$ with the right crosstalk compensation channel $Z_R$ to generate a right enhanced compensation channel $T_R$. The combiner 260 is coupled to the crosstalk cancellation processor 270, and provides the left enhanced compensation channel $T_L$ and the right enhanced compensation channel $T_R$ to the crosstalk cancellation processor 270. Additional details regarding the combiner 260 are discussed below in connection with FIG. 18.

The crosstalk cancellation processor 270 receives the left enhanced compensation channel $T_L$ and the right enhanced compensation channel $T_R$, and performs crosstalk cancellation on the channels $T_L$, $T_R$ to generate the output audio signal O including left output channel $O_L$ and right output channel $O_R$. Additional details regarding the crosstalk cancellation processor 270 are discussed below in connection with FIG. 15.

Figure 2B:
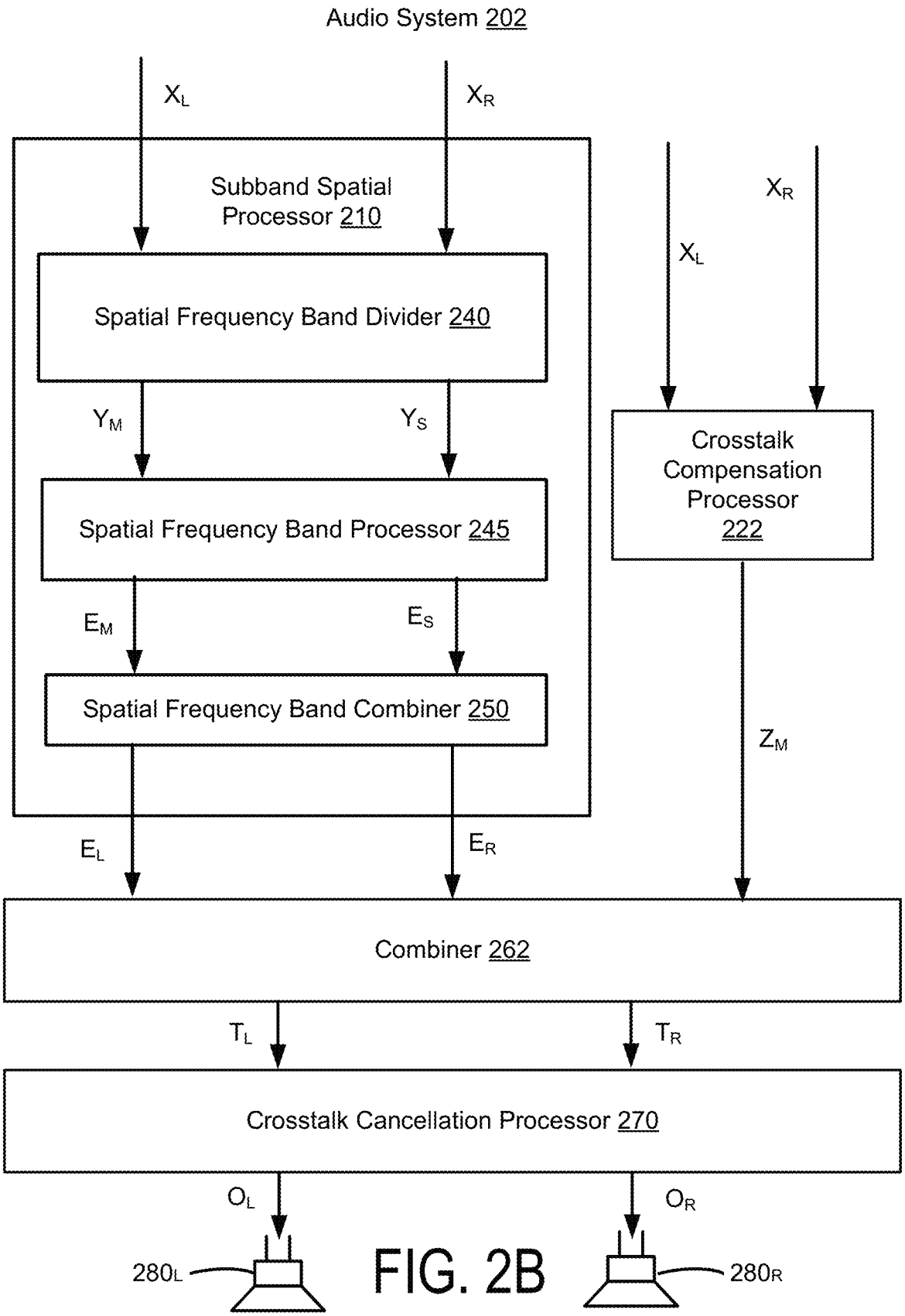
FIG. 2B illustrates an example of an audio system for performing crosstalk cancellation with a spatially enhanced audio signal, according to one embodiment.

FIG. 2B illustrates an example of an audio system 202 for performing crosstalk cancellation with a spatially enhanced audio signal, according to one embodiment. The audio system 202 includes the subband spatial processor 210, a crosstalk compensation processor 222, a combiner 262, and the crosstalk cancellation processor 270. The audio system 202 is similar to the audio system 200, except that the crosstalk compensation processor 222 performs an enhancement on the nonspatial component $X_m$ by applying filters to generate a mid crosstalk compensation signal $Z_m$. The combiner 262 combines the mid crosstalk compensation signal $Z_m$ with the left spatially enhanced channel $E_L$ and the right spatially enhanced channel $E_R$ from the subband spatial processor 210. Additional details regarding the crosstalk compensation processor 222 are discussed below in connection with FIG. 10, and the additional details regarding the combiner 262 are discussed below in connection with FIG. 18.

Figure 3:
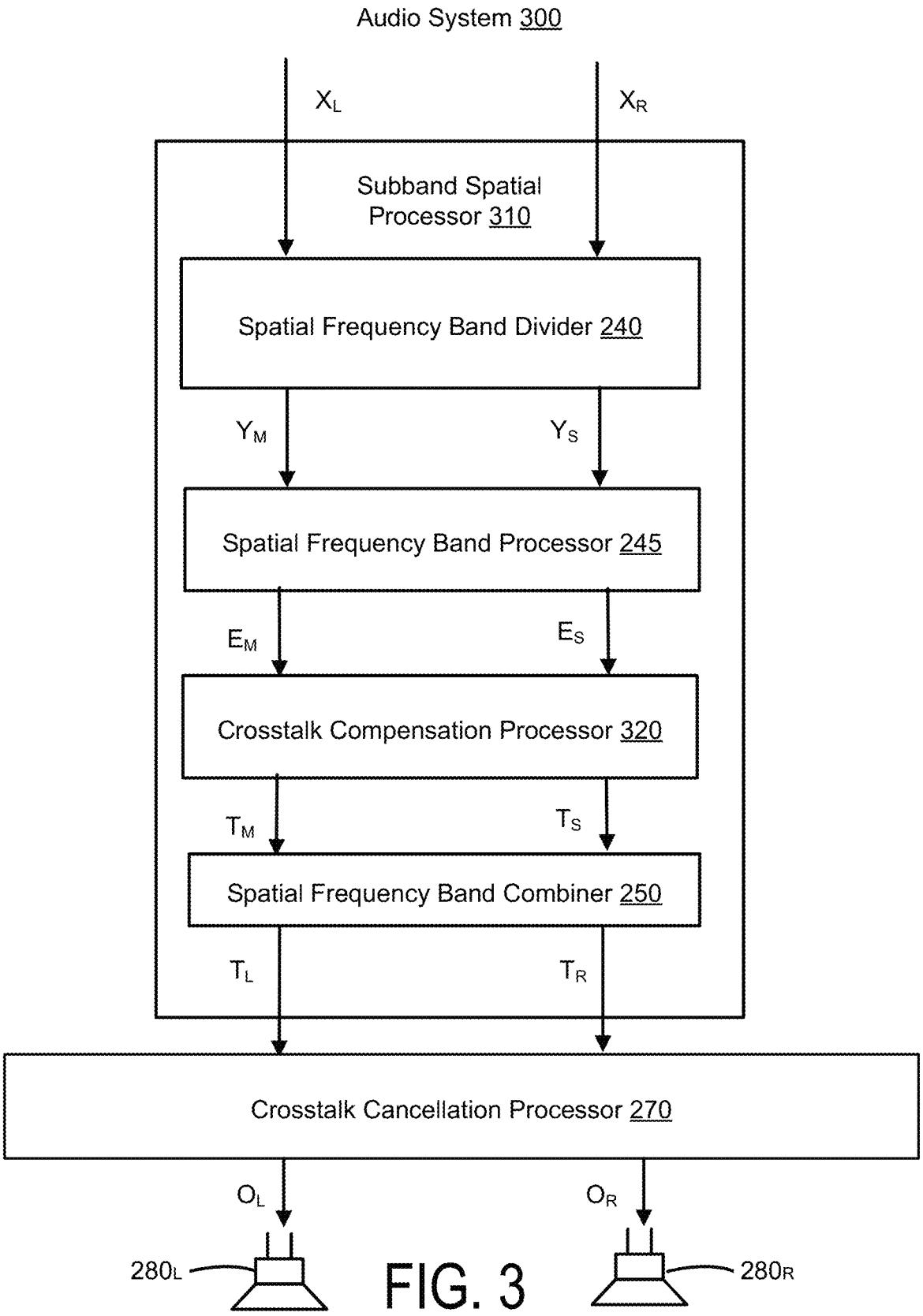
FIG. 3 illustrates an example of an audio system for performing crosstalk cancellation with a spatially enhanced audio signal, according to one embodiment.

FIG. 3 illustrates an example of an audio system 300 for performing crosstalk cancellation with a spatially enhanced audio signal, according to one embodiment. The audio system 300 includes a subband spatial processor 310 including a crosstalk compensation processor 320, and further includes a crosstalk cancellation processor 270. The subband spatial processor 310 includes the spatial frequency band divider 240, the spatial frequency band processor 245, a crosstalk compensation processor 320, and the spatial frequency band combiner 250. Unlike the audio systems 200 and 202 shown in FIGS. 2A and 2B, the crosstalk compensation processor 320 is integrated with the subband spatial processor 310.

In particular, the crosstalk compensation processor 320 is coupled to the spatial frequency band processor 245 to receive the enhanced nonspatial component $E_m$ and the enhanced spatial component $E_s$, performs the crosstalk compensation using the enhanced nonspatial component $E_m$ and the enhanced spatial component $E_s$ (e.g., rather than the input signal X as discussed above for the audio systems 200 and 202) to generate a mid enhanced compensation channel $T_m$ and a side enhanced compensation channel $T_s$. The spatial frequency band combiner 250 receives the mid enhanced compensation channel $T_m$ and a side enhanced compensation channel $T_s$, and generates the left enhanced compensation channel $T_L$ and the right enhanced compensation channel $T_R$. The crosstalk cancellation processor 270 generates output audio signal O including left output channel $O_L$ and right output channel $O_R$ by performing the crosstalk cancellation on the left enhanced compensation channel $T_L$ and the right enhanced compensation channel $T_R$. Additional details regarding the crosstalk compensation processor 320 are discussed below in connection with FIG. 11.

Figure 4:
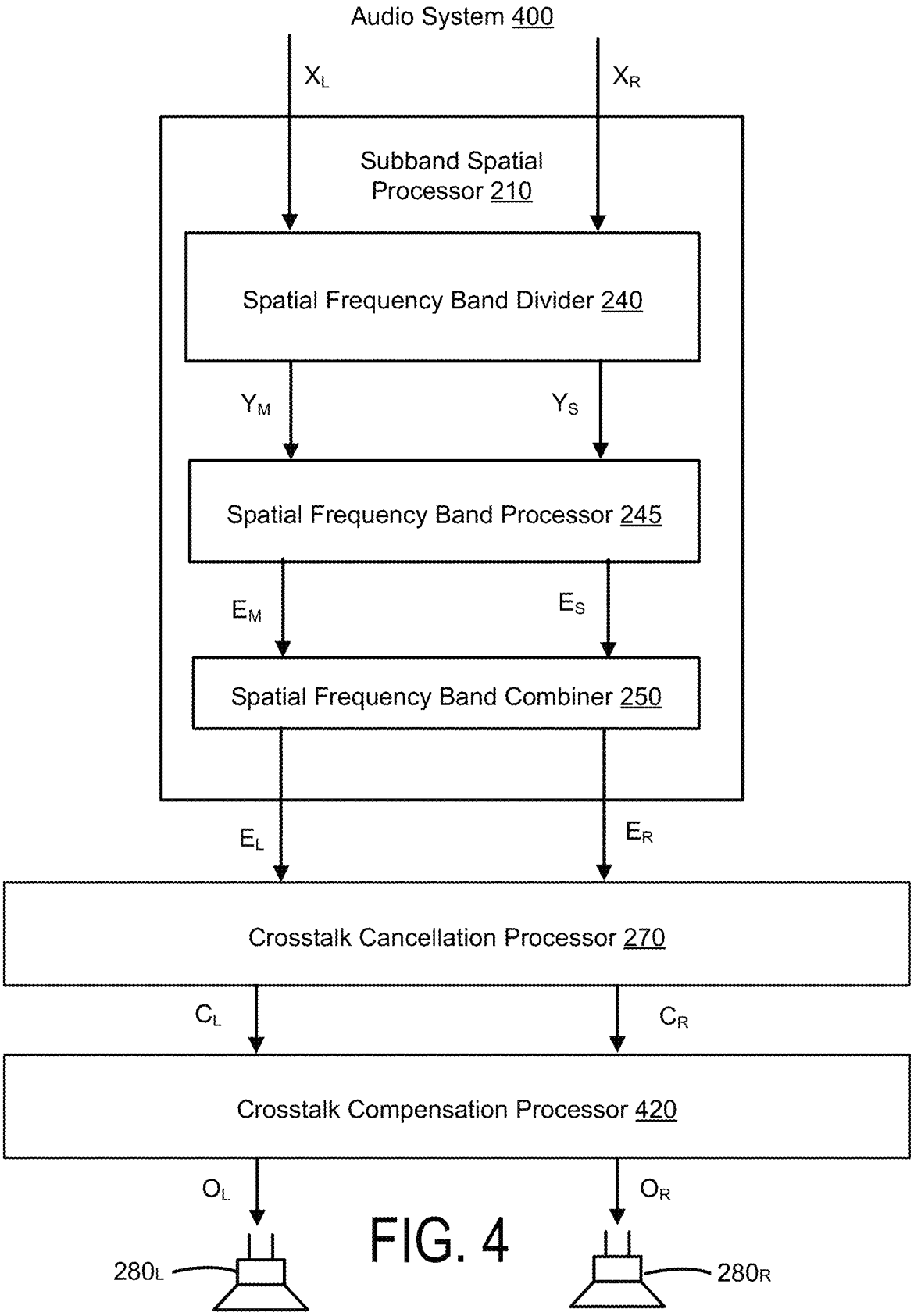
FIG. 4 illustrates an example of an audio system for performing crosstalk cancellation with a spatially enhanced audio signal, according to one embodiment.

FIG. 4 illustrates an example of an audio system 400 for performing crosstalk cancellation with a spatially enhanced audio signal, according to one embodiment. Unlike the audio systems 200, 202, and 300, the audio system 400 performs crosstalk compensation after crosstalk cancellation. The audio system 400 includes the subband spatial processor 210 coupled to the crosstalk cancellation processor 270. The crosstalk cancellation processor 270 is coupled to a crosstalk compensation processor 420. The crosstalk cancellation processor 270 receives the left spatially enhanced channel $E_L$ and the right spatially enhanced channel $E_R$ from the subband spatial processor 210, and performs a crosstalk cancellation to generate a left enhanced in-out-band crosstalk channel $C_L$ and a right enhanced in-out-band crosstalk channel $C_R$. The crosstalk compensation processor 420 receives the left enhanced in-out-band crosstalk channel $C_L$ and a right enhanced in-out-band crosstalk channel $C_R$, and performs a crosstalk compensation using the mid and side components of the left enhanced in-out-band crosstalk channel $C_L$ and a right enhanced in-out-band crosstalk channel $C_R$ to generate the left output channel $O_L$ and right output channel $O_R$. Additional details regarding the crosstalk compensation processor 420 are discussed below in connection with FIGS. 8 and 9.

Figure 5A:
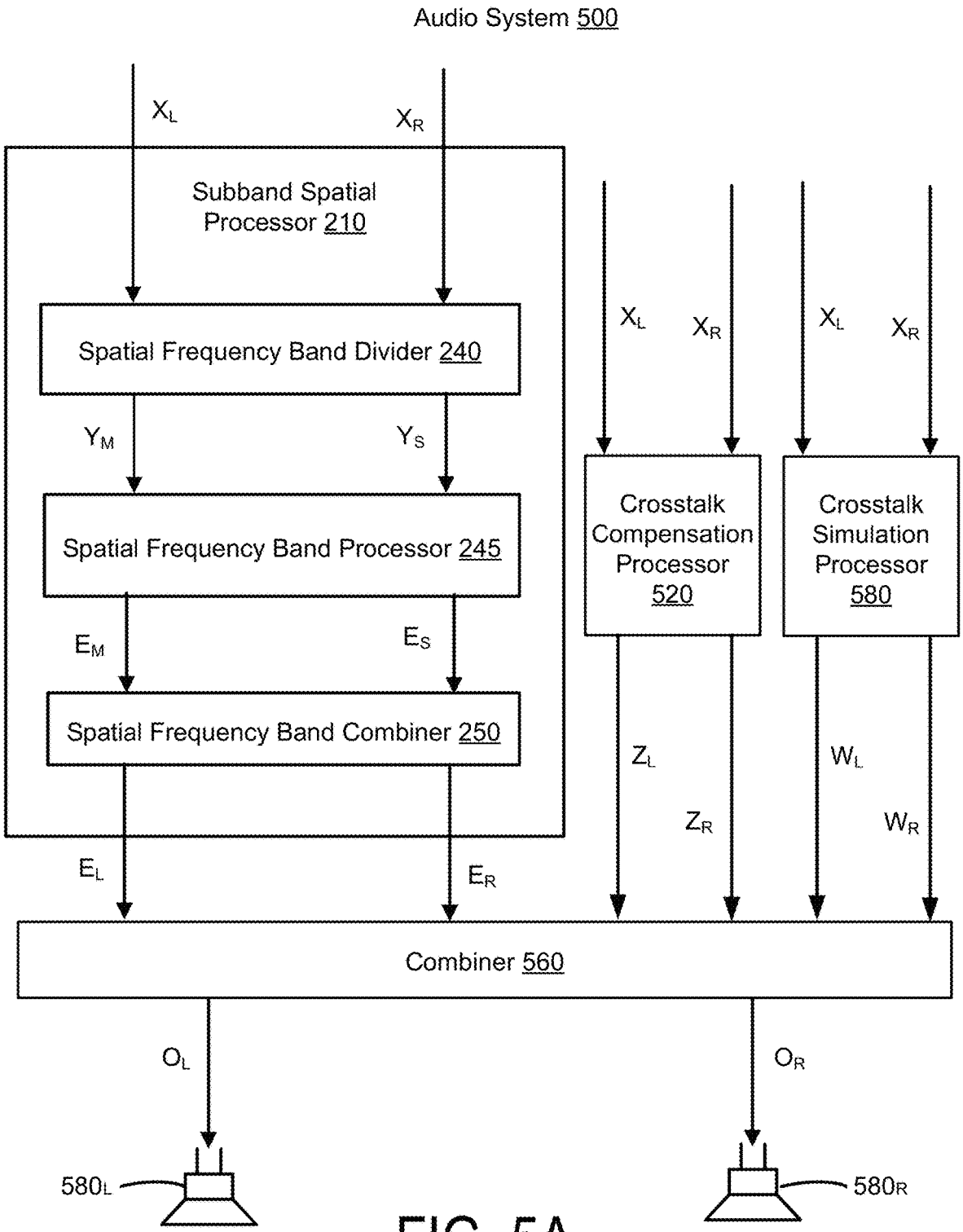
FIG. 5A illustrates an example of an audio system for performing crosstalk simulation with a spatially enhanced audio signal, according to one embodiment.

FIG. 5A illustrates an example of an audio system 500 for performing crosstalk simulation with a spatially enhanced audio signal, according to one embodiment. The audio system 500 performs crosstalk simulation for the input audio signal X to generate an output audio signal O including a left output channel $O_L$ for a left head-mounted speaker $\mathbf{580}_L$ and a right output channel $O_R$ for a right head-mounted speaker $\mathbf{580}_R$. The audio system 500 includes the subband spatial processor 210, a crosstalk compensation processor 520, a crosstalk simulation processor 580, and a combiner 560.

The crosstalk compensation processor 520 receives the input channels $X_L$ and $X_R$, and performs a processing to compensate for artifacts in a subsequent combination of a crosstalk simulation signal W generated by the crosstalk simulation processor 580 and the enhanced channel E. The crosstalk compensation processor 520 generates a crosstalk compensation signal Z, including a left crosstalk compensation channel $Z_L$ and a right crosstalk compensation channel $Z_R$. The crosstalk simulation processor 580 generates a left crosstalk simulation channel $W_L$ and a right crosstalk simulation channel $W_R$. The subband spatial processor 210 generates the left enhanced channel $E_L$ and the right enhanced channel $E_R$. Additional details regarding the crosstalk compensation processor 520 are discussed below in connection with FIGS. 9 and 10. Additional details regarding the crosstalk simulation processor 580 are discussed below in connection with FIGS. 16A and 16B.

The combiner 560 receives the left enhanced channel $E_L$, the right enhanced channel $E_R$, the left crosstalk simulation channel $W_L$, the right crosstalk simulation channel $W_R$, the left crosstalk compensation channel $Z_L$, and a right crosstalk compensation channel $Z_R$. The combiner 560 generates the left output channel $O_L$ by combining the left enhanced channel $E_L$, the right crosstalk simulation channel $W_R$, and the left crosstalk compensation channel $Z_L$. The combiner 560 generates the right output channel $O_R$ by combining the left enhanced channel $E_L$, the right crosstalk simulation channel $W_R$, and the left crosstalk compensation channel $Z_L$. Additional details regarding the combiner 560 are discussed below in connection with FIG. 19.

Figure 5B:
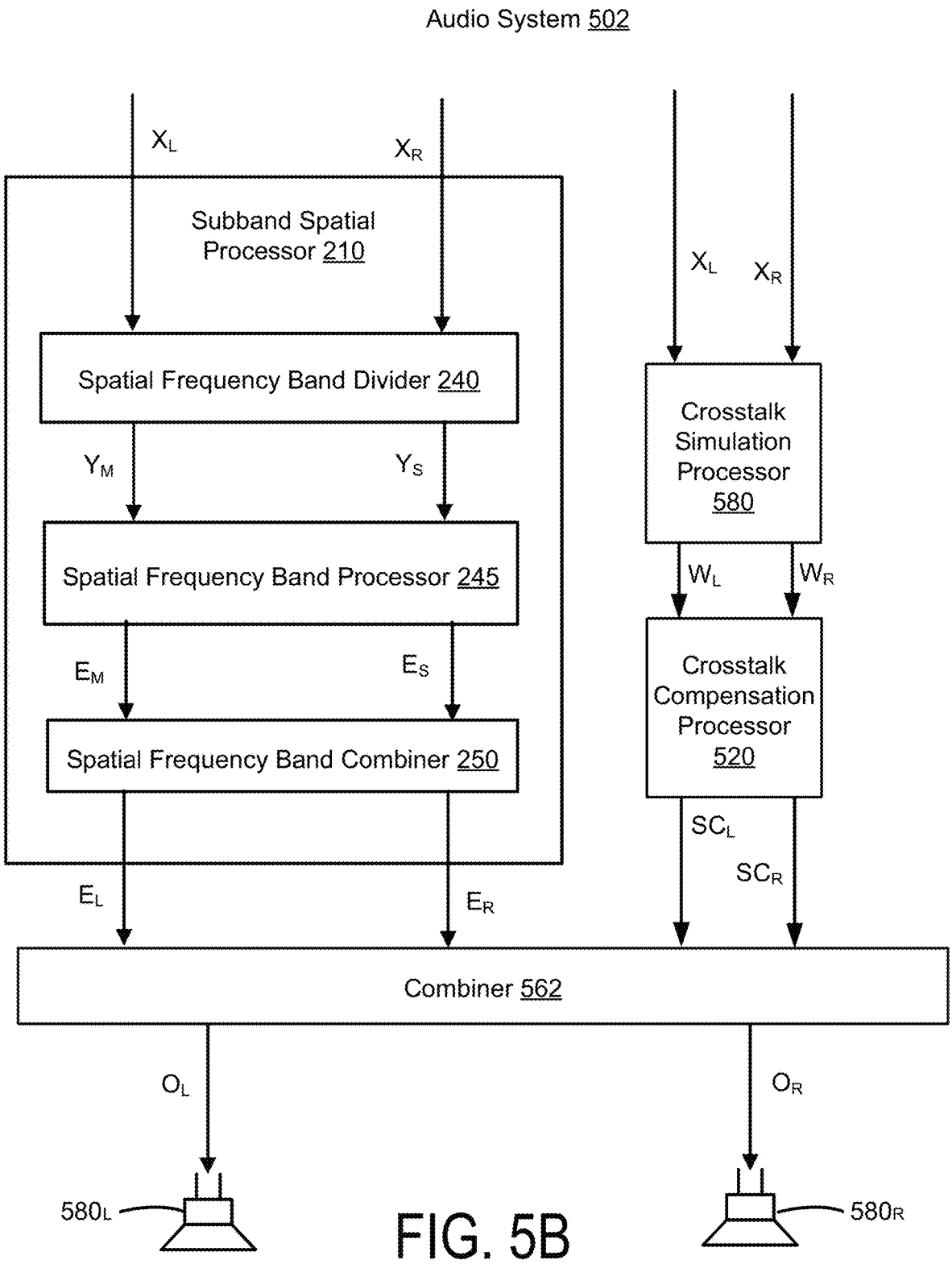
FIG. 5B illustrates an example of an audio system for performing crosstalk simulation with a spatially enhanced audio signal, according to one embodiment.

FIG. 5B illustrates an example of an audio system 502 for performing crosstalk simulation with a spatially enhanced audio signal, according to one embodiment. The audio system 502 is like the audio system 500, except that the crosstalk simulation processor 580 and the crosstalk compensation processor 520 are in series. In particular, the crosstalk simulation processor 580 receives the input channels $X_L$ and $X_R$ and performs crosstalk simulation to generate the left crosstalk simulation channel $W_L$ and the right crosstalk simulation channel $W_R$. The crosstalk compensation processor 520 receives the left crosstalk simulation channel $W_L$ and a right crosstalk simulation channel $W_R$, and performs crosstalk compensation to generate a simulation compensation signal SC including a left simulation compensation channel $SC_L$ and a right simulation compensation channel $SC_R$.

The combiner 562 combines the left enhanced channel $E_L$ from the subband spatial processor 210 with the right simulation compensation channel $SC_R$ to generate the left output channel $O_L$, and combines the right enhanced channel $E_R$ from the subband spatial processor 210 with the left simulation compensation channel $SC_L$ to generate the right output channel $O_R$. Additional details regarding the combiner 562 are discussed below in connection with FIG. 20.

Figure 5C:
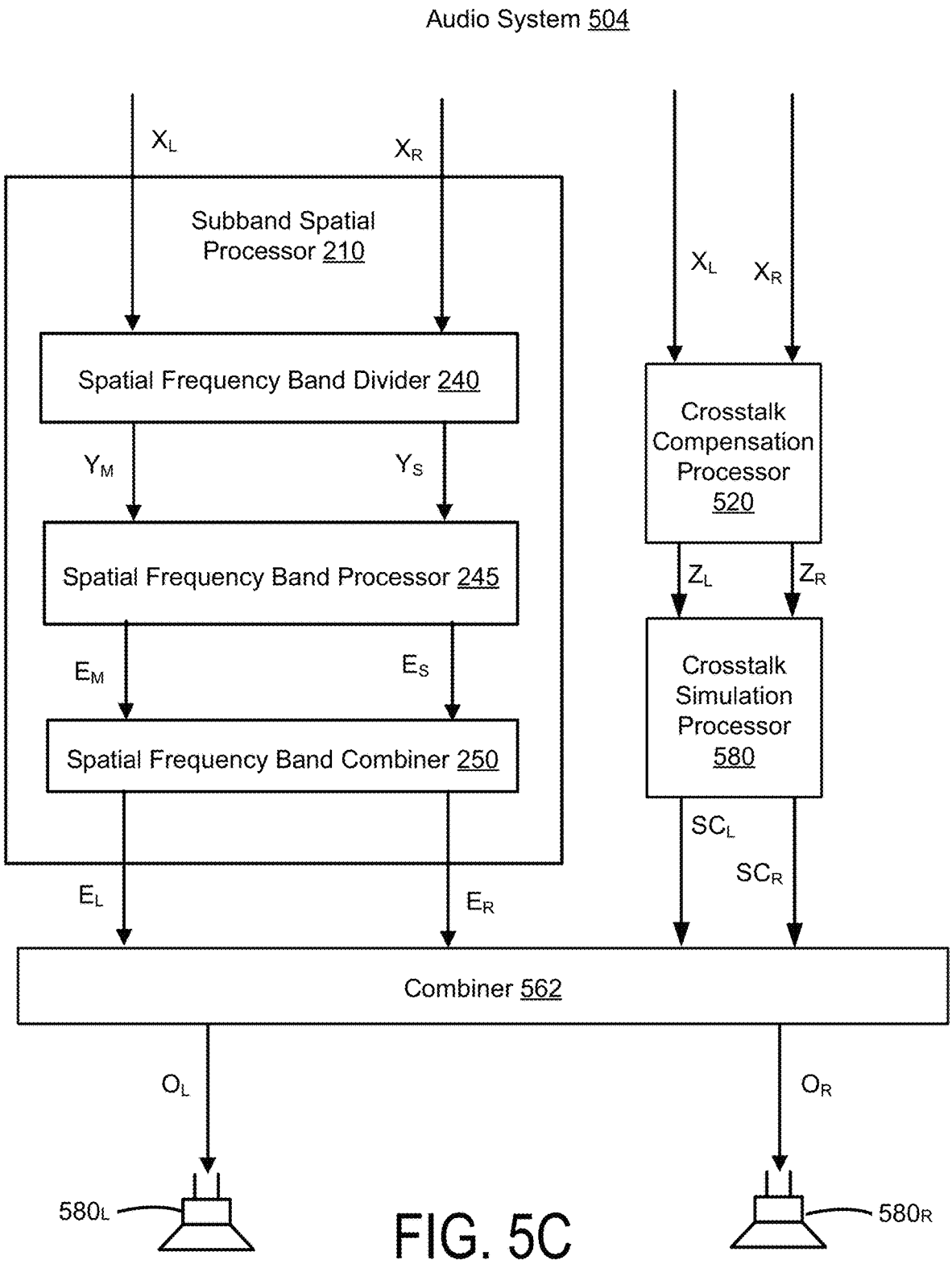
FIG. 5C illustrates an example of an audio system for performing crosstalk simulation with a spatially enhanced audio signal, according to one embodiment.

FIG. 5C illustrates an example of an audio system 504 for performing crosstalk simulation with a spatially enhanced audio signal, according to one embodiment. The audio system 504 is like the audio system 502, except that crosstalk compensation is applied to the input signal X prior to crosstalk simulation. The crosstalk compensation processor 520 receives the input channels $X_L$ and $X_R$ and performs crosstalk compensation to generate the left crosstalk compensation channel $Z_L$ and the right crosstalk compensation channel $Z_R$. The crosstalk simulation processor 580 receives the left crosstalk compensation channel $Z_L$ and a right crosstalk compensation channel $Z_R$, and performs crosstalk simulation to generate the simulation compensation signal SC including the left simulation compensation channel $SC_L$ and the right simulation compensation channel $SC_R$. The combiner 562 combines the left enhanced channel $E_L$ with the right simulation compensation channel $SC_R$ to generate the left output channel $O_L$, and combines the right enhanced channel $E_R$ with the left simulation compensation channel $SC_L$ to generate the right output channel $O_R$.

Figure 6:
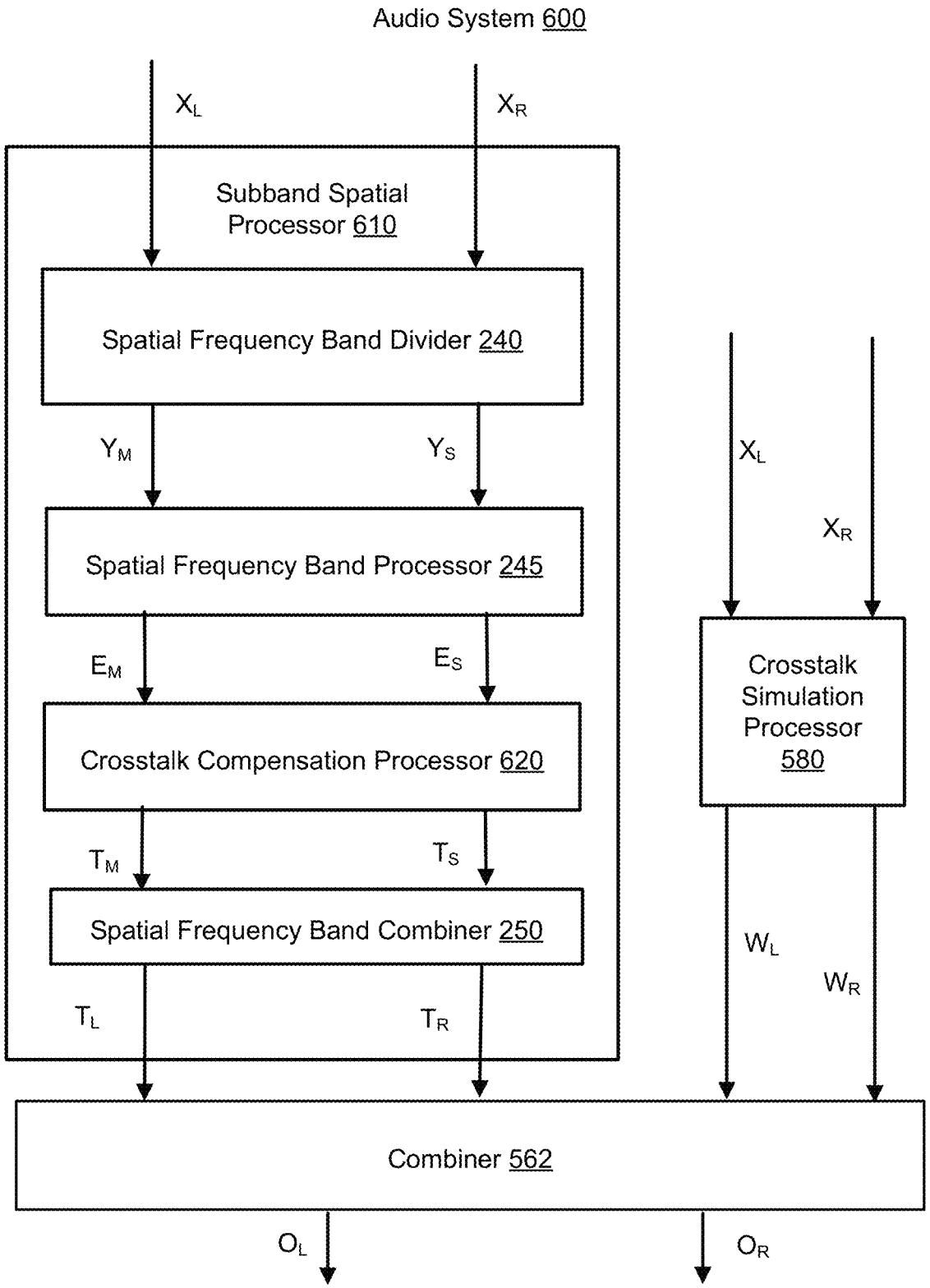
FIG. 6 illustrates an example of an audio system for performing crosstalk simulation with a spatially enhanced audio signal, according to one embodiment.

FIG. 6 illustrates an example of an audio system 600 for performing crosstalk simulation with a spatially enhanced audio signal, according to one embodiment. Unlike the audio systems 500, 502, and 504, the crosstalk compensation processor 620 is integrated with a subband spatial processor 610. The audio system 600 includes the subband spatial processor 610 including a crosstalk compensation processor 620, and a crosstalk simulation processor 580, and the combiner 562. The crosstalk compensation processor 620 is coupled to the spatial frequency band processor 245 to receive the enhanced nonspatial component $E_m$ and the enhanced spatial component E, performs the crosstalk compensation to generate the mid enhanced compensation channel $T_m$ and the side enhanced compensation channel $T_s$. The spatial frequency band combiner 562 receives the mid enhanced compensation channel $T_m$ and a side enhanced compensation channel $T_s$, and generates the left enhanced compensation channel $T_L$ and the right enhanced compensation channel $T_R$. The combiner 562 generates the left output channel $O_L$ by combining the left enhanced compensation channel $T_L$ with the right crosstalk simulation channel $W_R$, and generates the right output channel $O_R$ by combining the right enhanced compensation channel $T_R$ with the left crosstalk simulation channel $W_L$. Additional details regarding the crosstalk compensation processor 620 are discussed below in connection with FIG. 11.

Figure 7:
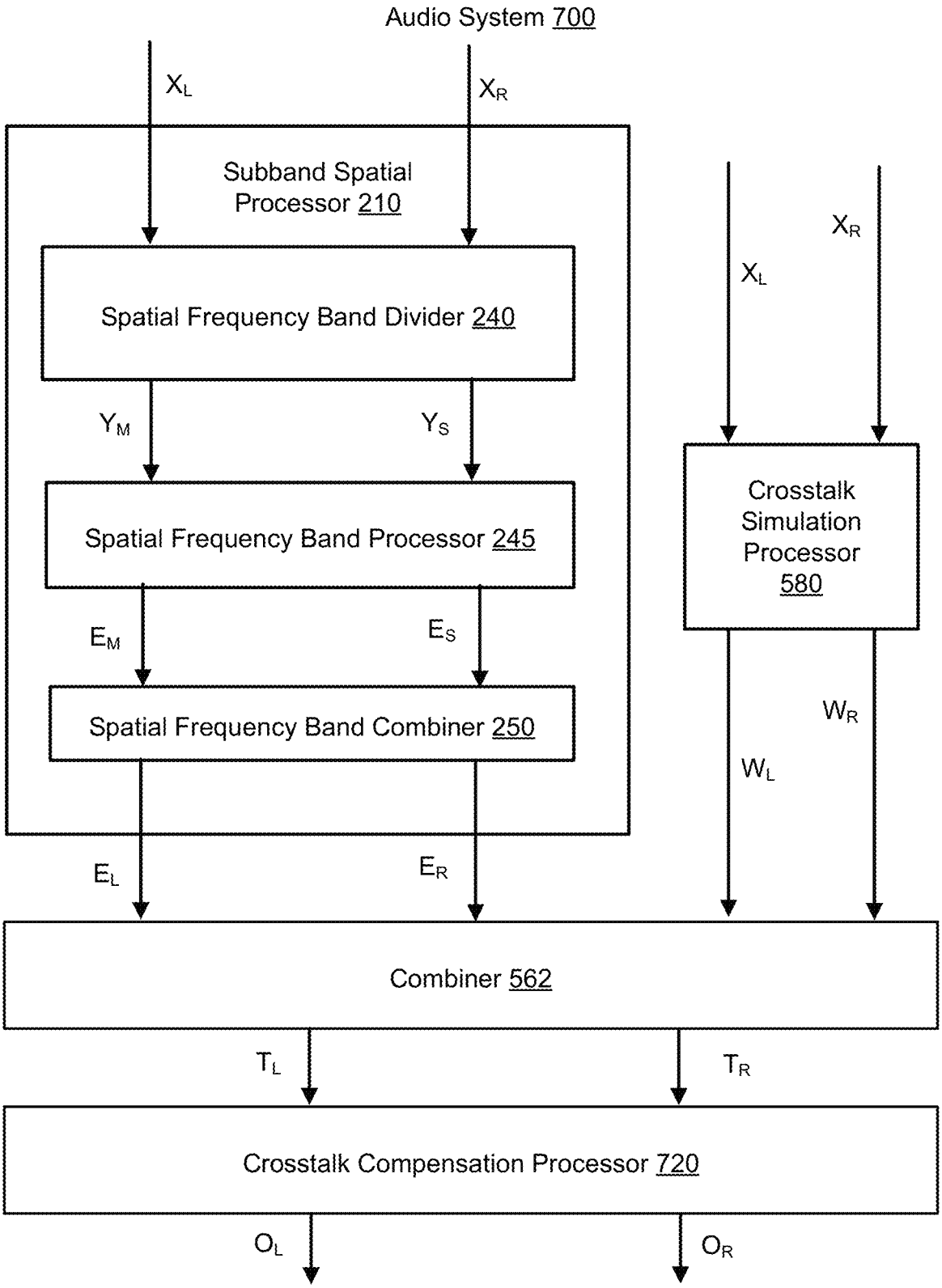
FIG. 7 illustrates an example of an audio system for performing crosstalk simulation with a spatially enhanced audio signal, according to one embodiment.

FIG. 7 illustrates an example of an audio system 700 for performing crosstalk simulation with a spatially enhanced audio signal, according to one embodiment. Unlike the audio systems 500, 502, 504, and 600, the audio system 700 performs crosstalk compensation after crosstalk simulation. The audio system 700 includes the subband spatial processor 210, the crosstalk simulation processor 580, the combiner 562, and a crosstalk compensation processor 720. The combiner 562 is coupled to the subband spatial processor 210 and the crosstalk simulation processor 580, and further coupled to the crosstalk cancellation processor 720. The combiner 562 receives the left spatially enhanced channel $E_L$ and the right spatially enhanced channel $E_R$ from the subband spatial processor 210, and receives the left crosstalk simulation channel $W_L$ and a right crosstalk simulation channel $W_R$ from the crosstalk simulation processor 580. The combiner 562 generates the left enhanced compensation channel $T_L$ by combining the left spatially enhanced channel $E_L$ and the right crosstalk simulation channel $W_R$, and generates the right enhanced compensation channel $T_R$ by combining the right spatially enhanced channel $E_R$ and the left crosstalk simulation channel $W_L$. The crosstalk compensation processor 720 receives the left enhanced compensation channel $T_L$ and the right enhanced compensation channel $T_R$, and performs a crosstalk compensation to generate the left output channel $O_L$ and right output channel $O_R$. Additional details regarding the crosstalk compensation processor 720 are discussed below in connection with FIGS. 8 and 9.

Figure 8:
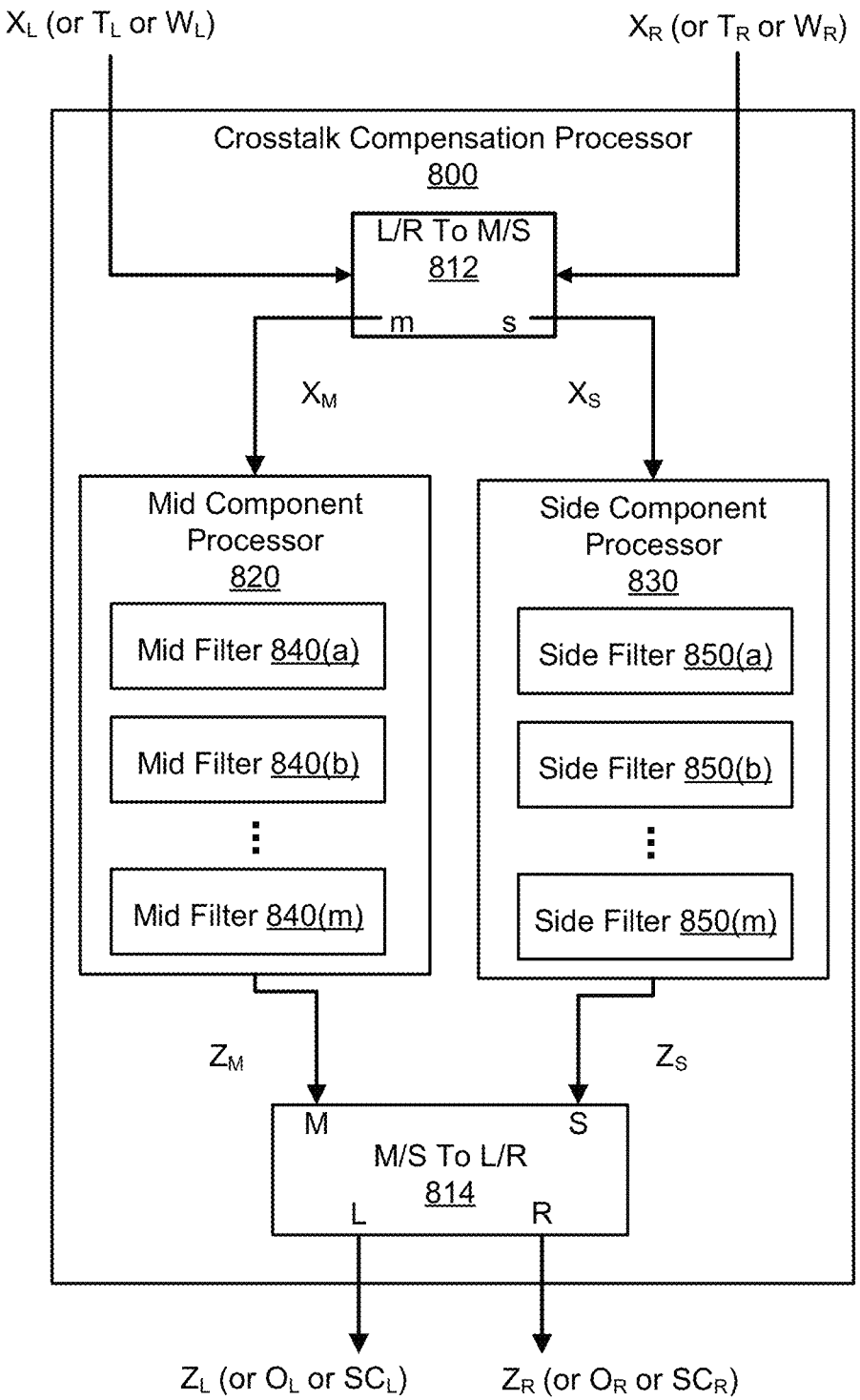
FIG. 8 illustrates an example of a crosstalk compensation processor, according to one embodiment.

FIG. 8 illustrates an example of a crosstalk compensation processor 800, according to one embodiment. The crosstalk compensation processor 800 receives left and right input channels, and generates left and right output channels by applying a crosstalk compensation on the input channels. The crosstalk compensation processor 800 is an example of the crosstalk compensation processor 220 shown in FIG. 2A, the crosstalk compensation processor 420 shown in FIG. 4, the crosstalk compensation processor 520 shown in FIGS. 5A, 5B, and 5C, or the crosstalk compensation processor 720 shown in FIG. 7. The crosstalk compensation processer

800 includes an L/R to M/S converter 812, a mid component processor 820, a side component processor 830, and an M/S to L/R converter 814.

When the crosstalk compensation processor 800 is part of the audio system 200, 400, 500, 504, or 700, the crosstalk compensation processor 800 receives left and right input channels (e.g., $X_L$ and $X_R$), and performs a crosstalk compensation processing, such as to generate the left crosstalk compensation channel $Z_L$ and the right crosstalk compensation channel $Z_R$. The channels $Z_L$, $Z_R$ may be used to compensate for any artifacts in crosstalk processing, such as crosstalk cancellation or simulation. The L/R to M/S converter 812 receives the left input audio channel $X_L$ and the right input audio channel $X_R$, and generates the nonspatial component $X_m$ and the spatial component $X_s$ of the input channels $X_L$, $X_R$. In general, the left and right channels may be summed to generate the nonspatial component of the left and right channels, and subtracted to generate the spatial component of the left and right channels.

The mid component processor 820 includes a plurality of filters 840, such as m mid filters 840(*a*), 840(*b*), through 840(*m*). Here, each of the m mid filters 840 processes one of m frequency bands of the nonspatial component $X_m$. The mid component processor 820 generates a mid crosstalk compensation channel $Z_m$ by processing the nonspatial component $X_m$. In some embodiments, the mid filters 840 are configured using a frequency response plot of the nonspatial component $X_m$ with crosstalk processing through simulation. In addition, by analyzing the frequency response plot, any spectral defects such as peaks or troughs in the frequency response plot over a predetermined threshold (e.g., 10 dB) occurring as an artifact of the crosstalk processing can be estimated. These artifacts result primarily from the summation of the delayed and possibly inverted (e.g., for crosstalk cancellation) contralateral signals with their corresponding ipsilateral signal in the crosstalk processing, thereby effectively introducing a comb filter-like frequency response to the final rendered result. The mid crosstalk compensation channel $Z_m$ can be generated by the mid component processor 820 to compensate for the estimated peaks or troughs, where each of the m frequency bands corresponds with a peak or trough. Specifically, based on the specific delay, filtering frequency, and gain applied in the crosstalk processing, peaks and troughs shift up and down in the frequency response, causing variable amplification and/or attenuation of energy in specific regions of the spectrum. Each of the mid filters 840 may be configured to adjust for one or more of the peaks and troughs.

The side component processor 830 includes a plurality of filters 850, such as m side filters 850(*a*), 850(*b*) through 850(*m*). The side component processor 830 generates a side crosstalk compensation channel $Z_s$ by processing the spatial component $X_s$. In some embodiments, a frequency response plot of the spatial component $X_s$ with crosstalk processing can be obtained through simulation. By analyzing the frequency response plot, any spectral defects such as peaks or troughs in the frequency response plot over a predetermined threshold (e.g., 10 dB) occurring as an artifact of the crosstalk processing can be estimated. The side crosstalk compensation channel $Z_s$ can be generated by the side component processor 830 to compensate for the estimated peaks or troughs. Specifically, based on the specific delay, filtering frequency, and gain applied in the crosstalk processing, peaks and troughs shift up and down in the frequency response, causing variable amplification and/or attenuation of energy in specific regions of the spectrum. Each of the side filters 850 may be configured to adjust for one or more of the peaks and troughs. In some embodiments, the mid component processor 820 and the side component processor 830 may include a different number of filters.

In some embodiments, the mid filters 840 and side filters 850 may include a biquad filter having a transfer function defined by Equation 1:

$$H(z) = \frac{b_0 + b_1 z^{-1} + b_2 z^{-2}}{a_0 + a_1 z^{-1} + a_2 z^{-2}} \quad \text{Eq. (1)}$$

where z is a complex variable, and $a_0$, $a_1$, $a_2$, $b_0$, $b_1$, and $b_2$ are digital filter coefficients. One way to implement such a filter is the direct form I topology as defined by Equation 2:

$$Y[n] = \frac{b_0}{a_0}X[n-1] + \frac{b_1}{a_0}X[n-1] + \frac{b_2}{a_0}X[n-2] - \frac{a_1}{a_0}Y[n-1] - \frac{a_2}{a_0}Y[n-2] \quad \text{Eq. (2)}$$

where X is the input vector, and Y is the ouput. Other topologies may be used, depending on their maximum word-length and saturation behaviors.

The biquad filter can then be used to implement a second-order filter with real-valued inputs and outputs. To design a discrete-time filter, a continuous-time filter is designed, and then transformed into discrete time via a bilinear transform. Furthermore, resulting shifts in center frequency and bandwidth may be compensated using frequency warping.

For example, a peaking filter may have an S-plane transfer function defined by Equation 3:

$$H(s) = \frac{s^2 + s(A/Q) + 1}{s^2 + s(A/Q) + 1} \quad \text{Eq. (3)}$$

where s is a complex variable, A is the amplitude of the peak, and Q is the filter "quality," and and the digital filter coefficients are defined by:

$$b_0 = 1 + \alpha A$$

$$b_1 = -2 * \cos(\omega_0)$$

$$b_2 = 1 - \alpha A$$

$$a_0 = 1 + \frac{\alpha}{A}$$

$$a_1 = -2\cos(\omega_0)$$

$$a_2 = 1 + \frac{\alpha}{A}$$

where $\omega_0$ is the center frequency of the filter in radians and $$\alpha = \frac{\sin(\omega_0)}{2Q}.$$

Furthermore, the filter quality Q may be defined by Equation 4:

$$Q = \frac{f_c}{\Delta f} \quad \text{Eq. (4)}$$

where $\Delta f$ is a bandwidth and $f_c$ is a center frequency.

The M/S to L/R converter 814 receives the mid crosstalk compensation channel $Z_m$ and the side crosstalk compensation channel $Z_s$, and generates the left crosstalk compensation channel $Z_L$ and the right crosstalk compensation channel $Z_R$. In general, the mid and side channels may be summed to generate the left channel of the mid and side components, and the mid and side channels may be subtracted to generate right channel of the mid and side components.

When the crosstalk compensation processor 800 is part of the audio system 502, the crosstalk compensation processor 800 receives the left crosstalk simulation channel $W_L$ and the right crosstalk simulation channel $W_R$ from the crosstalk simulation processor 580, and performs a preprocessing (e.g., as discussed above for the input channels $X_L$ and $X_R$) to generate left simulation compensation channel $SC_L$ and the right simulation compensation channel $SC_R$.

When the crosstalk compensation processor 800 is part of the audio system 700, the crosstalk compensation processor 800 receives the left enhanced compensation channel $T_L$ and the right enhanced compensation channel $T_R$ from the combiner 562, and performs a preprocessing (e.g., as discussed above for the input channels $X_L$ and $X_R$) to generate left output channel $O_L$ and the right output channel $O_R$.

Figure 9:
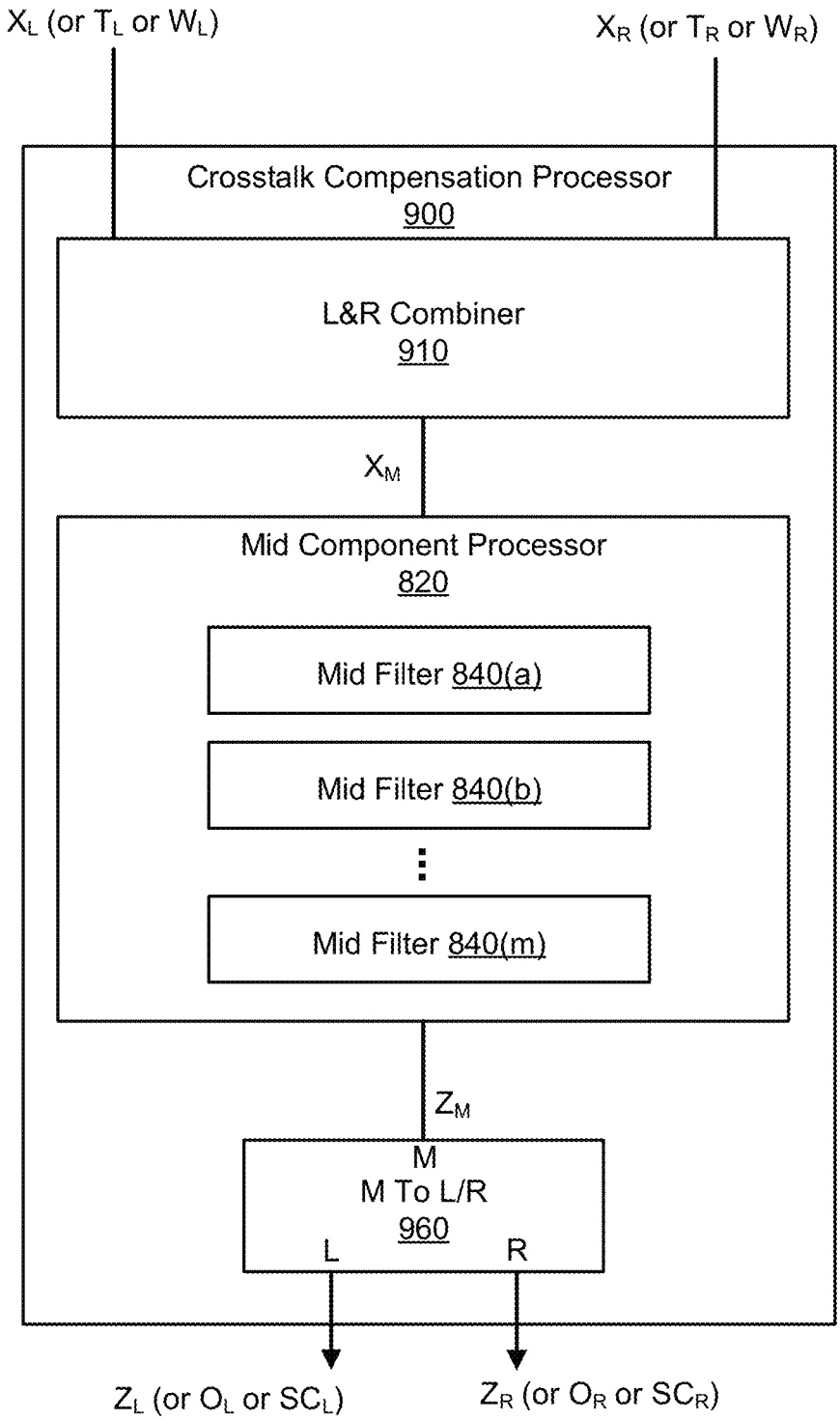
FIG. 9 illustrates an example of a crosstalk compensation processor, according to one embodiment.

FIG. 9 illustrates an example of a crosstalk compensation processor 900, according to one embodiment. Unlike the crosstalk compensation processor 800, the crosstalk compensation processor 900 performs processing on the nonspatial component $X_m$, rather than both the nonspatial component $X_m$ and the spatial component $X_s$. The crosstalk compensation processor 900 is another example of the crosstalk compensation processor 220 shown in FIG. 2A, the crosstalk compensation processor 420 shown in FIG. 4, the crosstalk compensation processor 520 shown in FIGS. 5A, 5B, and 5C, or the crosstalk compensation processor 720 shown in FIG. 7. The crosstalk compensation processor 900 includes an L&R combiner 910, the mid component processor 820, and an M to L/R converter 960.

When the crosstalk compensation processor 900 is part of the audio system 200, 500, or 504, for example, the L&R combiner 910 receives the left input audio channel $X_L$ and the right input audio channel $X_R$, and generates the nonspatial component $X_m$ by adding the channels $X_L$, $X_R$. The mid component processor 820 receives the nonspatial component $X_m$, and generates the mid crosstalk compensation channel $Z_m$ by processing the nonspatial component $X_m$ using the mid filters 840(*a*) through 840(*m*). The M to L/R converter 950 receives the mid crosstalk compensation channel $Z_m$, generates each of left crosstalk compensation channel $Z_L$ and the right crosstalk compensation channel $Z_R$ using the mid crosstalk compensation channel $Z_m$. When the crosstalk compensation processor 900 is part of the audio system 400, 502, or 700, for example, the input and output signals may be different as discussed above for the crosstalk compensation processor 800.

Figure 10:
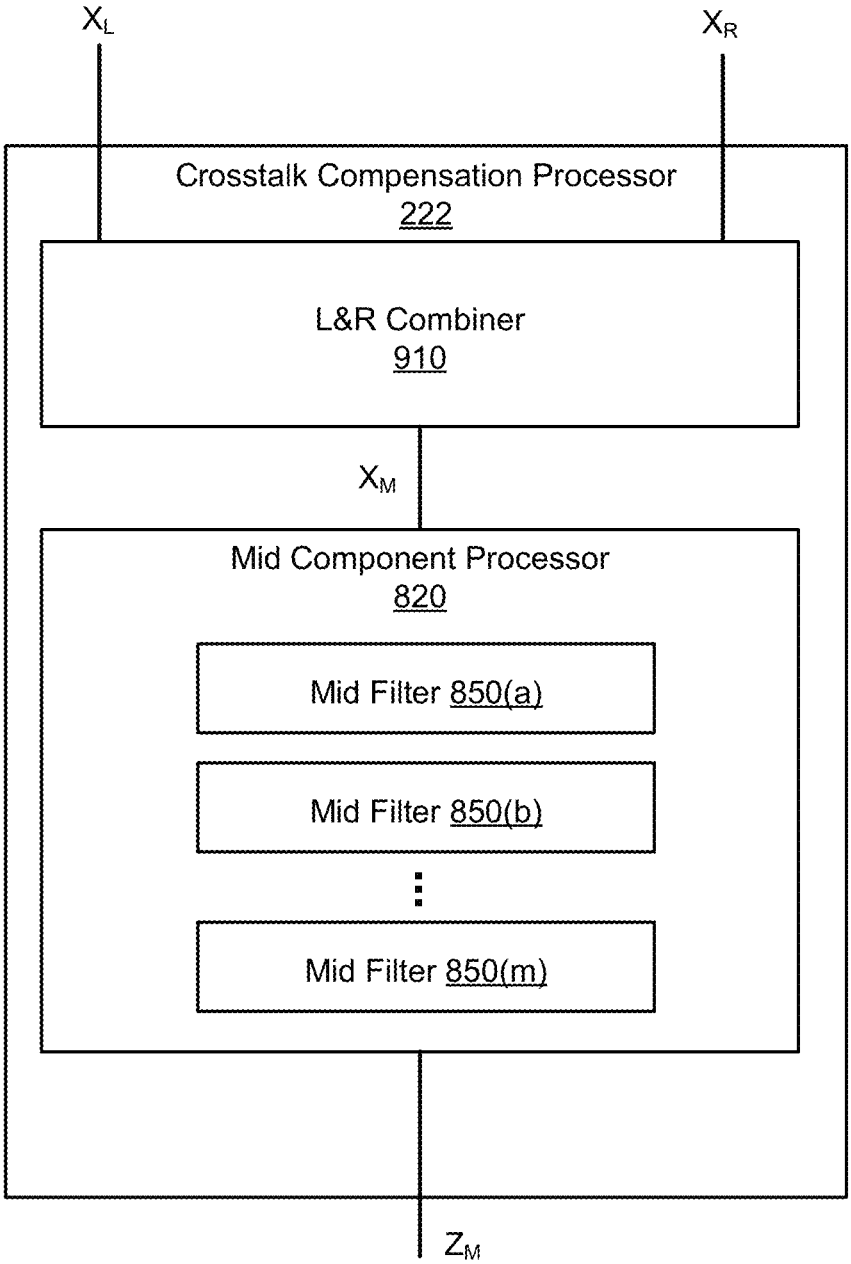
FIG. 10 illustrates an example of a crosstalk compensation processor, according to one embodiment.

FIG. 10 illustrates an example of a crosstalk compensation processor 222, according to one embodiment. The crosstalk compensation processor 222 is a component of the audio system 202 as discussed above in connection with FIG. 2B. Unlike the crosstalk compensation processor 900 which converts the mid crosstalk compensation channel $Z_m$ into the left crosstalk compensation channel $Z_L$ and the right crosstalk compensation channel $Z_R$, the crosstalk compensation processor 222 outputs the mid crosstalk compensation channel $Z_m$. As such, the crosstalk compensation process 900 includes the L&R combiner 910 and the mid component processor 820, as discussed above for the crosstalk compensation processor 900.

Figure 11:
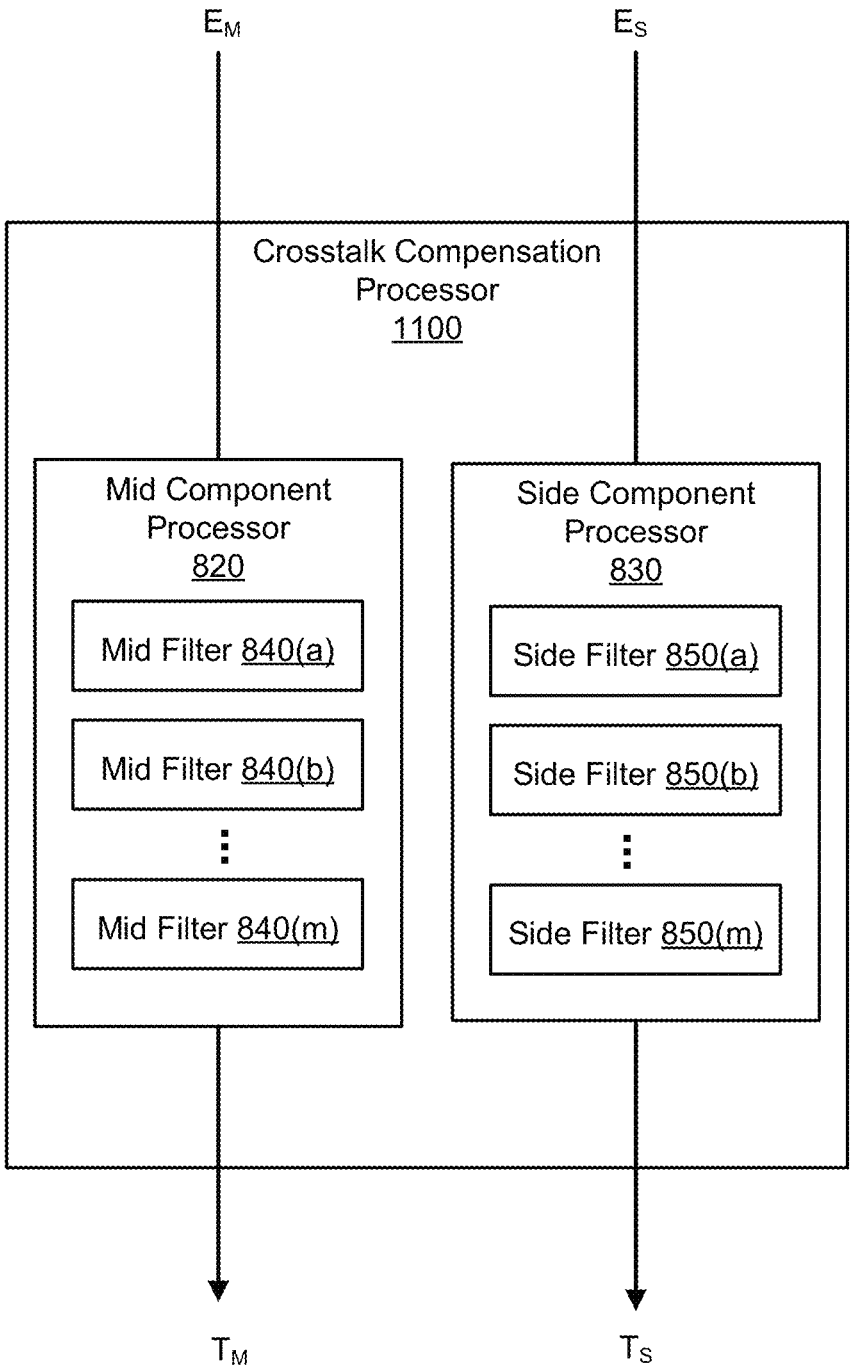
FIG. 11 illustrates an example of a crosstalk compensation processor, according to one embodiment.

FIG. 11 illustrates an example of a crosstalk compensation processor 1100, according to one embodiment. The crosstalk compensation processor 1100 is an example of the crosstalk compensation processor 320 shown in FIG. 3, or the crosstalk compensation processor 620 shown in FIG. 6. The crosstalk compensation processor 1100 is integrated within the subband spatial processor. The crosstalk compensation processor 1100 receives input mid $E_m$ and side $E_s$ components of a signal, and performs crosstalk compensation on the mid and side components to generate mid $T_m$ and side $T_s$ output channels.

The crosstalk compensation processor 1100 includes the mid component processor 820 and the side component processor 830. The mid component processor 820 receives the enhanced nonspatial component $E_m$ from the spatial frequency band processor 245, and generates the mid enhanced compensation channel $T_m$ using the mid filters 840(*a*) through 840(*m*). The side component processor 830 receives the enhanced spatial component E from the spatial frequency band processor 245, and generates the side enhanced compensation channel $T_s$ using the side filters 850(*a*) through 850(*m*).

Figure 12:
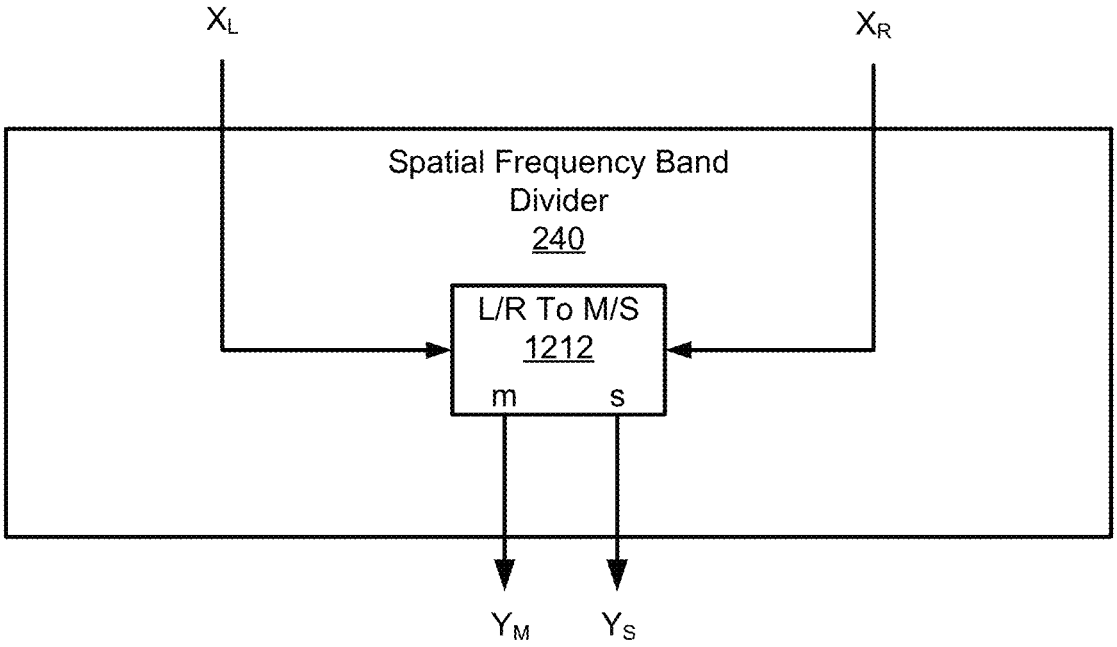
FIG. 12 illustrates an example of a spatial frequency band divider, according to one embodiment.

FIG. 12 illustrates an example of a spatial frequency band divider 240, according to one embodiment. The spatial frequency band divider 240 is a component of the subband spatial processor 210, 310, or 610 shown in FIGS. 2A through 7. The spatial frequency band divider 240 includes an L/R to M/S converter 1212 that receives the left input channel $X_L$ and the right input channel $X_R$, and converts these inputs into the spatial component $Y_s$ and the nonspatial component $Y_m$.

Figure 13:
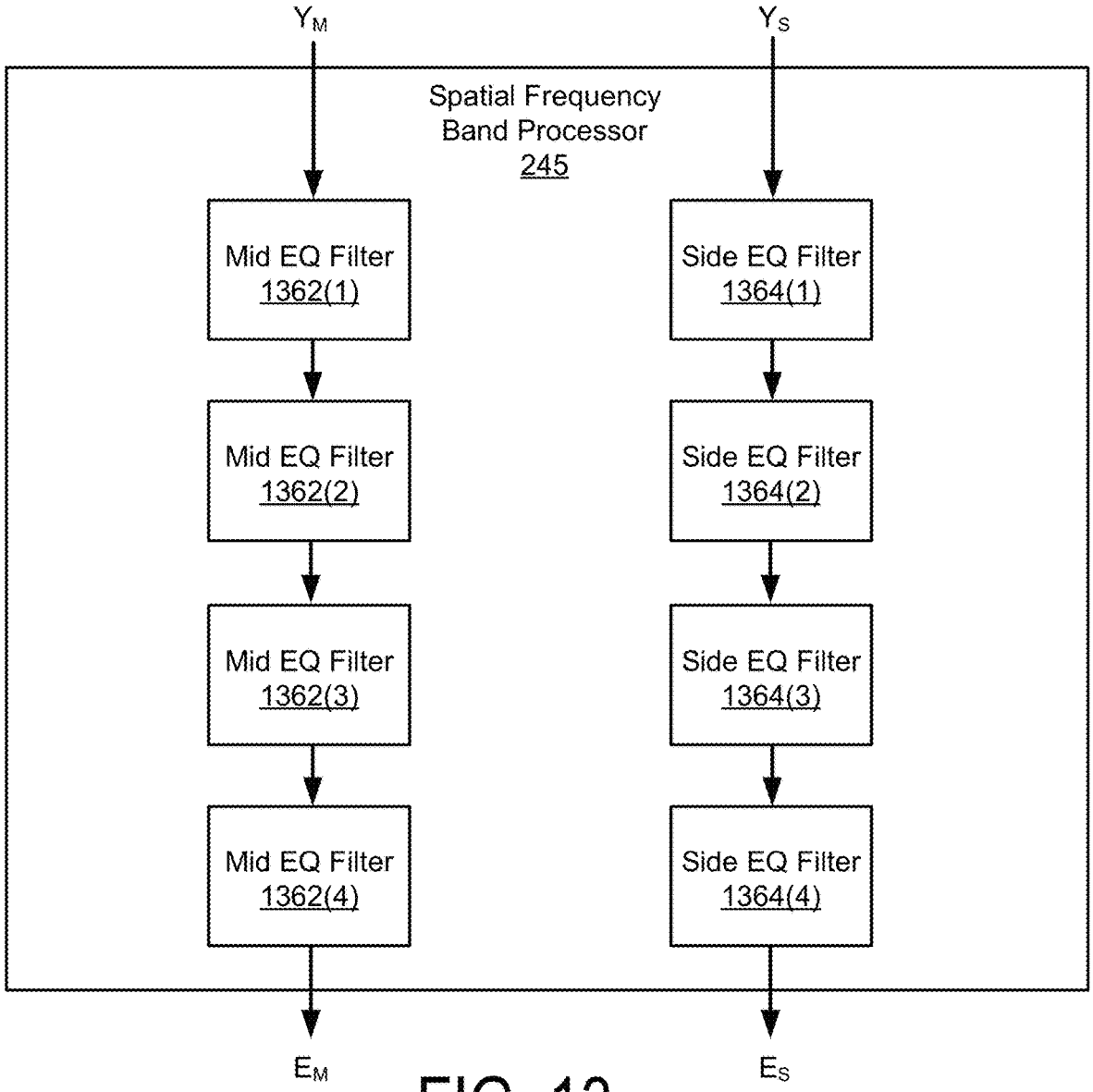
FIG. 13 illustrates an example of a spatial frequency band processor, according to one embodiment.

FIG. 13 illustrates an example of a spatial frequency band processor 245, according to one embodiment. The spatial frequency band processor 245 is a component of the subband spatial processor 210, 310, or 610 shown in FIGS. 2A through 7. The spatial frequency band processor 245 receives the nonspatial component $Y_m$ and applies a set of subband filters to generate the enhanced nonspatial subband component $E_m$. The spatial frequency band processor 245 also receives the spatial subband component $Y_s$ and applies a set of subband filters to generate the enhanced nonspatial subband component $E_m$. The subband filters can include various combinations of peak filters, notch filters, low pass filters, high pass filters, low shelf filters, high shelf filters, bandpass filters, bandstop filters, and/or all pass filters.

More specifically, the spatial frequency band processor 245 includes a subband filter for each of n frequency subbands of the nonspatial component $Y_m$ and a subband filter for each of the n subbands of the spatial component $Y_s$. For n=4 subbands, for example, the spatial frequency band processor 245 includes a series of subband filters for the nonspatial component $Y_m$ including a mid equalization (EQ) filter 1362(1) for the subband (1), a mid EQ filter 1362(2) for the subband (2), a mid EQ filter 1362(3) for the subband (3), and a mid EQ filter 1362(4) for the subband (4). Each mid EQ filter 1362 applies a filter to a frequency subband portion of the nonspatial component $Y_m$ to generate the enhanced nonspatial component $E_m$.

The spatial frequency band processor 245 further includes a series of subband filters for the frequency subbands of the spatial component $Y_s$, including a side equalization (EQ) filter 1364(1) for the subband (1), a side EQ filter 1364(2) for the subband (2), a side EQ filter 1364(3) for the subband (3), and a side EQ filter 1364(4) for the subband (4). Each side EQ filter 1364 applies a filter to a frequency subband portion of the spatial component $Y_s$ to generate the enhanced spatial component $E_s$.

Each of the n frequency subbands of the nonspatial component $Y_m$ and the spatial component $Y_s$ may correspond with a range of frequencies. For example, the frequency subband (1) may corresponding to 0 to 300 Hz, the frequency subband(2) may correspond to 300 to 510 Hz, the frequency subband(3) may correspond to 510 to 2700 Hz, and the frequency subband(4) may correspond to 2700 Hz to Nyquist frequency. In some embodiments, the n frequency subbands are a consolidated set of critical bands. The critical bands may be determined using a corpus of audio samples from a wide variety of musical genres. A long term average energy ratio of mid to side components over the 24 Bark scale critical bands is determined from the samples. Contiguous frequency bands with similar long term average ratios are then grouped together to form the set of critical bands. The range of the frequency subbands, as well as the number of frequency subbands, may be adjustable.

Figure 14:
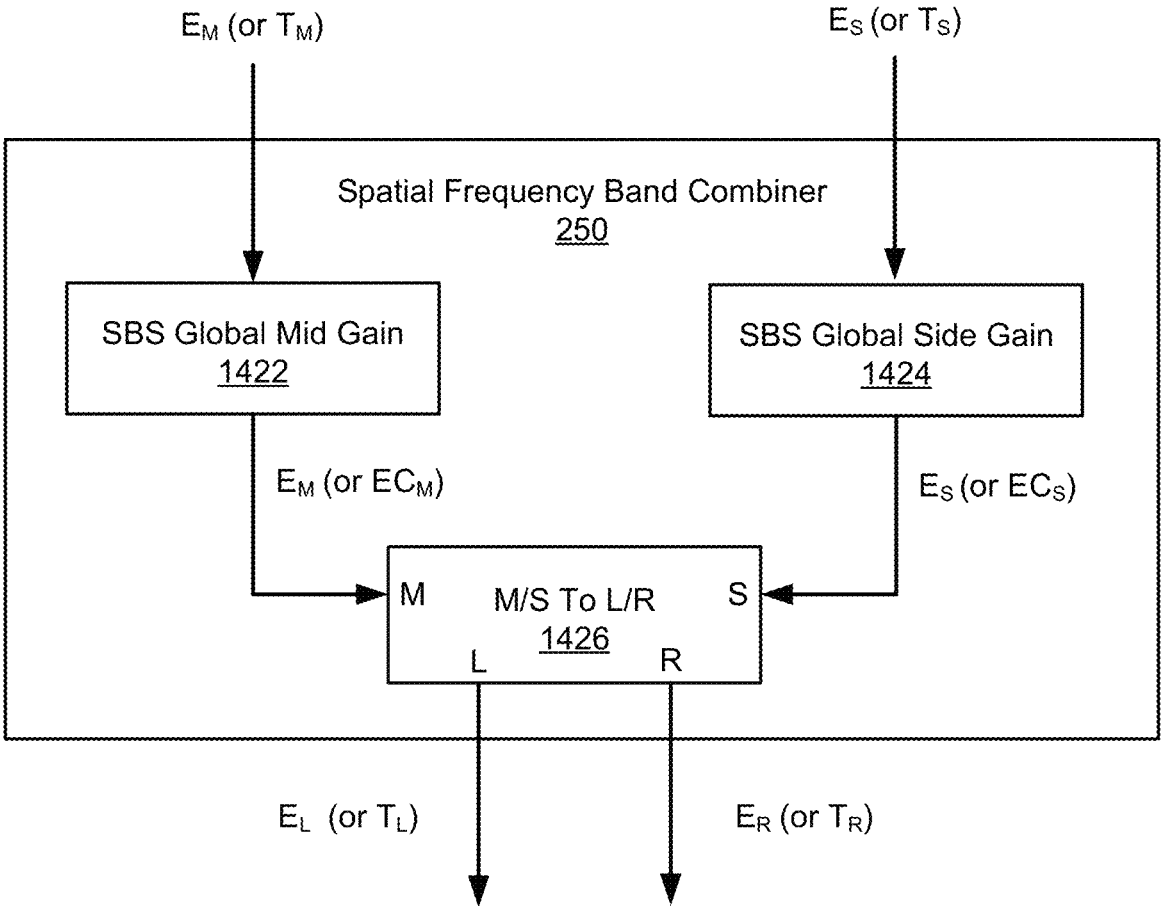
FIG. 14 illustrates an example of a spatial frequency band combiner, according to one embodiment.

FIG. 14 illustrates an example of a spatial frequency band combiner 250, according to one embodiment. The spatial frequency band combiner 250 is a component of the subband spatial processor 210, 310, or 610 shown in FIGS. 2A through 7. The spatial frequency band combiner 250 receives mid and side components, applies gains to each of the components, and converts the mid and side components into left and right channels. For example, the spatial frequency band combiner 250 receives the enhanced nonspatial component $E_m$ and the enhanced spatial component $E_s$, and performs global mid and side gains before converting the enhanced nonspatial component $E_m$ and the enhanced spatial component $E_s$ into the left spatially enhanced channel $E_L$ and the right spatially enhanced channel $E_R$.

More specifically, the spatial frequency band combiner 250 includes a global mid gain 1422, a global side gain 1424, and an M/S to L/R converter 1426 coupled to the global mid gain 1422 and the global side gain 1424. The global mid gain 1422 receives the enhanced nonspatial component $E_m$ and applies a gain, and the global side gain 1424 receives the enhanced spatial component E and applies a gain. The M/S to L/R converter 1426 receives the enhanced nonspatial component $E_m$ from the global mid gain 1422 and the enhanced spatial component E from the global side gain 1424, and converts these inputs into the left spatially enhanced channel $E_L$ and the right spatially enhanced channel $E_R$.

When the spatial frequency band combiner 250 is part of the subband spatial processor 310 shown in FIG. 3 or the subband spatial processor 610 shown in FIG. 6, the spatial frequency band combiner 250 receives the mid enhanced compensation channel $T_m$ instead of the nonspatial component $E_m$, and receives the side enhanced compensation channel $T_s$ instead of the nonspatial component $E_m$. The spatial frequency band combiner 250 processes the mid enhanced compensation channel $T_m$ and the side enhanced compensation channel $T_s$ to generate the left enhanced compensation channel $T_L$ and the right enhanced compensation channel $T_R$.

Figure 15:
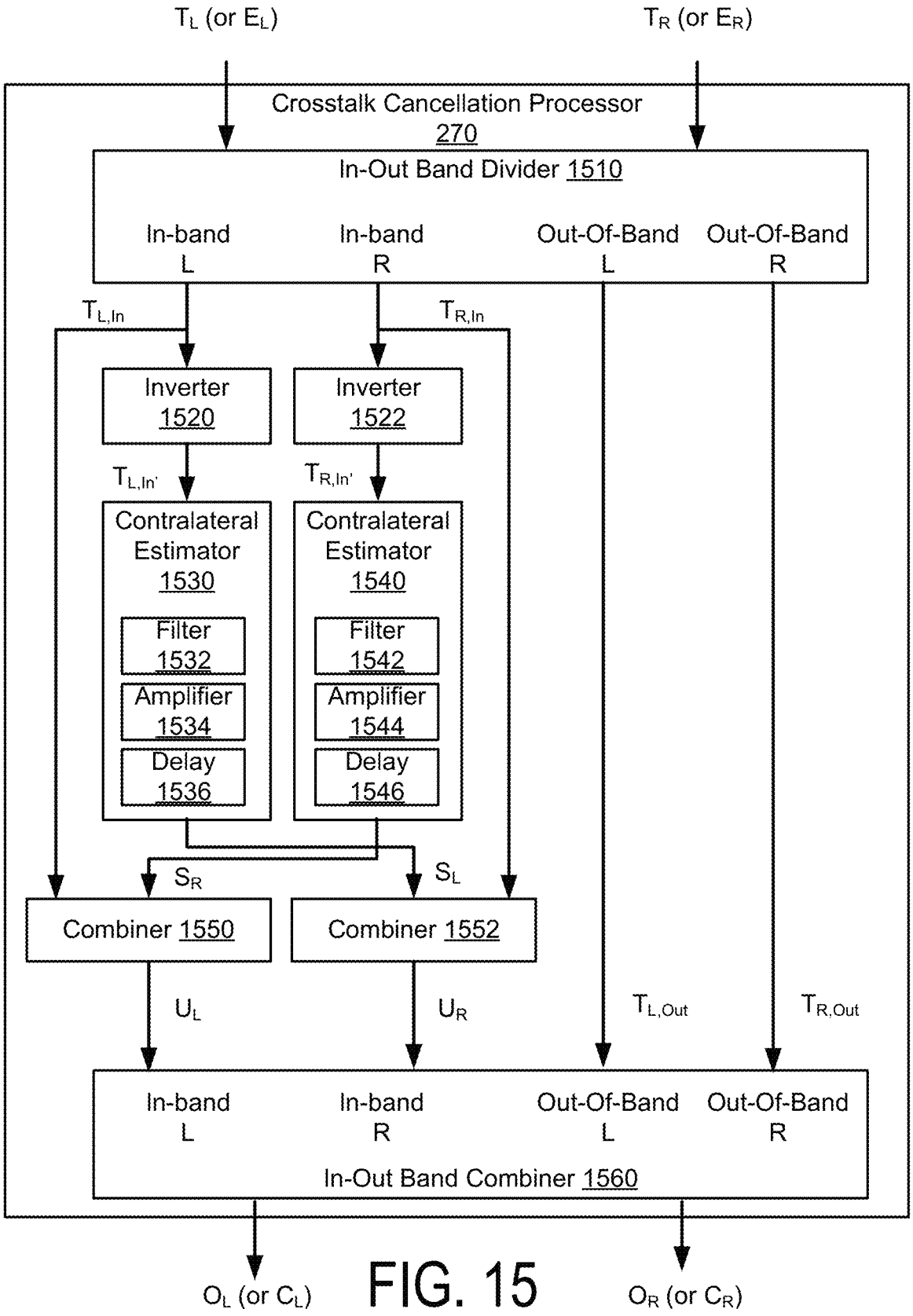
FIG. 15 illustrates a crosstalk cancellation processor, according to one embodiment.

FIG. 15 illustrates a crosstalk cancellation processor 270, according to one embodiment. When crosstalk cancellation is performed after crosstalk compensation as discussed above for the audio systems 200, 202, and 300, the crosstalk cancellation processor 270 receives the left enhanced compensation channel $T_L$ and the right enhanced compensation channel $T_R$, and performs crosstalk cancellation on the channels $T_L$, $T_R$ to generate the left output channel $O_L$, and the right output channel $O_R$. When crosstalk cancellation is performed before crosstalk compensation as discussed above for the audio system 400, the crosstalk cancellation processor 270 receives the left spatially enhanced channel $E_L$ and the right spatially enhanced channel $E_R$, and performs crosstalk cancellation on the channels $E_L$, $E_R$ to generate the left enhanced in-out-band crosstalk channel $C_L$ and a right enhanced in-out-band crosstalk channel $C_R$.

In one embodiment, the crosstalk cancellation processor 270 includes an in-out band divider 1510, inverters 1520 and 1522, contralateral estimators 1530 and 1540, combiners 1550 and 1552, and an in-out band combiner 1560. These components operate together to divide the input channels $T_L$, $T_R$ into in-band components and out-of-band components, and perform a crosstalk cancellation on the in-band components to generate the output channels $O_L$, $O_R$.

By dividing the input audio signal T into different frequency band components and by performing crosstalk cancellation on selective components (e.g., in-band components), crosstalk cancellation can be performed for a particular frequency band while obviating degradations in other frequency bands. If crosstalk cancellation is performed without dividing the input audio signal T into different frequency bands, the audio signal after such crosstalk cancellation may exhibit significant attenuation or amplification in the nonspatial and spatial components in low frequency (e.g., below 350 Hz), higher frequency (e.g., above 12000 Hz), or both. By selectively performing crosstalk cancellation for the in-band (e.g., between 250 Hz and 14000 Hz), where the vast majority of impactful spatial cues reside, a balanced overall energy, particularly in the nonspatial component, across the spectrum in the mix can be retained.

The in-out band divider 1510 separates the input channels $T_L$, $T_R$ into in-band channels $T_{L,In}$, $T_{R,In}$ and out of band channels $T_{L,Out}$, $T_{R,Out}$, respectively. Particularly, the in-out band divider 1510 divides the left enhanced compensation channel $T_L$ into a left in-band channel $T_{L,In}$ and a left out-of-band channel $T_{L,Out}$. Similarly, the in-out band divider 1510 separates the right enhanced compensation channel $T_R$ into a right in-band channel $T_{R,In}$ and a right out-of-band channel $T_{R,Out}$. Each in-band channel may encompass a portion of a respective input channel corresponding to a frequency range including, for example, 250 Hz to 14 kHz. The range of frequency bands may be adjustable, for example according to speaker parameters.

The inverter 1520 and the contralateral estimator 1530 operate together to generate a left contralateral cancellation component $S_L$ to compensate for a contralateral sound component due to the left in-band channel $T_{L,In}$. Similarly, the inverter 1522 and the contralateral estimator 1540 operate together to generate a right contralateral cancellation component $S_R$ to compensate for a contralateral sound component due to the right in-band channel $T_{R,In}$.

In one approach, the inverter 1520 receives the in-band channel $T_{L,In}$ and inverts a polarity of the received in-band channel $T_{L,In}$ to generate an inverted in-band channel $T_{L,In'}$.

The contralateral estimator 1530 receives the inverted in-band channel $T_{L,In'}$, and extracts a portion of the inverted in-band channel $T_{L,In'}$ corresponding to a contralateral sound component through filtering. Because the filtering is performed on the inverted in-band channel $T_{L,In'}$, the portion extracted by the contralateral estimator 1530 becomes an inverse of a portion of the in-band channel $T_{L,In}$ attributing to the contralateral sound component. Hence, the portion extracted by the contralateral estimator 1530 becomes a left contralateral cancellation component $S_L$, which can be added to a counterpart in-band channel $T_{R,In}$ to reduce the contralateral sound component due to the in-band channel $T_{L,In}$. In some embodiments, the inverter 1520 and the contralateral estimator 1530 are implemented in a different sequence.

The inverter 1522 and the contralateral estimator 1540 perform similar operations with respect to the in-band channel $T_{R,In}$ to generate the right contralateral cancellation component $S_R$. Therefore, detailed description thereof is omitted herein for the sake of brevity.

In one example implementation, the contralateral estimator 1530 includes a filter 1532, an amplifier 1534, and a delay unit 1536. The filter 1532 receives the inverted input channel $T_{L,In'}$ and extracts a portion of the inverted in-band channel $T_{L,In'}$ corresponding to a contralateral sound component through a filtering function. An example filter implementation is a Notch or Highshelf filter with a center frequency selected between 5000 and 10000 Hz, and Q selected between 0.5 and 1.0. Gain in decibels ($G_{dB}$) may be derived from Equation 5:

$$G_{dB}=-3.0-\log_{1.333}(D) \quad \text{Eq. (5)}$$

where D is a delay amount by delay unit 1536 and 1546 in samples, for example, at a sampling rate of 48 KHz. An alternate implementation is a Lowpass filter with a corner frequency selected between 5000 and 10000 Hz, and Q selected between 0.5 and 1.0. Moreover, the amplifier 1534 amplifies the extracted portion by a corresponding gain coefficient $G_{L,In}$, and the delay unit 1536 delays the amplified output from the amplifier 1534 according to a delay function D to generate the left contralateral cancellation component $S_L$. The contralateral estimator 1540 includes a filter 1542, an amplifier 1544, and a delay unit 1546 that performs similar operations on the inverted in-band channel $T_{R,In'}$ to generate the right contralateral cancellation component $S_R$. In one example, the contralateral estimators 1530, 1540 generate the left and right contralateral cancellation components $S_L$, $S_R$, according to equations below:

$$S_L=D[G_{L,In}*F[T_{L,In'}]] \quad \text{Eq. (6)}$$

$$S_R=D[G_{R,In}*F[T_{R,In'}]] \quad \text{Eq. (7)}$$

where F[ ] is a filter function, and D[ ] is the delay function.

The configurations of the crosstalk cancellation can be determined by the speaker parameters. In one example, filter center frequency, delay amount, amplifier gain, and filter gain can be determined, according to an angle formed between two speakers 280 with respect to a listener. In some embodiments, values between the speaker angles are used to interpolate other values.

The combiner 1550 combines the right contralateral cancellation component $S_R$ to the left in-band channel $T_{L,In}$ to generate a left in-band crosstalk channel UL, and the combiner 1552 combines the left contralateral cancellation component $S_L$ to the right in-band channel $T_{R,In}$ to generate a right in-band crosstalk channel $U_R$. The in-out band combiner 1560 combines the left in-band crosstalk channel UL with the out-of-band channel $T_{L,Out}$ to generate the left output channel $O_L$, and combines the right in-band crosstalk channel $U_R$ with the out-of-band channel $T_{R,Out}$ to generate the right output channel $O_R$.

Accordingly, the left output channel $O_L$ includes the right contralateral cancellation component $S_R$ corresponding to an inverse of a portion of the in-band channel $T_{R,In}$ attributing to the contralateral sound, and the right output channel $O_R$ includes the left contralateral cancellation component $S_L$ corresponding to an inverse of a portion of the in-band channel $T_{L,In}$ attributing to the contralateral sound. In this configuration, a wavefront of an ipsilateral sound component output by the loudspeaker $\mathbf{280}_R$ according to the right output channel $O_R$ arrived at the right ear can cancel a wavefront of a contralateral sound component output by the loudspeaker $\mathbf{280}_L$ according to the left output channel $O_L$. Similarly, a wavefront of an ipsilateral sound component output by the speaker $\mathbf{280}_L$ according to the left output channel $O_L$ arrived at the left ear can cancel a wavefront of a contralateral sound component output by the loudspeaker $\mathbf{280}_R$ according to right output channel $O_R$. Thus, contralateral sound components can be reduced to enhance spatial detectability.

Figure 16A:
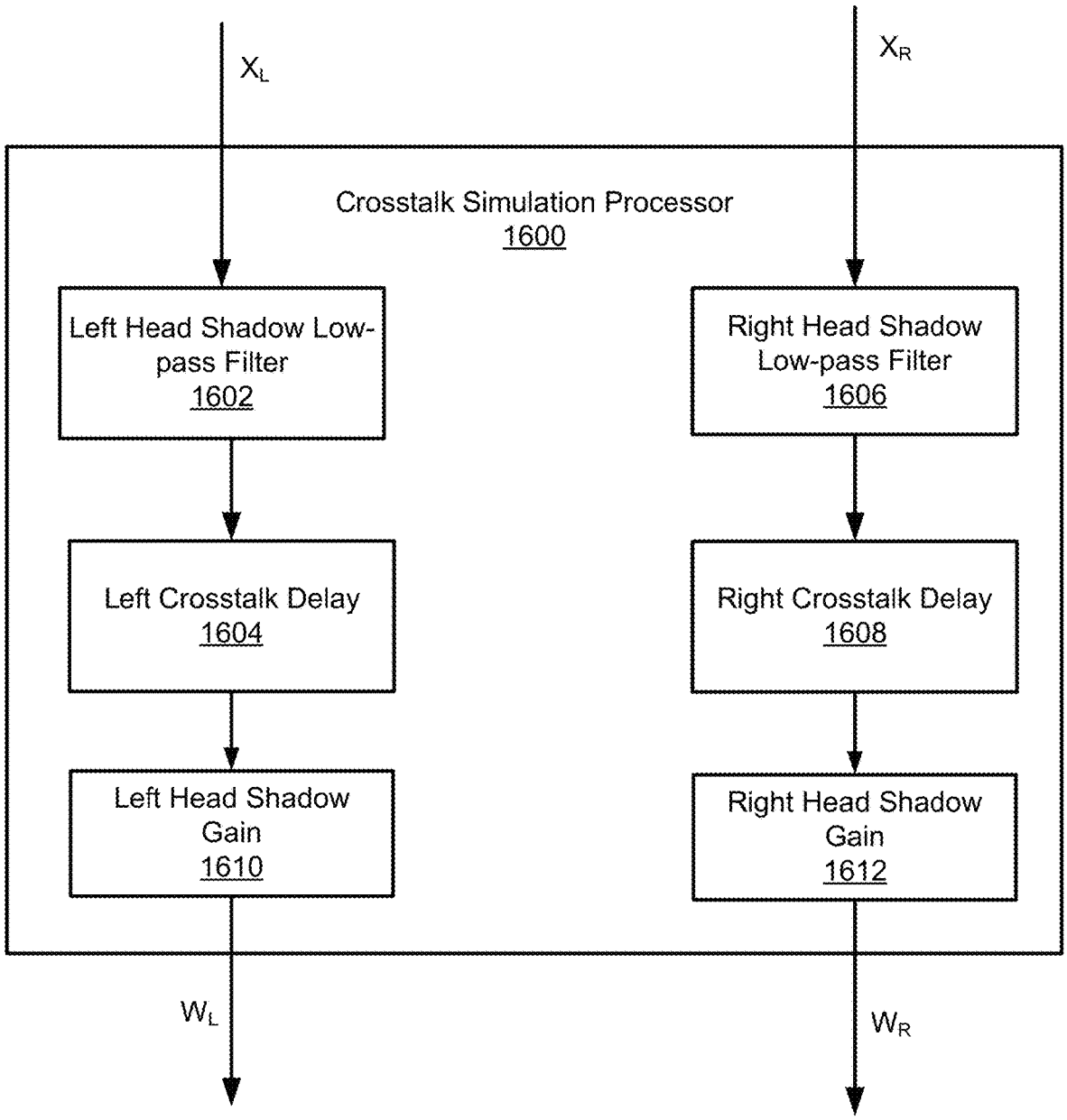
FIG. 16A illustrates a crosstalk simulation processor, according to one embodiment.

FIG. 16A illustrates a crosstalk simulation processor 1600, according to one embodiment. The crosstalk simulation processor 1600 is an example of the crosstalk simulation processor 580 of the audio systems 500, 502, 504, 600, and 700 as shown in FIGS. 5A, 5B, 5C, 6, and 7, respectively. The crosstalk simulation processor 1600 generates contralateral sound components for output to the head-mounted speakers $\mathbf{580}_L$ and $\mathbf{580}_R$, thereby providing a loudspeaker-like listening experience on the head-mounted speakers $\mathbf{580}_L$ and $\mathbf{580}_R$.

The crosstalk simulation processor 1600 includes a left head shadow low-pass filter 1602, a left cross-talk delay 1604, and a left head shadow gain 1610 to process the left input channel $X_L$. The crosstalk simulation processor 1600 further includes a right head shadow low-pass filter 1606, a right cross-talk delay 1608, and a right head shadow gain 1612 to process the right input channel $X_R$. The left head shadow low-pass filter 1602 receives the left input channel $X_L$ and applies a modulation that models the frequency response of the signal after passing through the listener's head. The output of the left head shadow low-pass filter 1602 is provided to the left cross-talk delay 1604, which applies a time delay to the output of the left head shadow low-pass filter 1602. The time delay represents trans-aural distance that is traversed by a contralateral sound component relative to an ipsilateral sound component. The frequency response can be generated based on empirical experiments to determine frequency dependent characteristics of sound wave modulation by the listener's head. For example and with reference to FIG. 1B, the contralateral sound component $\mathbf{112}_L$ that propagates to the right ear $\mathbf{125}_R$ can be derived from the ipsilateral sound component $\mathbf{118}_L$ that propagates to the left ear $\mathbf{125}_L$ by filtering the ipsilateral sound component $\mathbf{118}_L$ with a frequency response that represents sound wave modulation from trans-aural propagation, and a time delay that models the increased distance the contralateral sound component $\mathbf{112}_L$ travels (relative to the ipsilateral sound component $\mathbf{118}_R$) to reach the right ear $\mathbf{125}_R$. In some embodiments, the cross-talk delay 1604 is applied prior to the head shadow low-pass filter 1602. The left head shadow gain 1610 applies a gain to the output of the left crosstalk delay 1604 to generate the left crosstalk simulation channel $W_L$. The application of the head shadow low-pass filter, crosstalk delay, and head shadow gain for each of the left and right channels may be performed in different orders.

Similarly for the right input channel $X_R$, the right head shadow low-pass filter 1606 receives the right input channel $X_R$ and applies a modulation that models the frequency response of the listener's head. The output of the right head shadow low-pass filter 1606 is provided to the right crosstalk delay 1608, which applies a time delay to the output of the right head shadow low-pass filter 1606. The right head shadow gain 1612 applies a gain to the output of the right crosstalk delay 1608 to generate the right crosstalk simulation channel $W_R$.

Figure 16B:
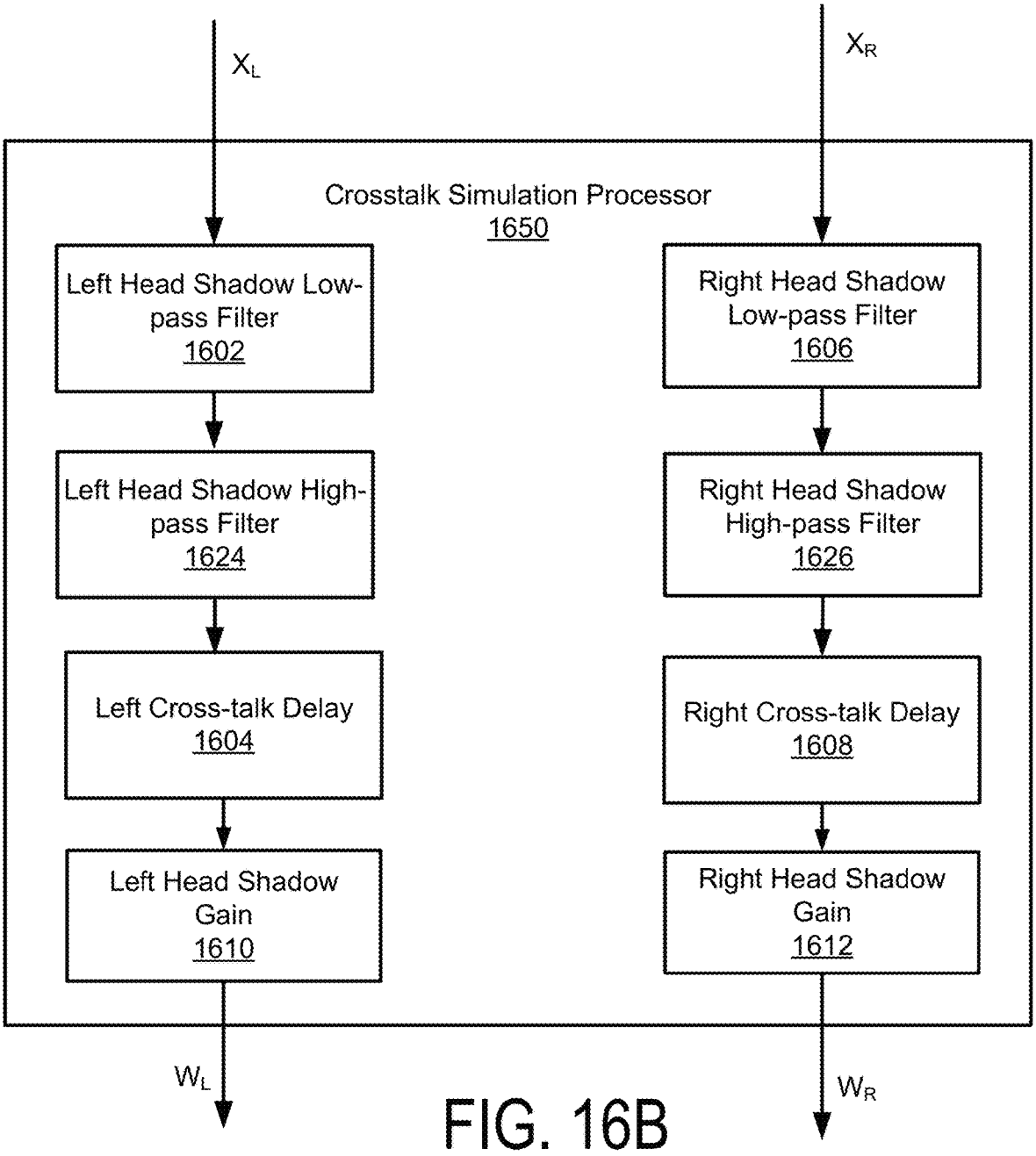
FIG. 16B illustrates a crosstalk simulation processor, according to one embodiment.

In some embodiments, the head shadow low-pass filters 1602 and 1606 have a cutoff frequency of 2,023 Hz. The cross-talk delays 1604 and 1608 apply a 0.792 millisecond delay. The head shadow gains 1610 and 1612 apply a −14.4 dB gain. FIG. 16B illustrates a crosstalk simulation processor 1650, according to one embodiment. The crosstalk simulation processor 1650 is another example of the cross-talk simulation processor 580 of the audio systems 500, 502, 504, 600, and 700 as shown in FIGS. 5A, 5B, 5C, 6, and 7, respectively. In addition to the components of the crosstalk simulation processor 1600, the crosstalk simulation processor 1650 further includes a left head shadow high-pass filter 1624 and a right head shadow high-pass filter 1626. The left head shadow high-pass filter 1624 applies a modulation to the left input channel $X_L$ that models the frequency response of the signal after passing through the listener's head, and the right head shadow high-pass filter applies a modulation to the right input channel $X_R$ that models the frequency response of the signal after passing through the listener's head. The use of both low-pass and high-pass filters on the left and right input channels $X_L$ and $X_R$ may result in a more accurate model of the frequency response though the listener's head.

The components of the crosstalk simulation processors 1600 and 1650 may be arranged in different orders. For example, although crosstalk simulation processor 1650 includes the left head shadow low-pass filter 1602 coupled with the left head shadow high-pass filter 1624, the left head shadow high-pass filter 1624 coupled to the left crosstalk delay 1604, and the left crosstalk delay 1604 coupled to the left head shadow gain 1610, the components 1602, 1624, 1604, and 1610 may be rearranged to process the left input channel $X_L$ in different orders. Similarly, the components 1606, 1626, 1608, and 1612 that process the right input channel $X_R$ may be arranged in different orders.

Figure 17:
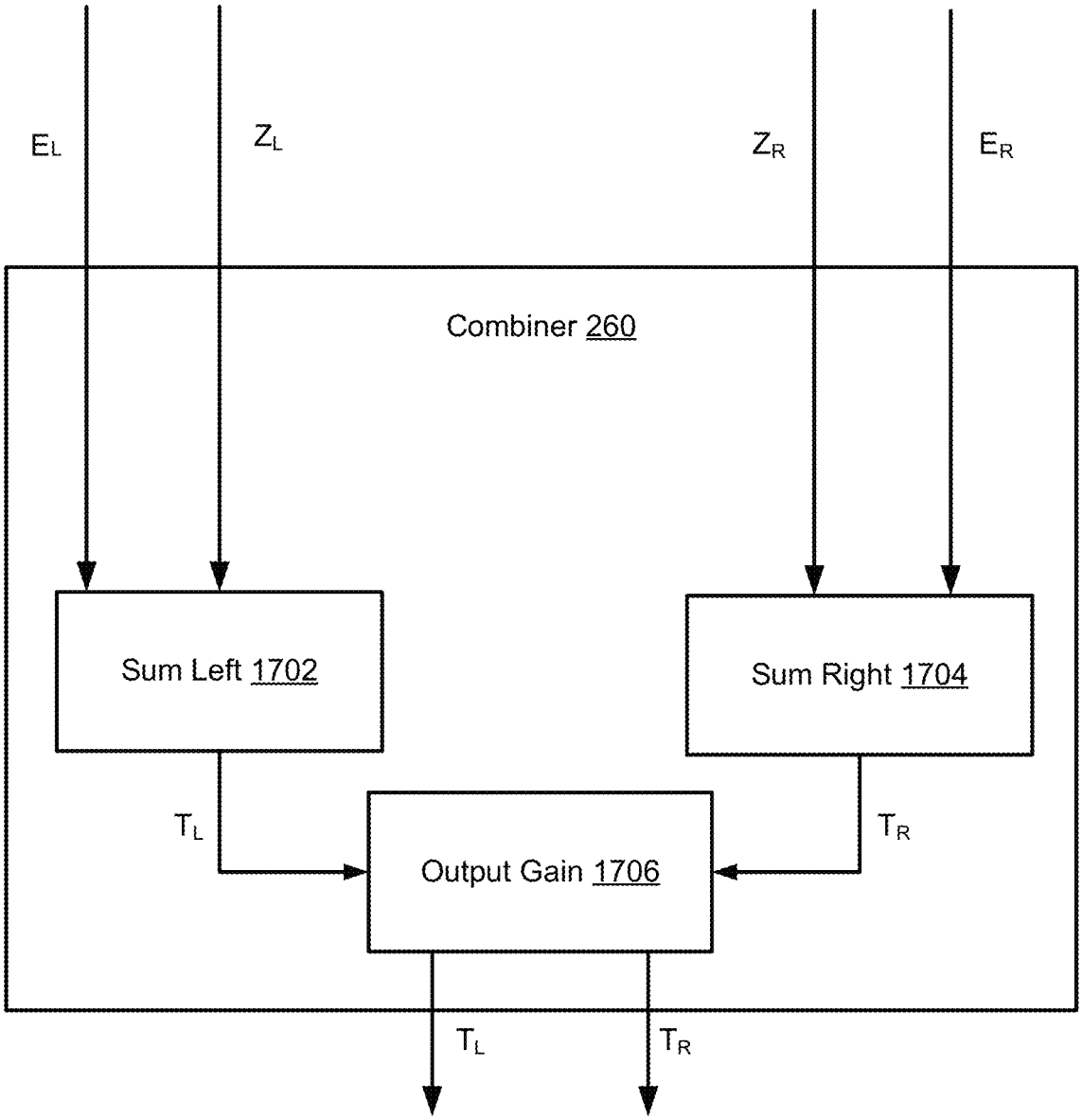
FIG. 17 illustrates a combiner, according to one embodiment.

FIG. 17 illustrates a combiner 260, according to one embodiment. The combiner 260 may be part of the audio system 200 shown in FIG. 2A. The combiner 260 includes a sum left 1702, a sum right 1704, and an output gain 1706. The combiner 260 receives the left spatially enhanced channel $E_L$ and the right spatially enhanced channel $E_R$ from the subband spatial processor 210, and receives the left crosstalk compensation channel $Z_L$ and the right crosstalk compensation channel $Z_R$ from the crosstalk compensation processor 220. The sum left 1702 combines the left spatially enhanced channel $E_L$ with left crosstalk compensation channel $Z_L$ to generate the left enhanced compensation channel $T_L$. The sum right 1704 combines the right spatially enhanced channel $E_R$ with the right crosstalk compensation channel $Z_R$ to generate the right enhanced compensation channel $T_R$. The output gain 1706 applies a gain to the left enhanced compensation channel $T_L$, and outputs the left enhanced compensation channel $T_L$. The output gain 1706 also applies a gain to the right enhanced compensation channel $T_R$, and outputs the right enhanced compensation channel $T_R$.

Figure 18:
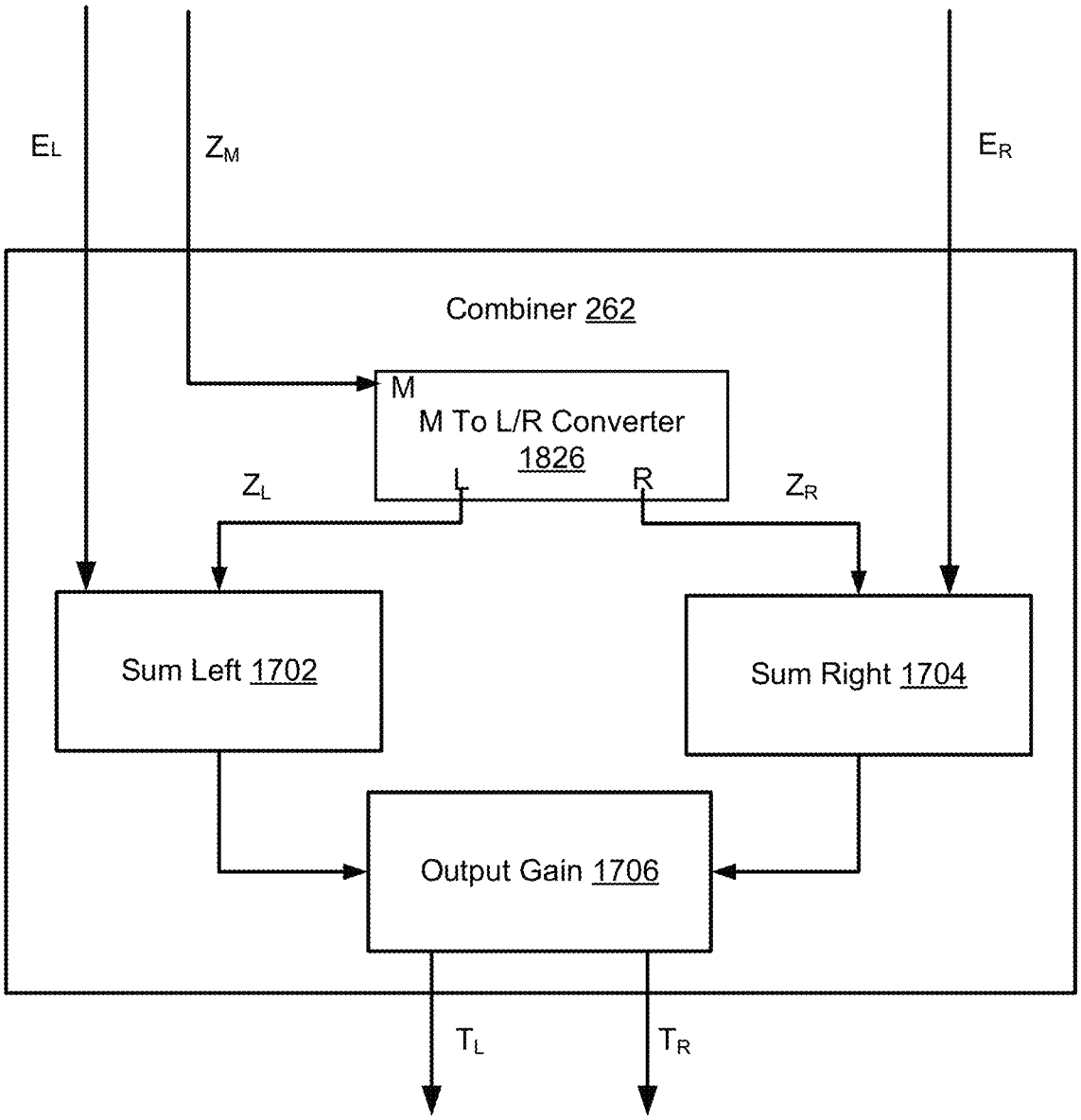
FIG. 18 illustrates a combiner, according to one embodiment.

FIG. 18 illustrates a combiner 262, according to one embodiment. The combiner 262 may be part of the audio system 202 shown in FIG. 2B. The combiner 262 includes the sum left 1702, the sum right 1704, and the output gain 1706 as discussed above for the combiner 260. Unlike the combiner 260, the combiner 262 receives the mid crosstalk compensation signal $Z_m$ from the crosstalk compensation processor 222. The M to L/R converter 1826 separates the mid crosstalk compensation signal $Z_m$ into a left crosstalk compensation channel $Z_L$ and a right crosstalk compensation channel $Z_R$. The combiner 262 receives the left spatially enhanced channel $E_L$ and the right spatially enhanced channel $E_R$ from the subband spatial processor 210, and receives the left crosstalk compensation channel $Z_L$ and the right crosstalk compensation channel $Z_R$ from the M to L/R converter 1826. The sum left 1702 combines the left spatially enhanced channel $E_L$ with left crosstalk compensation channel $Z_L$ to generate the left enhanced compensation channel $T_L$. The sum right 1704 combines the right spatially enhanced channel $E_R$ with the right crosstalk compensation channel $Z_R$ to generate the right enhanced compensation channel $T_R$. The output gain 1706 applies a gain to the left enhanced compensation channel $T_L$, and outputs the left enhanced compensation channel $T_L$. The output gain 1706 also applies a gain to the right enhanced compensation channel $T_R$, and outputs the right enhanced compensation channel $T_R$.

Figure 19:
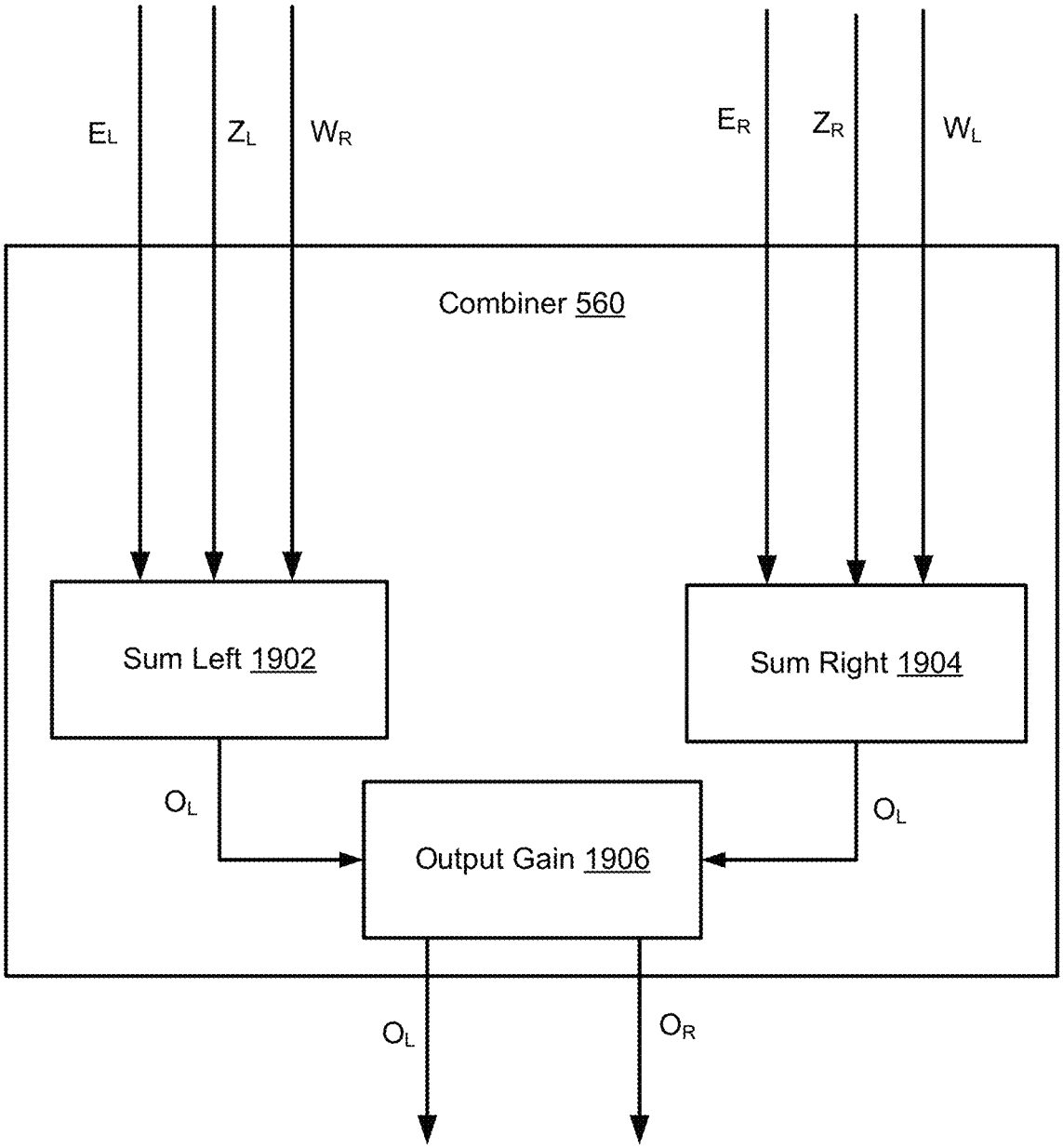
FIG. 19 illustrates a combiner, according to one embodiment.

FIG. 19 illustrates a combiner 560, according to one embodiment. The combiner 560 may be part of the audio system 500 shown in FIG. 5A. The combiner 560 includes a sum left 1902, a sum right 1904, and an output gain 1906. The combiner 560 receives the left spatially enhanced channel $E_L$ and the right spatially enhanced channel $E_R$ from the subband spatial processor 210, receives the left crosstalk compensation channel $Z_L$ and the right crosstalk compensation channel $Z_R$ from the crosstalk compensation processor 520, and receives the left crosstalk simulation channel $W_L$ and the right crosstalk simulation channel $W_R$ from the crosstalk simulation processor 580. The sum left 1902 combines the left spatially enhanced channel $E_L$, the left crosstalk compensation channel $Z_L$, and the right crosstalk simulation channel $W_R$ to generate the left output channel $O_L$. The sum right 1904 combines the right spatially enhanced channel $E_R$, the right crosstalk compensation channel $Z_R$, and the left crosstalk simulation channel $W_L$ to generate the right output channel $O_R$. The output gain 1906 applies a gain to the left output channel $O_L$, and outputs the left output channel $O_L$. The output gain 1906 also applies a gain to the right output channel $O_R$, and outputs the right output channel $O_R$.

Figure 20:
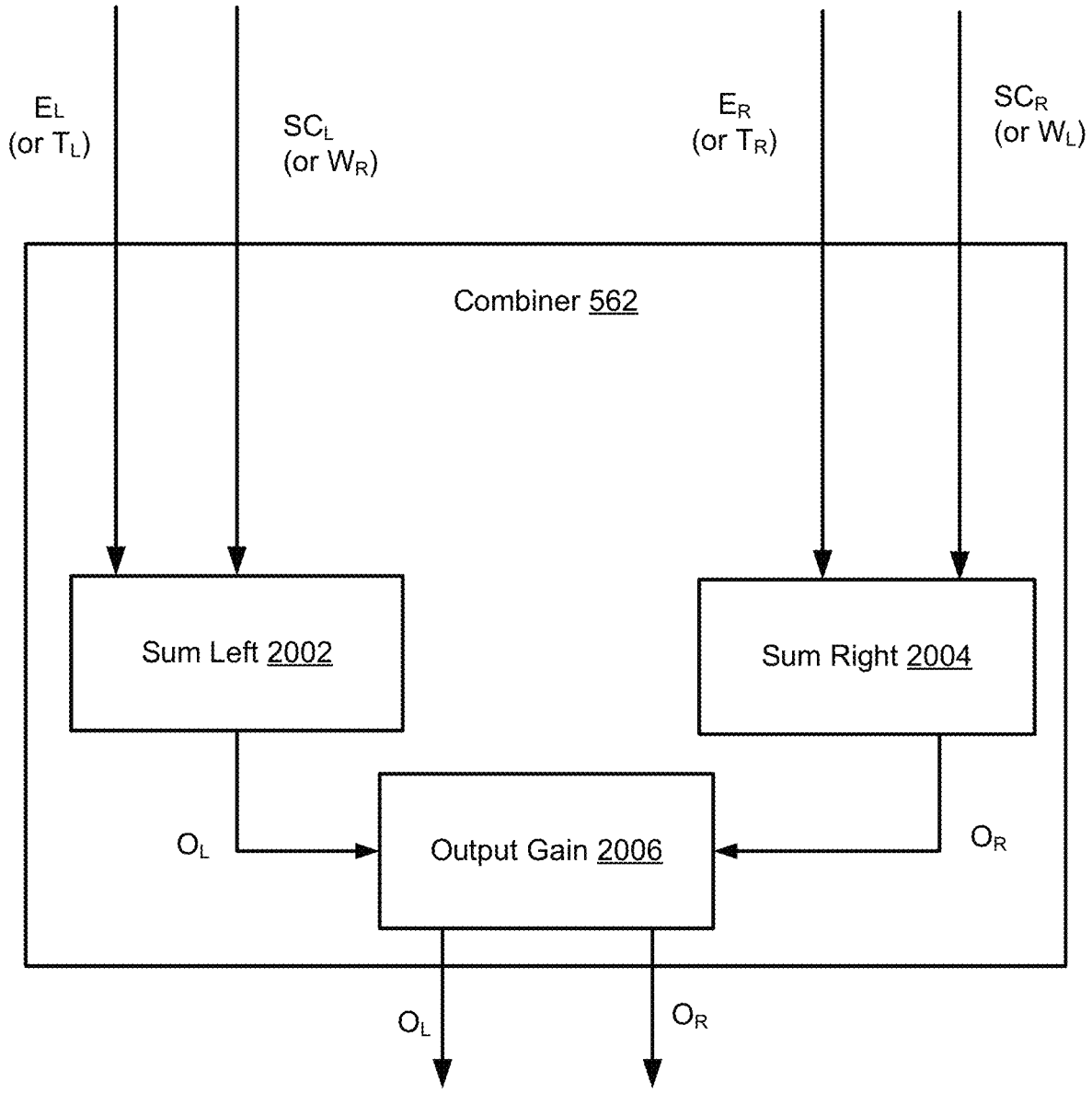
FIG. 20 illustrates a combiner, according to one embodiment.

FIG. 20 illustrates a combiner 562, according to one embodiment. The combiner 562 may be part of the audio system 502, 504, 600, and 700 shown in FIGS. 5B, 5C, 6 and 7, respectively. For the audio systems 502 and 504, the combiner 562 receives the left spatially enhanced channel $E_L$ and the right spatially enhanced channel $E_R$ from the subband spatial processor 210, receives the left simulation compensation channel $SC_L$ and the right simulation compensation channel $SC_R$, and generates the left output channel $O_L$ and the right output channel $O_R$.

The sum left 2002 combines the left spatially enhanced channel $E_L$ and the left simulation compensation channel $SC_L$ to generate the left output channel $O_L$. The sum right 2004 combines the right spatially enhanced channel $E_R$ and the right simulation compensation channel $SC_R$ to generate the right output channel $O_R$. The output gain 2006 applies gains to the left output channel $O_L$ and the right output channel $O_R$, and outputs the left output channel $O_L$ and the right output channel $O_R$.

For the audio system 600, the combiner 562 receives the left enhanced compensation channel $T_L$ and the right enhanced compensation channel $T_R$ from the subband spatial processor 610, receives the left crosstalk simulation channel $W_L$ and the right crosstalk simulation channel $W_R$ from the crosstalk simulation processor 580. The sum left 2002 generates the left output channel $O_L$ by combining the left enhanced compensation channel $T_L$ and the right crosstalk simulation channel $W_R$. The sum right 2004 generates the right output channel $O_R$ by combining the right enhanced compensation channel $T_R$ and the left crosstalk simulation channel $W_L$.

For the audio system 700, the combiner 562 receives the left spatially enhanced channel $E_L$ and the right spatially enhanced channel $E_R$ from the subband spatial processor 210, and receives the left crosstalk simulation channel $W_L$ and the right crosstalk simulation channel $W_R$ from the crosstalk simulation processor 580. The sum left 2002 generates the left enhanced compensation channel $T_L$ by combining the left spatially enhanced channel $E_L$ and the right crosstalk simulation channel $W_R$. The sum right 2004 generates the right enhanced compensation channel $T_R$ by combining the right spatially enhanced channel $E_R$ and the left crosstalk simulation channel $W_L$.

Example Crosstalk Compensation

As discussed above, a crosstalk compensation processor may compensate for comb-filtering artifacts that occur in the spatial and nonspatial signal components as a result of various crosstalk delays and gains in crosstalk cancellation. These crosstalk cancellation artifacts may be handled by applying correction filters to the non-spatial and spatial components independently. Mid/Side filtering (with associated M/S de-matrixing) can be inserted at various points in the overall signal flow of the algorithms, and the crosstalk-induced comb-filter peaks and notches in the frequency response of the spatial and nonspatial signal components may be handled in parallel.

FIGS. 21-26 illustrate effects on the spatial and nonspatial signal components when applying the filters of a crosstalk compensation processor for different speaker angle and speaker size configurations, with only crosstalk cancellation processing applied to an input signal. The crosstalk compensation processor can selectively flatten the frequency response of the signal components, providing a minimally colored and minimally gain-adjusted post-crosstalk-cancelled output.

In these examples, compensation filters are applied to the spatial and nonspatial components independently, targeting all comb-filter peaks and/or troughs in the nonspatial (L+R, or mid) component, and all but the lowest comb-filter peaks and/or troughs in the spatial (L-R, or side) component. The method of compensation can be procedurally derived, tuned by ear and hand, or a combination.

Figure 21:
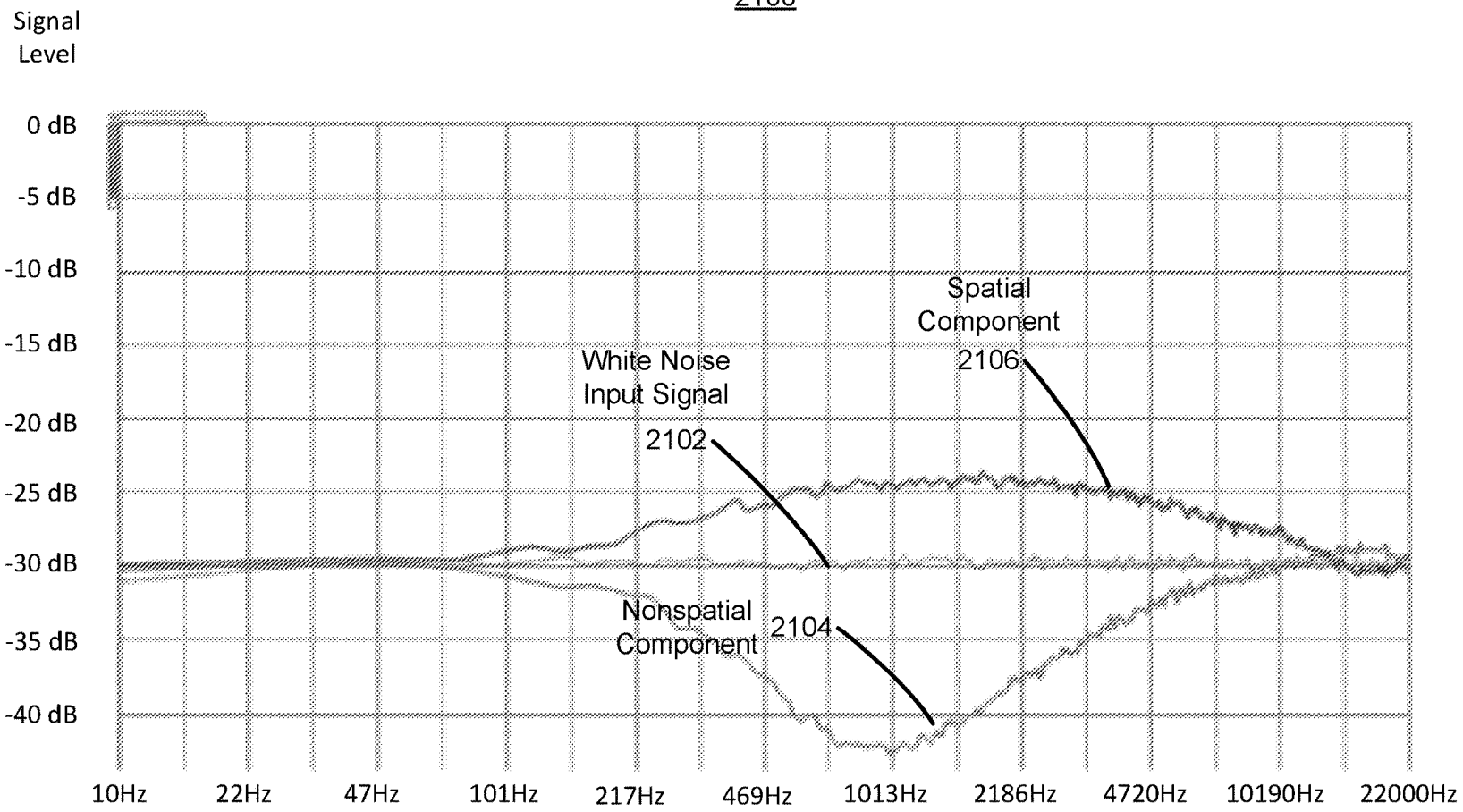
FIGS. 21-26 illustrate plots of spatial and nonspatial components of a signal using crosstalk cancellation and crosstalk compensation, according to one embodiment.

FIG. 21 illustrates a plot 2100 of a crosstalk cancelled signal, according to one embodiment. The line 2102 is a white noise input signal. The line 2104 is a nonspatial component of the input signal with crosstalk cancellation. The line 2106 is a spatial component of the input signal with crosstalk cancellation. For a speaker angle of 10 degrees and a small speaker setting, the crosstalk cancellation may include a crosstalk delay of 1 sample @48 KHz sampling rate, a crosstalk gain of −3 dB, and an in-band frequency range defined by a low frequeny bypass of 350 Hz and a high frequency bypass of 12000 Hz.

Figure 22:
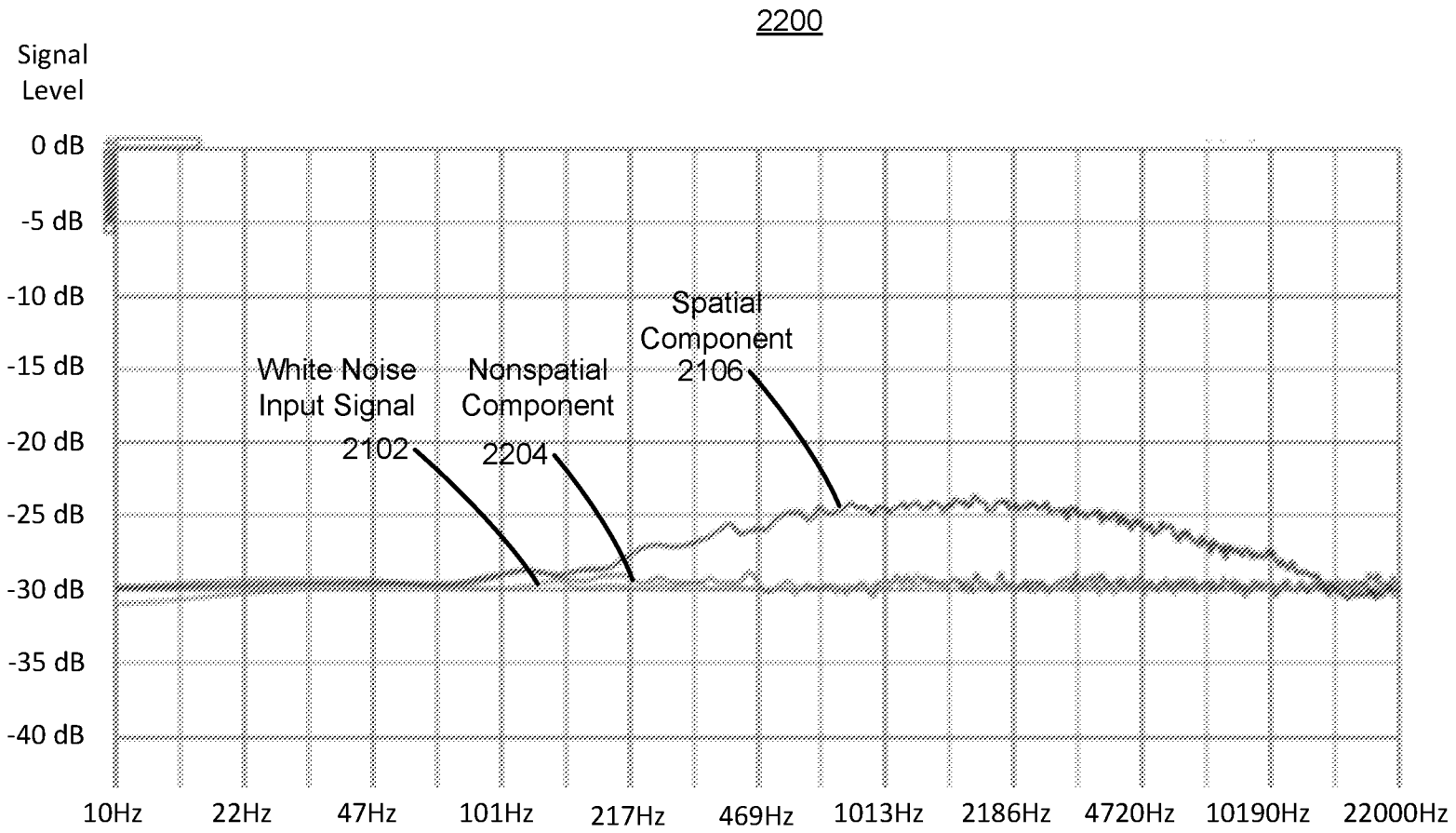

FIG. 22 illustrates a plot 2200 for crosstalk compensation applied to the nonspatial component of FIG. 21, according to one embodiment. The line 2204 represents the crosstalk compensation applied to the nonspatial component of the input signal with crosstalk cancellation, as represented by the line 2104 in FIG. 21. In particular, two mid filters are applied to the crosstalk cancelled nonspatial component including a peaknotch filter having a 1000 Hz center frequency, a 12.5 dB gain, and 0.4 Q, and another peaknotch filter having a 15000 Hz center frequency, a −1 dB gain, and 1.0 Q. Although not shown in FIG. 22, the line 2106 representing the spatial component of the input signal with crosstalk cancellation may also be modified with a crosstalk compensation.

Figure 23:
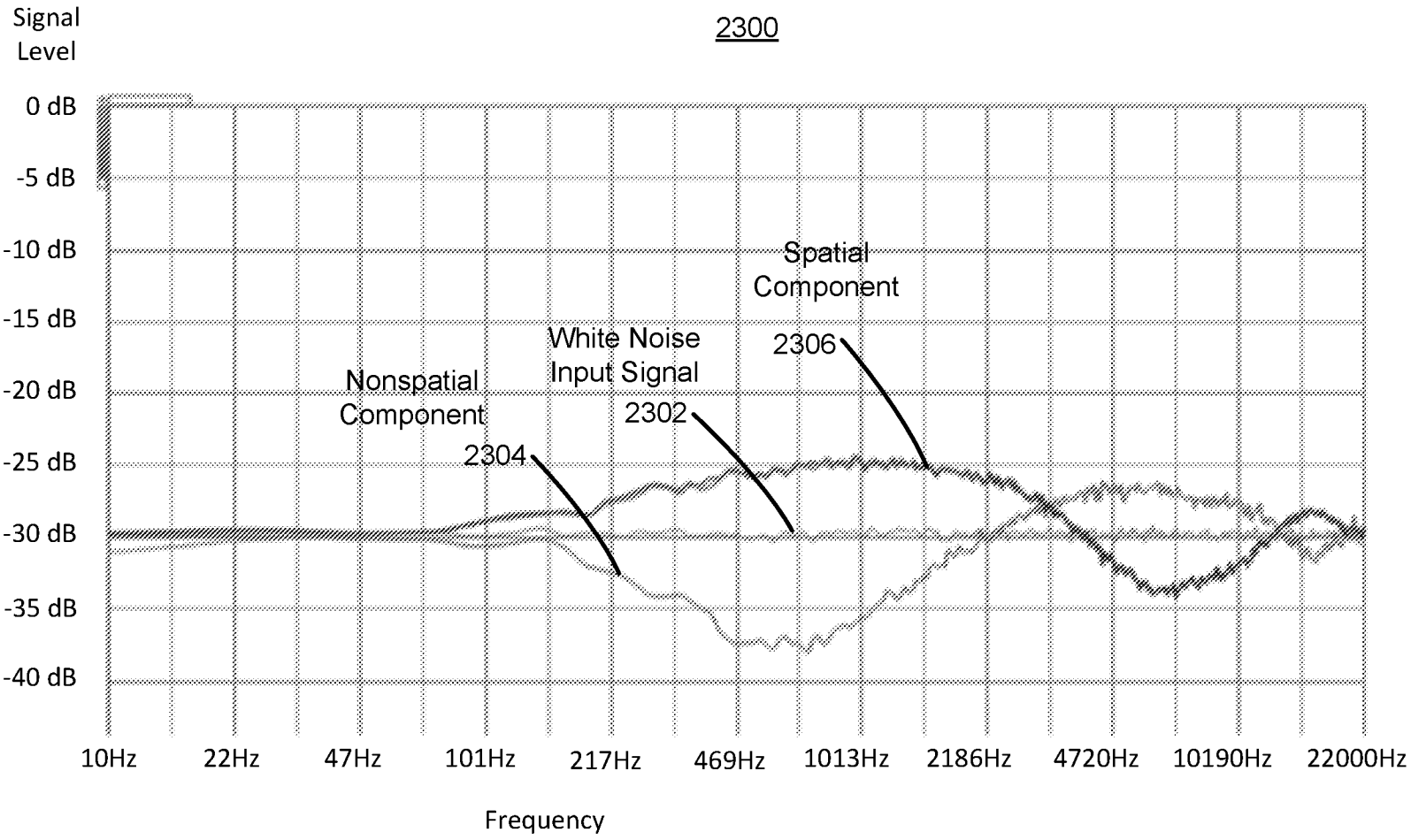

FIG. 23 illustrates a plot 2300 of a crosstalk cancelled signal, according to one embodiment. The line 2302 is a white noise input signal. The line 2304 is a nonspatial component of the input signal with crosstalk cancellation. The line 2306 is a spatial component of the input signal with crosstalk cancellation. For a speaker angle of 30 degrees and a small speaker setting, the crosstalk cancellation may include a crosstalk delay of 3 samples @48 KHz sampling rate, a crosstalk gain of −6.875 dB, and an in-band frequency range defined by a low frequeny bypass of 350 Hz and a high frequency bypass of 12000 Hz.

Figure 24:
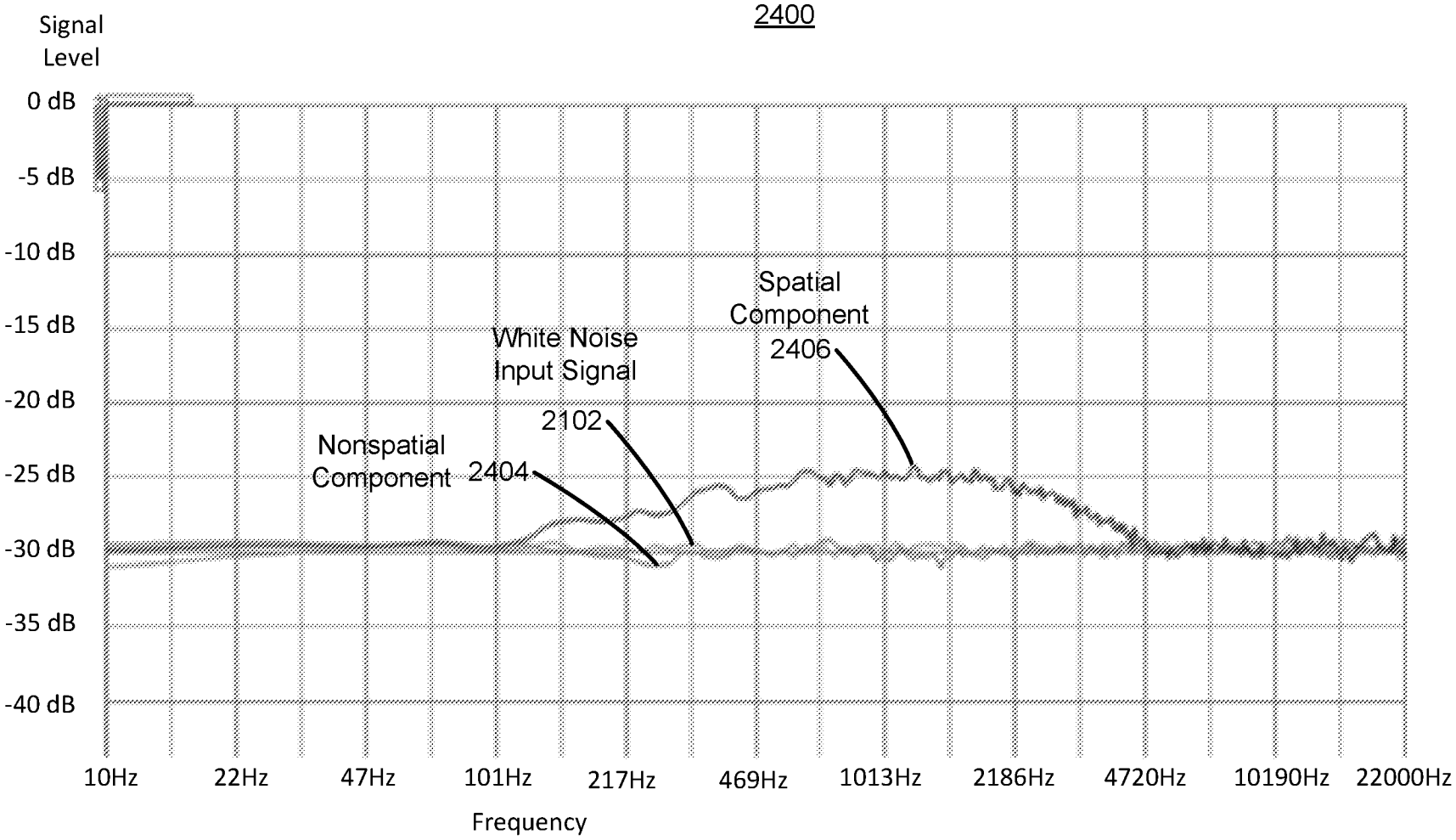

FIG. 24 illustrates a plot 2400 for crosstalk compensation applied to the nonspatial component and spatial component of FIG. 23, according to one embodiment. The line 2404 represents the crosstalk compensation applied to the nonspatial component of the input signal with crosstalk cancellation, as represented by the line 2304 in FIG. 23. Three mid filters are applied to the crosstalk cancelled nonspatial component including a first peaknotch filter having a 650 Hz center frequency, an 8.0 dB gain, and 0.65 Q, a second peaknotch filter having a 5000 Hz center frequency, a −3.5 dB gain, and 0.5 Q, and a third peaknotch filter having a 16000 Hz center frequency, a 2.5 dB gain, and 2.0 Q. The line 2406 represents the crosstalk compensation applied to the spatial component of the input signal with crosstalk cancellation, as represented by the line 2306 in FIG. 23. Two side filters are applied to the crosstalk cancelled spatial component including a first peaknotch filter having a 6830 Hz center frequency, an 4.0 dB gain, and 1.0 Q, and a second peaknotch filter having a 15500 Hz center frequency, a −2.5 dB gain, and 2.0 Q. In general, the number of mid and side filters applied by the crosstalk compensation processor, as well as their parameters, may vary.

Figure 25:
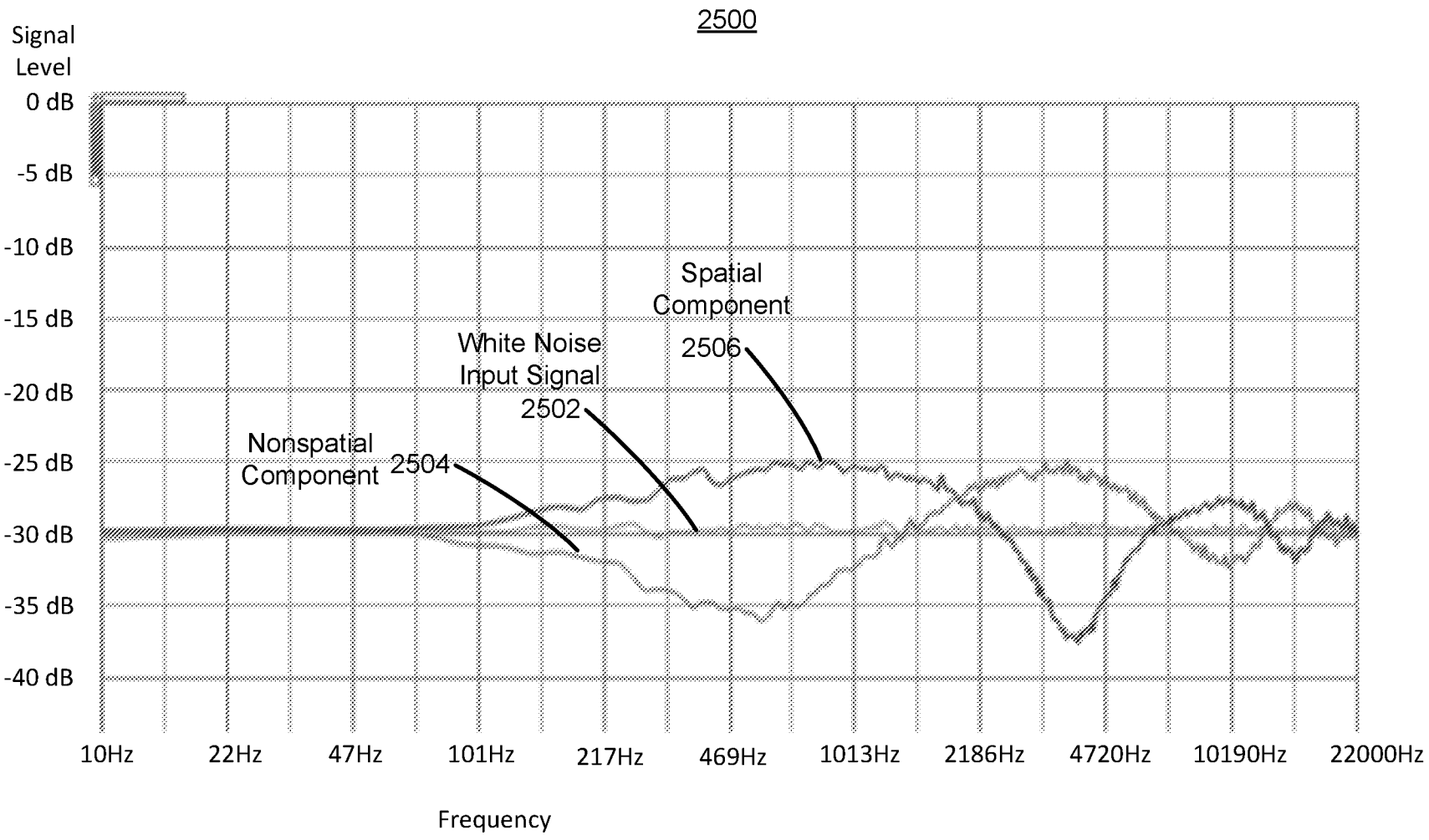

FIG. 25 illustrates a plot 2500 of a crosstalk cancelled signal, according to one embodiment. The line 2502 is a white noise input signal. The line 2504 is a nonspatial component of the input signal with crosstalk cancellation. The line 2506 is a spatial component of the input signal with crosstalk cancellation. For a speaker angle of 50 degrees and a small speaker setting, the crosstalk cancellation may include a crosstalk delay of 5 samples @48 KHz sampling rate, a crosstalk gain of −8.625 dB, and an in-band defined by a low frequency bypass of 350 Hz and a high frequency bypass of 12000 Hz.

Figure 26:
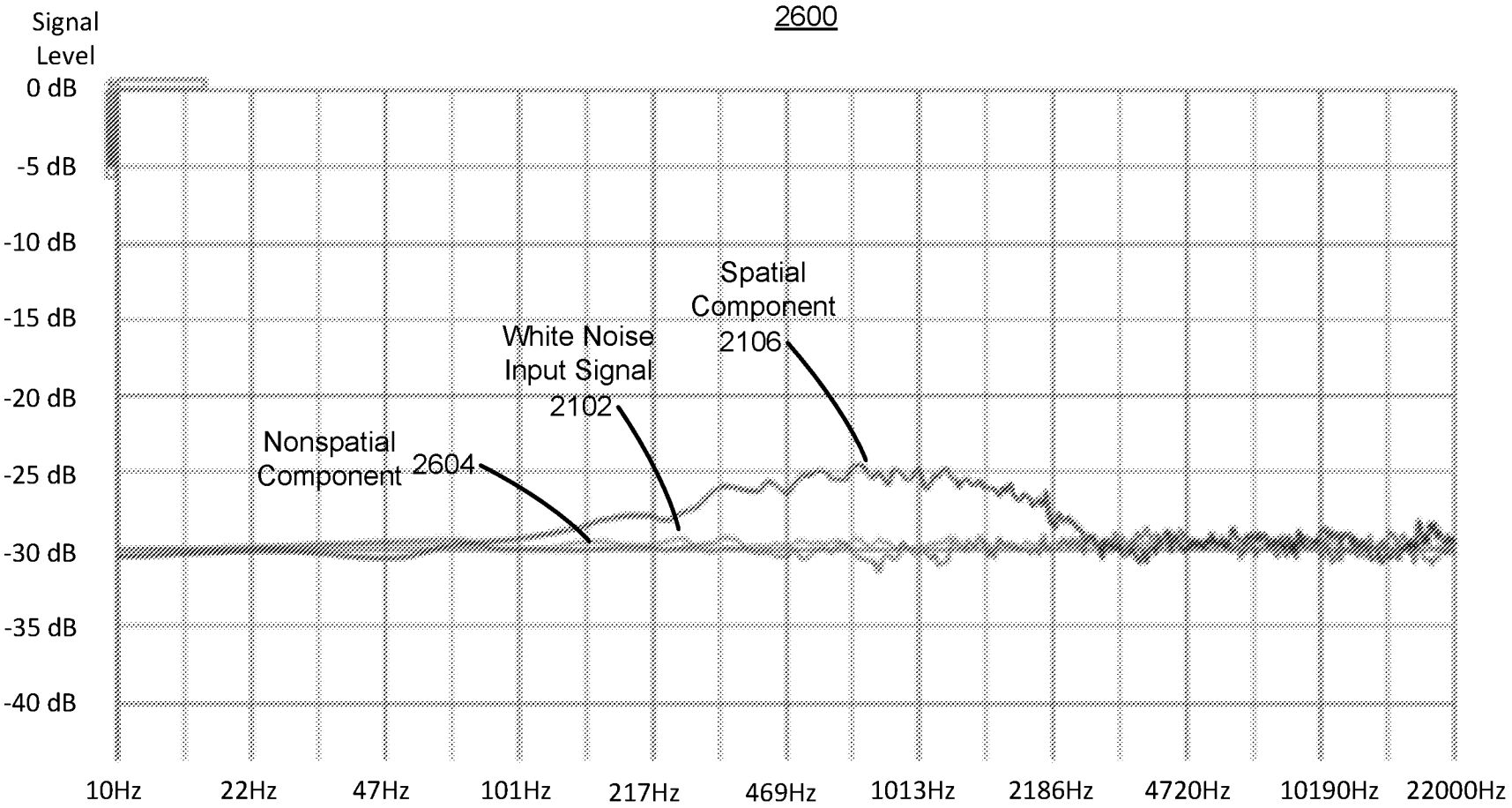

FIG. 26 illustrates a plot 2600 for crosstalk compensation applied to the nonspatial component and spatial component of FIG. 25, according to one embodiment. The line 2604 represents the crosstalk compensation applied to the nonspatial component of the input signal with crosstalk cancellation, as represented by the line 2504 in FIG. 25. Four mid filters are applied to the crosstalk cancelled nonspatial component including a first peaknotch filter having a 500 Hz center frequency, an 6.0 dB gain, and 0.65 Q, a second peaknotch filter having a 3200 Hz center frequency, a −4.5 dB gain, and 0.6 Q, a third peaknotch filter having a 9500 Hz center frequency, a 3.5 dB gain, and 1.5 Q, and a fourth peaknotch filter having a 14000 Hz center frequency, a −2.0 dB gain, and 2.0 Q. The line 2606 represents the crosstalk compensation applied to the spatial component of the input signal with crosstalk cancellation, as represented by the line 2506 in FIG. 25. Three side filters are applied to the crosstalk cancelled spatial component including a first peaknotch filter having a 4000 Hz center frequency, an 8.0 dB gain, and 2.0 Q, and second peaknotch filter having an 8800 Hz center frequency, a −2.0 dB gain, and 1.0 Q, and a third peaknotch filter having a 15000 Hz center frequency, a 1.5 dB gain, and 2.5 Q.

FIG. 27A illustrates a table 2700 of filter settings for a crosstalk compensation processor as a function of crosstalk cancellation delays, according to one embodiment. In particular, the table 2700 provides center frequency (Fc), gain, and Q values for a mid filter 840 of a crosstalk compensation processor when the crosstalk cancellation processor applies an in-band frequency range of 350 to 12000 Hz @48 KHz.

FIG. 27B illustrates a table 2750 of filter settings for a crosstalk compensation processor as a function of crosstalk cancellation delays, according to one embodiment. In particular, the table 2750 provides center frequency (Fc), gain, and Q values for a mid filter 840 of a crosstalk compensation processor when the crosstalk cancellation processor applies an in-band frequency range of 200 to 14000 Hz @48 KHz.

As shown in FIGS. 27A and 27B, different crosstalk delay times may be caused by speaker positions or angles, for example, and may result in different comb-filtering artifacts. Furthermore, different in-band frequencies used in crosstalk cancellation may also result in different comb-filtering artifacts. As such, the mid and side filters of the crosstalk cancellation processor may apply different settings for the center frequency, gain, and Q to compensate for the comb-filtering artifacts.

Example Processing

The audio systems discussed herein perform various types of processing on an input audio signal including subband spatial processing (SBS), crosstalk compensation processing (CCP), and crosstalk processing (CP). The crosstalk processing may include crosstalk simulation or crosstalk cancellation. The order of processing for SBS, CCP, and CP may vary. In some embodiments, various steps of the SBS, CCP, or CP processing may be integrated. Some examples of processing embodiments are shown in FIGS. 28A, 28B, 28C, 28D, and 28E for when the crosstalk processing is crosstalk cancellation, and in FIGS. 29A, 29B, 29C, 29D, 29E, 29F, 29G, and 29H for when the crosstalk processing is crosstalk simulation.

Figure 28B:
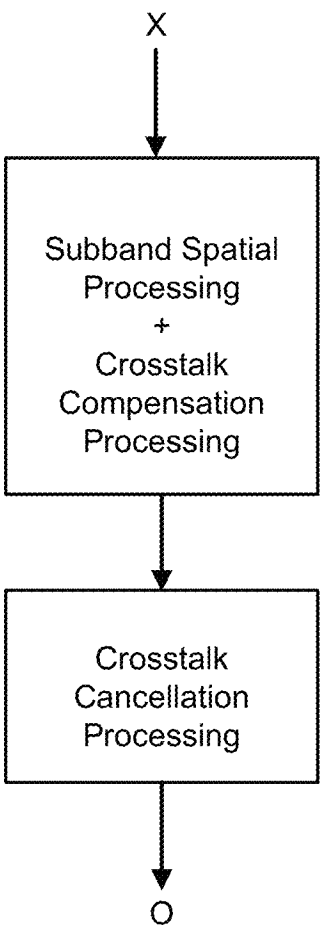
FIGS. 28A, 28B, 28C, 28D, and 28E illustrate examples of crosstalk cancellation, crosstalk compensation, and subband spatial processing, according to some embodiments.
Figure 28A:
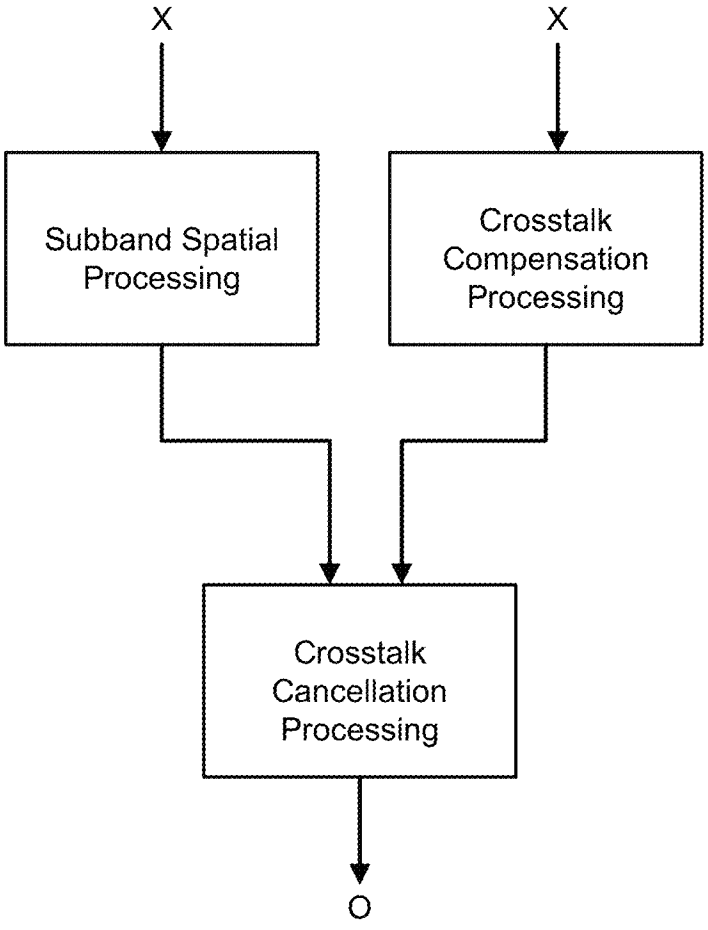

With reference to FIG. 28A, subband spatial processing is performed in parallel with crosstalk compensation processing on the input audio signal X to generate a result, then crosstalk cancellation processing is applied to the result to generate the output audio signal O.

With reference to FIG. 28B, the subband spatial processing is integrated with the crosstalk compensation processing to generate a result from the input audio signal X. An example is shown in FIG. 3 where the crosstalk compensation processor 320 is integrated with the subband spatial processor 310. Crosstalk cancellation processing is then applied to the result to generate the output audio signal O.

Figure 28D:
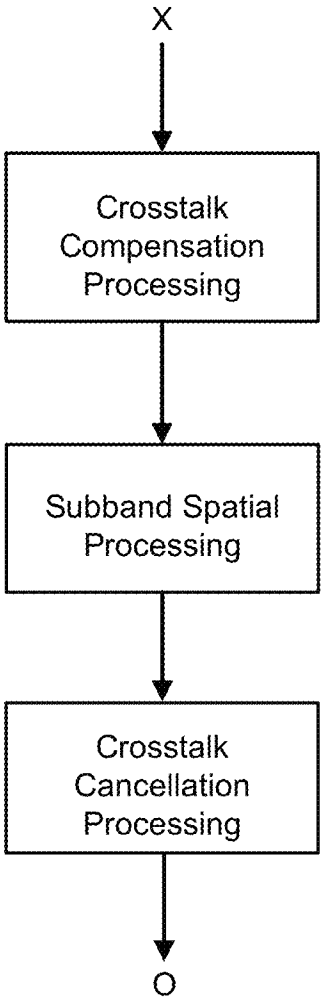
Figure 28C:
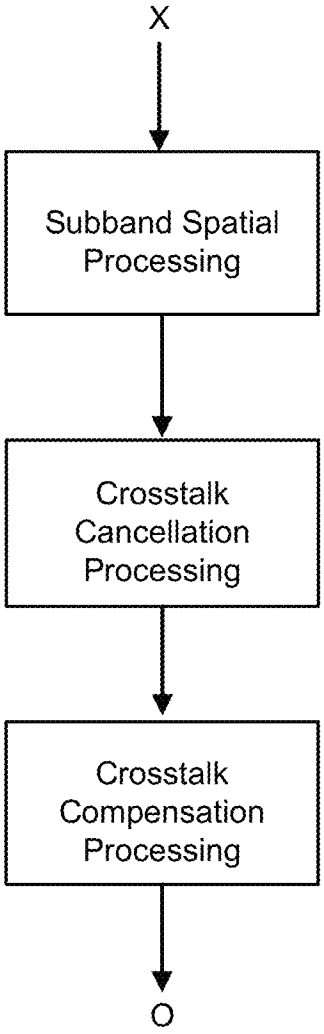

With reference to FIG. 28C, the subband spatial processing is performed on the input audio signal X to generate a result, crosstalk cancellation processing is performed on the result of the subband spatial processing, and crosstalk compensation processing is performed on the result of the crosstalk cancellation processing to generate the output audio signal O.

With reference to FIG. 28D, the crosstalk compensation processing is performed on the input audio signal X to generate a result, subband spatial processing is performed on the result of the crosstalk compensation processing, and crosstalk cancellation processing is performed on the result of the crosstalk compensation processing to generate the output audio signal O.

Figure 28E:
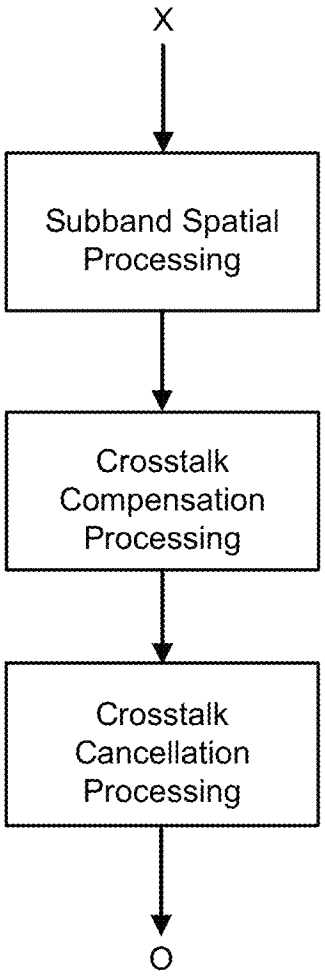

With reference to FIG. 28E, subband spatial processing is performed on the input audio signal X to generate a result, crosstalk compensation processing is performed on the result of the subband spatial processing, and crosstalk cancellation processing is performed on the result of the crosstalk compensation processing to generate the output audio signal O.

Figure 29A:
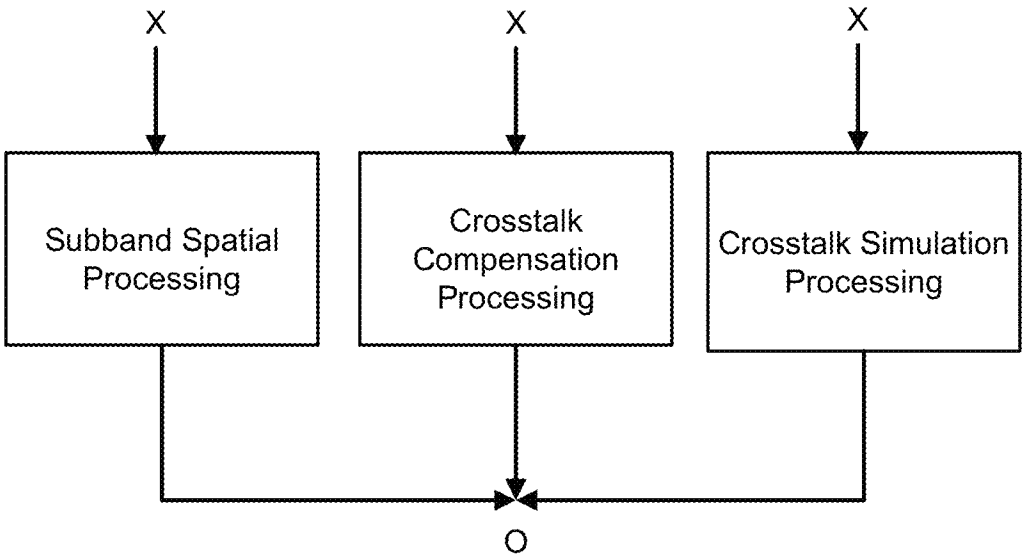
FIGS. 29A, 29B, 29C, 29D, 29E, 29F, 29G, and 29H illustrate examples of crosstalk simulation, crosstalk compensation, and subband spatial processing, according to some embodiments.

With reference to FIG. 29A, subband spatial processing, crosstalk compensation processing, and crosstalk simulation processing are each performed on the input audio signal X, and the results are combined to generate the output audio signal O.

Figure 29C:
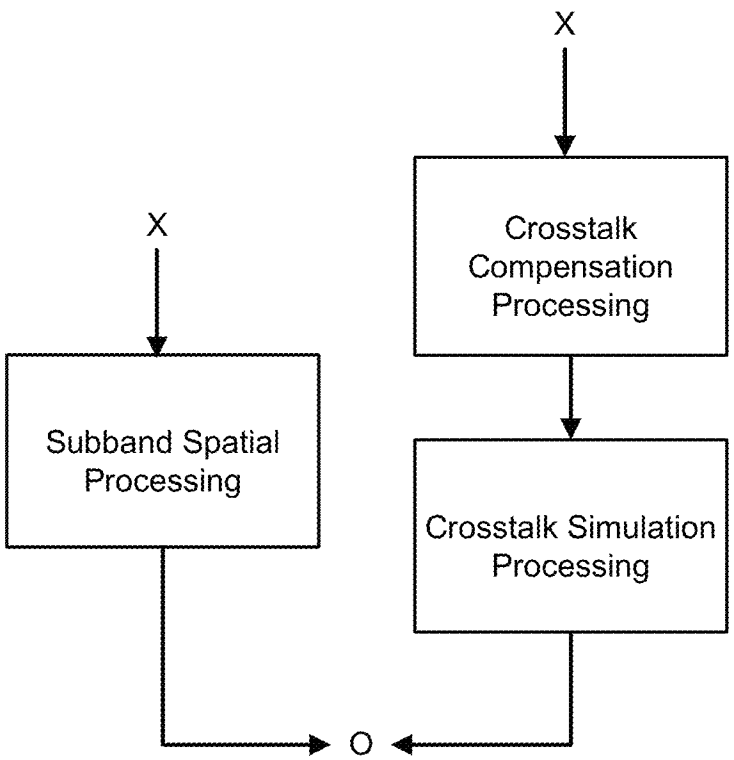
Figure 29B:
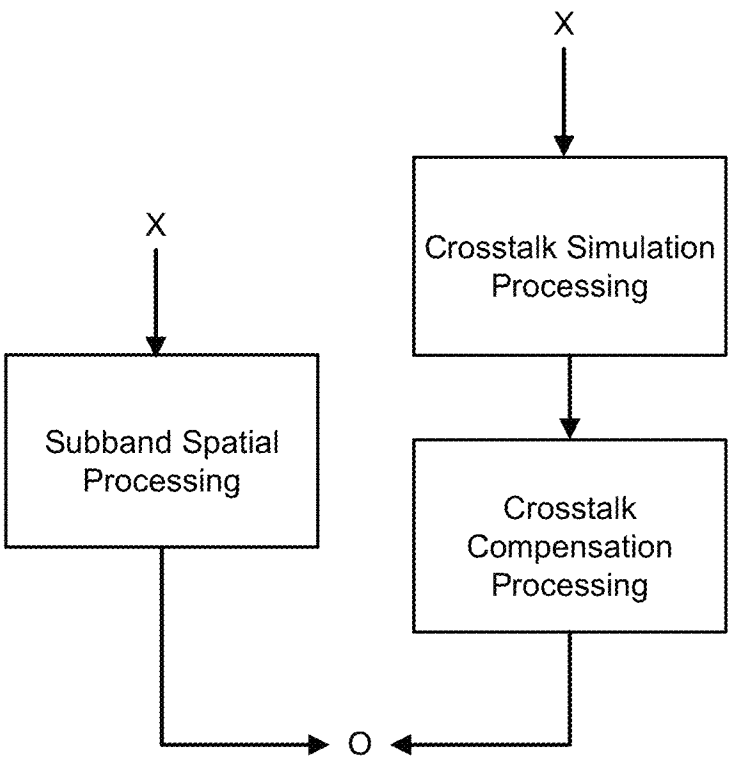

With reference to FIG. 29B, subband spatial processing is performed on the input audio signal X in parallel with crosstalk simulation processing and crosstalk compensation processing being performed on the input audio signal X. The parallel results are combined to generate the output audio signal O. Here, the crosstalk simulation processing is applied before the crosstalk compensation processing.

With reference to FIG. 29C, subband spatial processing is performed on the input audio signal X in parallel with crosstalk compensation processing and crosstalk simulation processing being performed on the input audio signal X. The parallel results are combined to generate the output audio signal O. Here, the crosstalk compensation processing is applied before the crosstalk simulation processing.

Figure 29E:
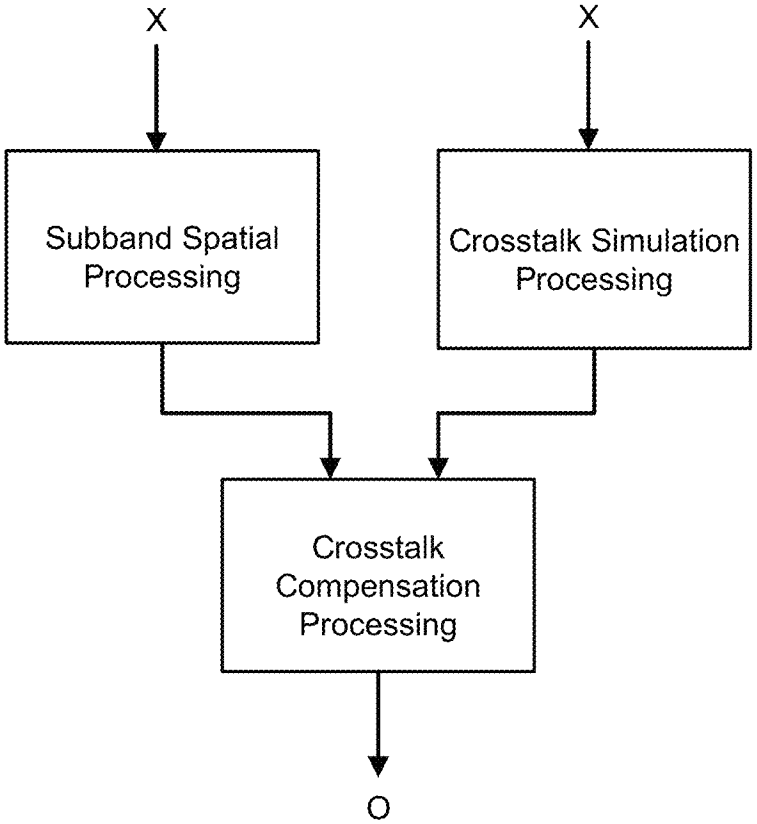
Figure 29D:
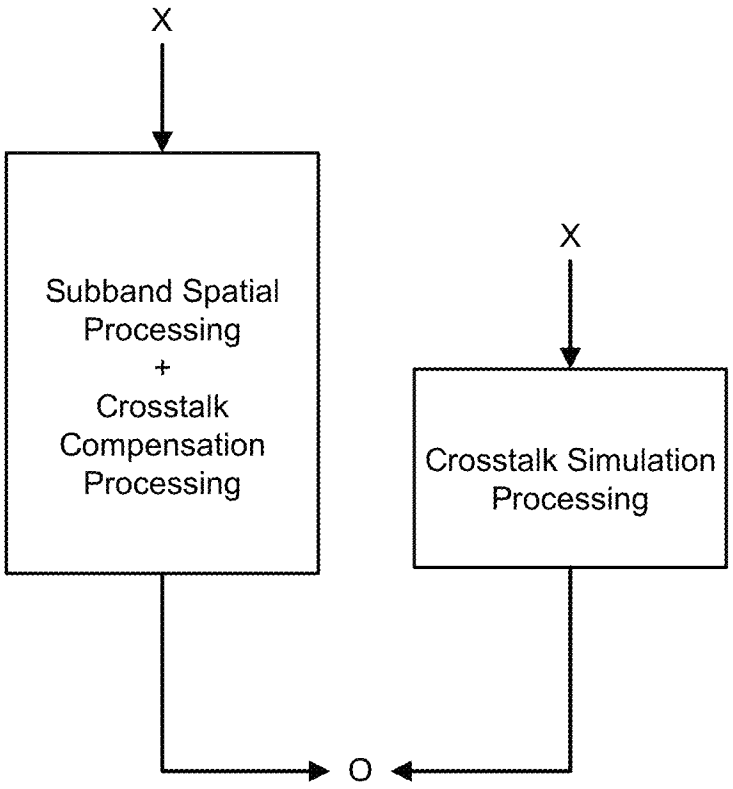

With reference to FIG. 29D, subband spatial processing is integrated with crosstalk compensation processing to generate a result from the input audio signal X. In parallel, crosstalk simulation processing is applied to the input audio signal X. The parallel results are combined to generate the output audio signal O.

With reference to FIG. 29E, subband spatial processing and crosstalk simulation processing are each applied to the input audio signal X. Crosstalk compensation processing is applied to the parallel results to generate the output audio signal O.

Figure 29G:
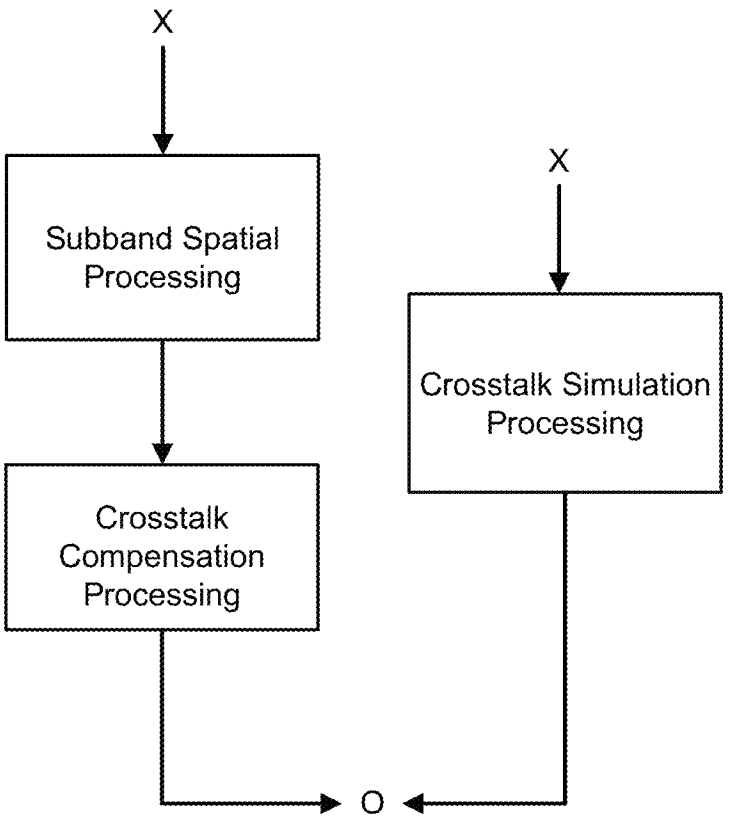
Figure 29F:
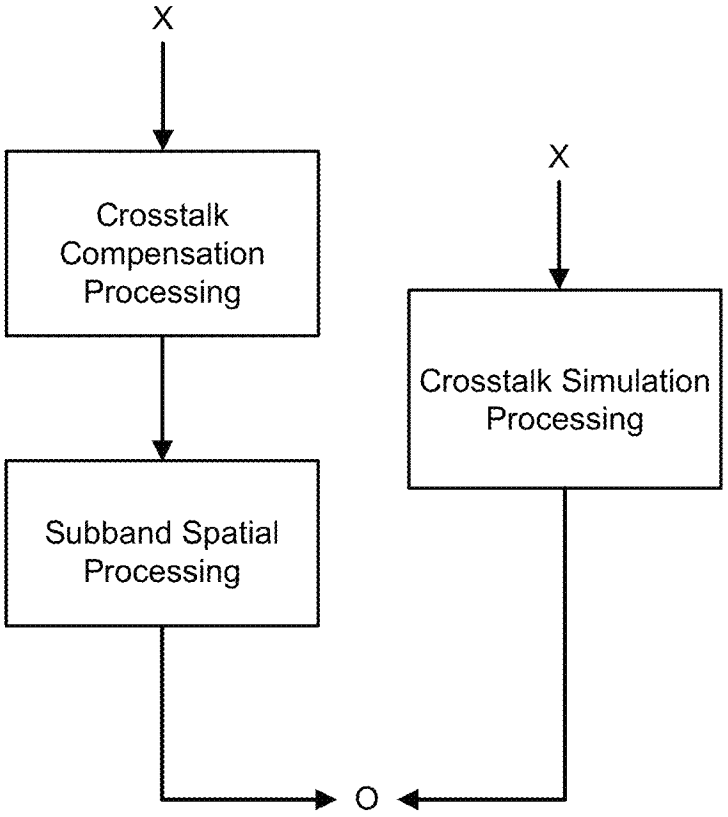

With reference to FIG. 29F, crosstalk simulation processing is applied to the input audio signal X in parallel with crosstalk compensation processing and subband spatial processing being applied to the input signal X. The parallel results are combined to generate the output audio signal O. Here, the crosstalk compensation processing is performed before the subband spatial processing.

With reference to FIG. 29G, crosstalk simulation processing is applied to the input audio signal X in parallel with subband spatial processing and crosstalk compensation processing being applied to the input signal X. The parallel results are combined to generate the output audio signal O. Here, the subband spatial processing is performed before the crosstalk compensation processing.

Figure 29H:
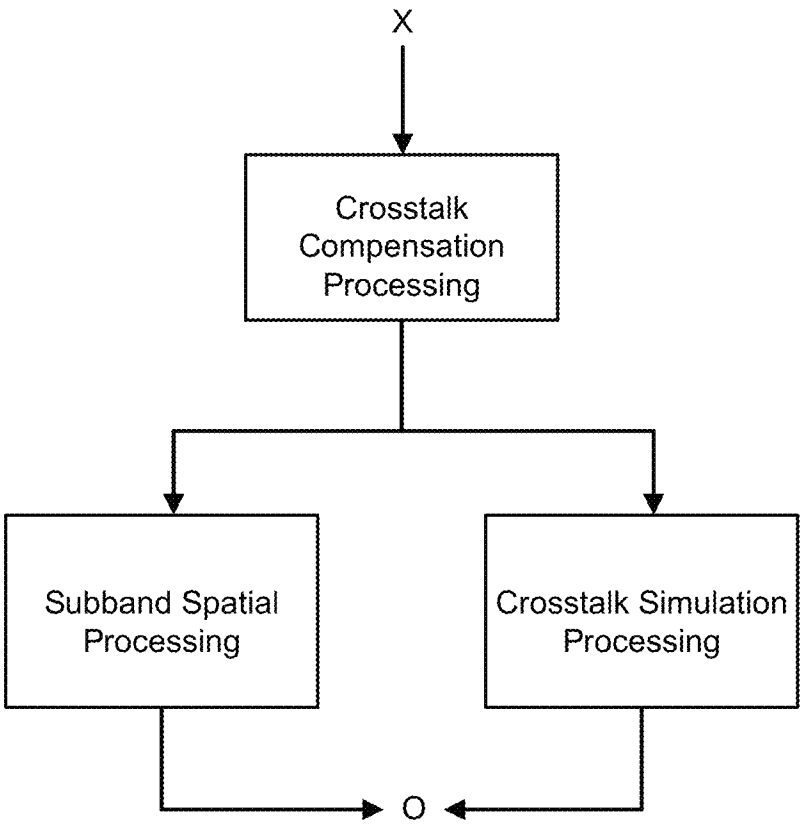

With reference to FIG. 29H, crosstalk compensation processing is applied to the input audio signal. Subband spatial processing and crosstalk simulation are applied in parallel to the result of the crosstalk compensation processing. The result of the subband spatial processing and crosstalk simulation processing are combined to generate the output audio signal O.

Example Computer

Figure 30:
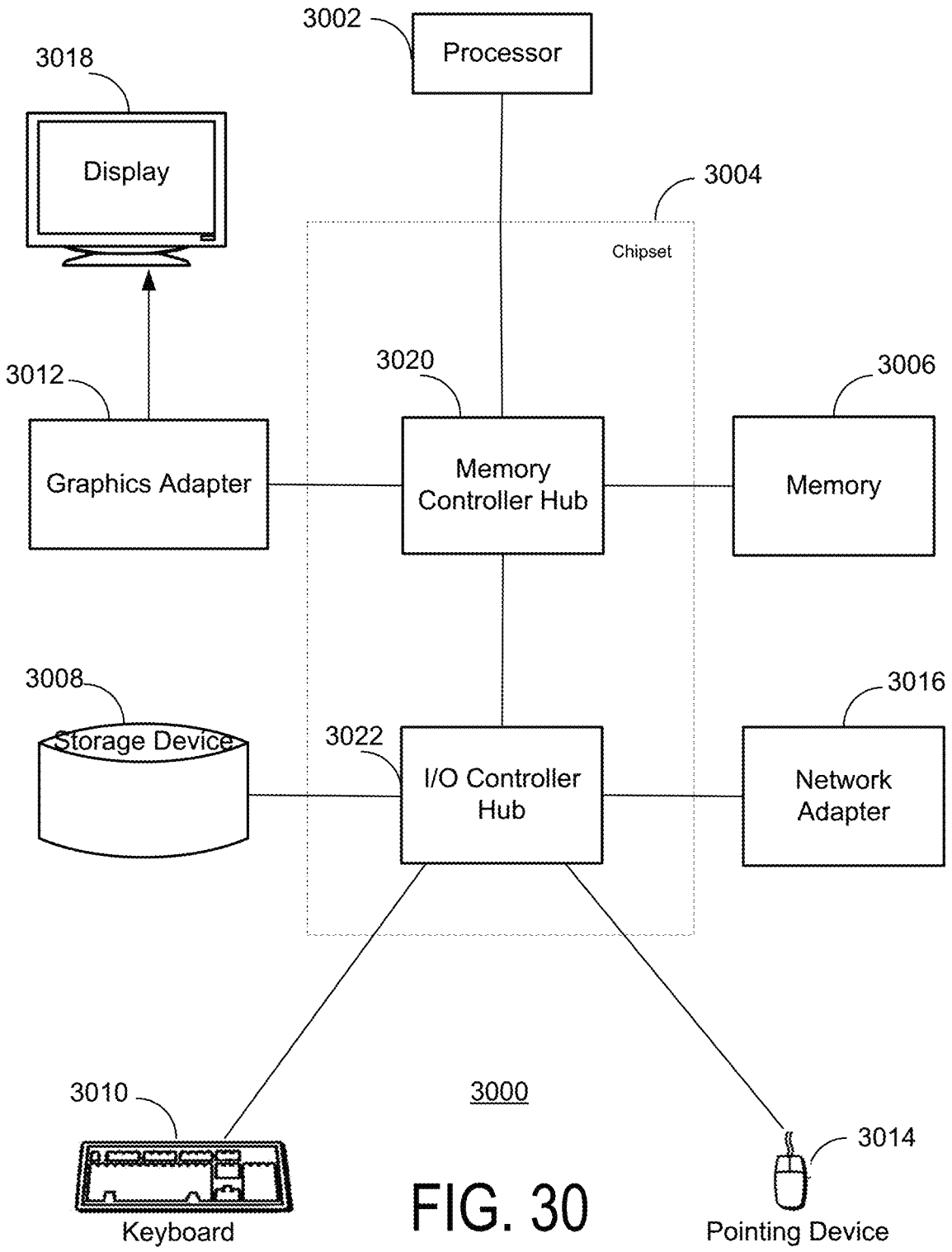
FIG. 30 is a schematic block diagram of a computer, in accordance with some embodiments

FIG. 30 is a schematic block diagram of a computer 3000, according to one embodiment. The computer 3000 is an example of circuitry that implements an audio system. Illustrated are at least one processor 3002 coupled to a chipset 3004. The chipset 3004 includes a memory controller hub 3020 and an input/output (I/O) controller hub 3022. A memory 3006 and a graphics adapter 3012 are coupled to the memory controller hub 3020, and a display device 3018 is coupled to the graphics adapter 3012. A storage device 3008, keyboard 3010, pointing device 3014, and network adapter 3016 are coupled to the I/O controller hub 3022. The computer 3000 may include various types of input or output devices. Other embodiments of the computer 3000 have different architectures. For example, the memory 3006 is directly coupled to the processor 3002 in some embodiments.

The storage device 3008 includes one or more non-transitory computer-readable storage media such as a hard drive, compact disk read-only memory (CD-ROM), DVD, or a solid-state memory device. The memory 3006 holds instructions and data used by the processor 3002. The pointing device 3014 is used in combination with the keyboard 3010 to input data into the computer system 3000. The graphics adapter 3012 displays images and other information on the display device 3018. In some embodiments, the display device 3018 includes a touch screen capability for receiving user input and selections. The network adapter 3016 couples the computer system 3000 to a network. Some embodiments of the computer 3000 have different and/or other components than those shown in FIG. 30.

The computer 3000 is adapted to execute computer program modules for providing functionality described herein. For example, some embodiments may include a computing device including one or more modules configured to perform the processing as discussed herein. As used herein, the term "module" refers to computer program instructions and/or other logic used to provide the specified functionality. Thus, a module can be implemented in hardware, firmware, and/or software. In one embodiment, program modules formed of executable computer program instructions are stored on the storage device 3008, loaded into the memory 3006, and executed by the processor 3002.

Upon reading this disclosure, those of skill in the art will appreciate still additional alternative embodiments the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the scope described herein.

Any of the steps, operations, or processes described herein may be performed or implemented with one or more hardware or software modules, alone or in combination with other devices. In one embodiment, a software module is implemented with a computer program product comprising a computer readable medium (e.g., non-transitory computer readable medium) containing computer program code, which can be executed by a computer processor for performing any or all of the steps, operations, or processes described.

What is claimed is:

1. A method for enhancing an audio signal having a left input channel and a right input channel, comprising:

generating a nonspatial component and a spatial component from the left input channel and the right input channel;

generating a mid compensation channel by applying first filters to the nonspatial component that compensate for spectral defects from crosstalk processing of the audio signal;

generating a side compensation channel by applying second filters to the spatial component that compensate for spectral defects from the crosstalk processing of the audio signal;

generating a left compensation channel and a right compensation channel from the mid compensation channel and the side compensation channel;

generating a left output channel using the left compensation channel; and generating a right output channel using the right compensation channel.

2. The method of claim 1, further comprising applying the crosstalk processing of the audio signal by applying one of a crosstalk simulation or a crosstalk cancellation.

3. The method of claim 2, wherein applying the crosstalk simulation includes:

generating a left crosstalk simulation channel by applying a first low-pass filter, a first high-pass filter, and a first delay to the left input channel to model a frequency response of a listener's head;

generating a right crosstalk simulation channel by applying a second low-pass filter, a second high-pass filter, and a second delay to the right input channel to model the frequency response of the listener's head;

combining the left compensation channel and the right crosstalk simulation channel to generate the left output channel; and combining the right compensation channel and the left crosstalk simulation channel to generate the right output channel.

4. The method of claim 1, further comprising applying the crosstalk processing to the audio signal to generate a crosstalk processed audio signal; and wherein:

generating the mid compensation channel includes applying the first filters to the nonspatial component of the crosstalk processed audio signal; and generating the side compensation channel includes applying the second filters to the nonspatial component of the crosstalk processed audio signal.

5. The method of claim 1, further comprising applying the crosstalk processing to the left compensation channel and the right compensation channel.

6. The method of claim 1, further comprising:

applying first subband gains to subbands of the nonspatial component to generate an enhanced nonspatial component;

applying second subband gains to subbands of the spatial component to generate an enhanced spatial component; and wherein:

generating the mid compensation channel includes applying the first filters to the enhanced nonspatial component; and generating the side compensation channel includes applying the second filters to the enhanced spatial component.

7. The method of claim 1, further comprising:

applying a subband spatial processing to the left input channel and the right input channel to generate a left spatially enhanced channel and a right spatially enhanced channel;

generating a left enhanced compensation channel by combining the left compensation channel and the left spatially enhanced channel;

generating a right enhanced compensation channel by combining the right compensation channel and the right spatially enhanced channel; and applying the crosstalk processing on the left enhanced compensation channel and the right enhanced compensation channel to generate the left output channel and the right output channel.

8. The method of claim 1, wherein:

the method further includes:

applying a subband spatial processing to the left input channel and the right input channel to generate a left spatially enhanced channel and a right spatially enhanced channel; and applying the crosstalk processing on the left spatially enhanced channel and the right spatially enhanced channel to generate a left enhanced crosstalk channel and a right enhanced crosstalk channel;

generating the mid compensation channel includes applying the first filters to a nonspatial component of the left enhanced crosstalk channel and the right enhanced crosstalk channel; and generating the side compensation channel by applying the second filters to a spatial component of the left enhanced crosstalk channel and the right enhanced crosstalk channel.

9. The method of claim 1, further comprising applying a subband spatial processing to the left compensation channel and the right compensation channel to generate a spatially enhanced compensation signal, and applying the crosstalk processing on the spatially enhanced compensation signal.

10. The method of claim 1, wherein:

the method further includes applying a subband spatial processing to the left input channel and right input channel to generate a spatially enhanced signal;

generating the mid compensation channel includes applying the first filters to the nonspatial component of the spatially enhanced signal;

generating the side compensation channel includes applying the second filters to the spatial component of the spatially enhanced signal; and the method further includes applying the crosstalk processing using the left compensation channel and the right compensation channel generated from the mid and side compensation channels.

11. A system for enhancing an audio signal having a left input channel and a right input channel, comprising:

circuitry configured to:

generate a nonspatial component and a spatial component from the left input channel and the right input channel;

generate a mid compensation channel by applying first filters to the nonspatial component that compensate for spectral defects from crosstalk processing of the audio signal;

generate a side compensation channel by applying second filters to the spatial component that compensate for spectral defects from the crosstalk processing of the audio signal;

generate a left compensation channel and a right compensation channel from the mid compensation channel and the side compensation channel;

generate a left output channel using the left compensation channel; and generate a right output channel using the right compensation channel.

12. The system of claim 11, wherein the circuitry is further configured to apply the crosstalk processing of the audio signal by applying one of a crosstalk simulation or a crosstalk cancellation.

13. The system of claim 12, wherein the circuitry configured to apply the crosstalk simulation includes the circuitry being configured to:

generate a left crosstalk simulation channel by applying a first low-pass filter, a first high-pass filter, and a first delay to the left input channel to model a frequency response of a listener's head;

generate a right crosstalk simulation channel by applying a second low-pass filter, a second high-pass filter, and a second delay to the right input channel to model the frequency response of the listener's head;

combine the left compensation channel and the right crosstalk simulation channel to generate the left output channel; and combine the right compensation channel and the left crosstalk simulation channel to generate the right output channel.

14. The system of claim 11, wherein the circuitry is further configured to apply the crosstalk processing to the audio signal to generate a crosstalk processed audio signal, and wherein:

the circuitry configured to generate the mid compensation channel includes the circuitry being configured to apply the first filters to the nonspatial component of the crosstalk processed audio signal; and the circuitry configured to generate the side compensation channel includes the circuitry being configured to apply the second filters to the nonspatial component of the crosstalk processed audio signal.

15. The system of claim 11, wherein the circuitry is further configured to apply the crosstalk processing to the left compensation channel and the right compensation channel.

16. The system of claim 11, wherein:

the circuitry is further configured to:

apply first subband gains to subbands of the nonspatial component to generate an enhanced nonspatial component; and apply second subband gains to subbands of the spatial component to generate an enhanced spatial component;

the circuitry configured to generate the mid compensation channel includes the circuitry being configured to apply the first filters to the enhanced nonspatial component; and the circuitry configured to generate the side compensation channel includes the circuitry being configured to apply the second filters to the enhanced spatial component.

17. The system of claim 11, wherein the circuitry is further configured to:

apply a subband spatial processing to the left input channel and the right input channel to generate a left spatially enhanced channel and a right spatially enhanced channel;

generate a left enhanced compensation channel by combining the left compensation channel and the left spatially enhanced channel;

generate a right enhanced compensation channel by combining the right compensation channel and the right spatially enhanced channel; and apply the crosstalk processing on the left enhanced compensation channel and the right enhanced compensation channel to generate the left output channel and the right output channel.

18. The system of claim 11, wherein:

the circuitry is further configured to:

apply a subband spatial processing to the left input channel and the right input channel to generate a left spatially enhanced channel and a right spatially enhanced channel; and apply the crosstalk processing on the left spatially enhanced channel and the right spatially enhanced channel to generate a left enhanced crosstalk channel and a right enhanced crosstalk channel;

the circuitry configured to generate the mid compensation channel includes the circuitry being configured to apply the first filters to a nonspatial component of the left enhanced crosstalk channel and the right enhanced crosstalk channel; and the circuitry configured to generate the side compensation channel includes the circuitry being configured to apply the second filters to a spatial component of the left enhanced crosstalk channel and the right enhanced crosstalk channel.

19. The system of claim 11, wherein the circuitry is further configured to apply a subband spatial processing to the left compensation channel and the right compensation channel to generate a spatially enhanced compensation signal, and apply the crosstalk processing on the spatially enhanced compensation signal.

20. The system of claim 11, wherein:

the circuitry is further configured to apply a subband spatial processing to the left input channel and right input channel to generate a spatially enhanced signal;

the circuitry configured to generate the mid compensation channel includes the circuitry being configured to apply the first filters to the nonspatial component of the spatially enhanced signal;

the circuitry configured to generate the side compensation channel includes the circuitry being configured to apply the second filters to the spatial component of the spatially enhanced signal; and the circuitry is further configured to apply the crosstalk processing using the left compensation channel and the right compensation channel generated from the mid and side compensation channels.

21. A non-transitory computer readable medium storing program code that when executed by a processor causes the processor to:

generate a nonspatial component and a spatial component from a left input channel and a right input channel of an audio signal;

generate a mid compensation channel by applying first filters to the nonspatial component that compensate for spectral defects from crosstalk processing of the audio signal;

generate a side compensation channel by applying second filters to the spatial component that compensate for spectral defects from the crosstalk processing of the audio signal;

generate a left compensation channel and a right compensation channel from the mid compensation channel and the side compensation channel;

generate a left output channel using the left compensation channel; and generate a right output channel using the right compensation channel.

22. The computer readable medium of claim 21, wherein the program code further configures the processor to perform the crosstalk processing of the audio signal by applying one of a crosstalk simulation or a crosstalk cancellation.

* * * * *